US007429826B2

(12) United States Patent
Kawai

(10) Patent No.: US 7,429,826 B2
(45) **Date of Patent: *Sep. 30, 2008**

(54) INDIRECTLY HEATED ELECTRODE FOR GAS DISCHARGE TUBE, GAS DISCHARGE TUBE USING SAID INDIRECTLY HEATED ELECTRODE, AND LIGHTING DEVICE FOR SAID GAS DISCHARGE TUBE

(75) Inventor: Koji Kawai, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 65 days.

This patent is subject to a terminal disclaimer.

(21) Appl. No.: 11/222,934

(22) Filed: Sep. 12, 2005

(65) Prior Publication Data

US 2006/0071606 A1 Apr. 6, 2006

Related U.S. Application Data

(63) Continuation of application No. 10/450,110, filed as application No. PCT/JP01/10940 on Dec. 13, 2001, now Pat. No. 7,193,367.

(30) Foreign Application Priority Data

| | | |
|---|---|---|
| Dec. 13, 2000 | (JP) | P2000-379360 |
| Aug. 6, 2001 | (JP) | P2001-238207 |
| Aug. 6, 2001 | (JP) | P2001-238226 |

(51) Int. Cl.
*H01J 17/02* (2006.01)

(52) U.S. Cl. ..... 315/94; 314/94; 314/107; 314/339; 314/337; 313/340

(58) Field of Classification Search ..... None
See application file for complete search history.

(56) References Cited

U.S. PATENT DOCUMENTS

| | | | | |
|---|---|---|---|---|
| 1,983,621 | A | 12/1934 | Loewe et al. | 313/340 |
| 2,107,945 | A | 2/1938 | Hull et al. | |

(Continued)

FOREIGN PATENT DOCUMENTS

| | | |
|---|---|---|
| EP | 0384406 | 8/1990 |

(Continued)

*Primary Examiner*—Douglas W. Owens
*Assistant Examiner*—Chuc Tran
(74) *Attorney, Agent, or Firm*—Drinker Biddle & Reath LLP

(57) ABSTRACT

An indirectly heated cathode C1 comprises a heater 1, a double coil 2, a mesh member 3, and a metal oxide 10. An electrical insulating layer 4 is formed on the surface of heater 1. Heater 1 is inserted into and positioned at the inner side of double coil 2. Mesh member 3 is disposed along the length direction of double coil 2 at the outer side of double coil 2. Double coil 2 is grounded by being connected to the ground terminal of heater 1 via a lead rod 7. Metal oxide 10 is held by double coil 2 and disposed to be in contact with mesh member 3. Metal oxide 10 and mesh member 3 are exposed to the outer side of indirectly heated electrode C1 so that the surface of metal oxide 10 and the surface of mesh member 3 make up a discharge surface and mesh member 3 is in contact with the surface part of metal oxide 10.

43 Claims, 58 Drawing Sheets

U.S. PATENT DOCUMENTS

| | | | | |
|---|---|---|---|---|
| 2,704,821 | A | 3/1955 | Bain et al. | |
| 3,003,077 | A | 10/1961 | Thomas | 313/343 |
| 3,662,211 | A | 5/1972 | Millis | 313/340 |
| 3,736,458 | A | 5/1973 | Miller, Jr. et al. | |
| 4,441,048 | A | 4/1984 | Takaoka et al. | |
| 4,780,645 | A | 10/1988 | Toho et al. | |
| 4,886,995 | A | 12/1989 | Takakura et al. | |
| 5,159,236 | A | 10/1992 | Kawai | |
| 5,343,112 | A | 8/1994 | Wegmann et al. | |
| 5,646,487 | A | 7/1997 | Ikedo et al. | |
| 2004/0051435 | A1 | 3/2004 | Kawai | |
| 2004/0051436 | A1* | 3/2004 | Kawai | 313/346 DC |

FOREIGN PATENT DOCUMENTS

| | | |
|---|---|---|
| EP | 1351275 | 10/2003 |
| GB | 444737 | 8/1934 |
| GB | 766881 | 1/1957 |
| GB | 1006423 | 9/1965 |
| JP | 57-147860 | 9/1982 |
| JP | 58-60852 | 4/1983 |
| JP | 1-206537 | 8/1989 |
| JP | 2-181352 | 7/1990 |
| JP | 02-220345 | 9/1990 |
| JP | 02-0220346 | 9/1990 |
| JP | 4-137422 | 5/1992 |
| JP | 4-292829 | 10/1992 |
| JP | 04-306550 | 10/1992 |
| JP | 04-315761 | 11/1992 |
| JP | 4-357659 | 12/1992 |
| JP | 04-370642 | 12/1992 |
| JP | 07-29545 | 1/1995 |
| JP | 62-56628 | 11/1997 |
| JP | 63-029439 | 2/1998 |

* cited by examiner

Ebb [V]
160
120
0

HEATER [V]
10
0

ACROSS GND AND ANODE [V]
130
0

AUXILIARY LIGHTING CIRCUIT UNIT [V]
130
0

MAKE-AND-BREAK SWITCHING CIRCUIT UNIT [V]
90
0

NEGATIVE RESISTANCE [V]
30
0
ON
LIGHTING
OFF
A1
A2
A3

HEATER [mA]
300
0
0

ACROSS GND
AND ANODE [mA]
300
0

AUXILIARY LIGHTING
CIRCUIT UNIT [mA]
SEVERALmA
0

MAKE-AND-BREAK
SWITCHING CIRCUIT
UNIT [mA]
300
0

NEGATIVE
RESISTANCE [mA]
300
0
ON
LIGHTING
OFF
A1
A2
A3

INDIRECTLY HEATED ELECTRODE FOR GAS DISCHARGE TUBE, GAS DISCHARGE TUBE USING SAID INDIRECTLY HEATED ELECTRODE, AND LIGHTING DEVICE FOR SAID GAS DISCHARGE TUBE

This is a continuation application of application Ser. No. 10/450,110, having a § 371 date of Jun. 11, 2003 now U.S. Pat. No. 7,193,367, which is a national stage filing based on PCT International Application No. PCT/JP01/10940, filed on Dec. 13, 2001. The application Ser. No. 10/450,110 is incorporated by reference herein in its entirety.

FIELD OF THE ART

The present invention concerns an indirectly heated electrode for gas discharge tube, a gas discharge tube using this indirectly heated electrode for gas discharge tube, and a lighting device for the gas discharge tube using the abovementioned indirectly heated electrode for gas discharge tube.

BACKGROUND ART

A known example of the abovementioned indirectly heated electrode for gas discharge tube is that which is disclosed in Japanese Examined Patent Publication No. 62-56628 (U.S. Pat. No. 4,441,048). The indirectly heated electrode for gas discharge tube (indirectly heated cathode for gas discharge tube) that is disclosed in Japanese Examined Patent Publication No. 62-56628 has an arrangement wherein a double coil is wound a plurality of turns around and fixed closely to the outer wall of a cylinder of good thermal conductivity, a uniform cathode surface is formed by applying a paste-form cathode material in the space inside the primary coil and between the secondary coil of the double coil, and providing a heater inside the cylinder.

DISCLOSURE OF THE INVENTION

An object of the present invention is to provide an indirectly heated electrode for gas discharge tube, which is elongated in the service life of the electrode and enables a stable discharge to be obtained, a gas discharge tube using this indirectly heated electrode for gas discharge tube, and a lighting device using the gas discharge tube that uses the abovementioned indirectly heated electrode for gas discharge tube.

Using the discharge surface potential as an experimental factor, the present inventor made comparisons with prior-art indirectly heated electrodes (indirectly heated cathodes), mainly in regard to the cathode fall voltage (box potential), and as a result of research, made the following new findings.

The terms, "equipotential surface," "equipotential interface," and "box potential," and the modes of discharge, which are used below, shall be defined as follows. An "equipotential surface" shall be defined as a state in which a discharge surface that is in an equipotential state in terms of electric potential is formed. An "equipotential interface" shall be defined as a structure with which a metal oxide is contact coated, as a material likely to emit electrons, onto an equipotential surface and put in contact with a gas. "Box potential" shall be defined as the potential that is generated between a cathode and a terminal that is in the vicinity of the cathode but is electrically insulated from the cathode during discharge. This value is approximately the cathode fall voltage, which is a term among generally used terms for discharge properties. An "ionic current" shall be defined as a current generated by ionized gas resulting from the ionization of the gas molecules in a gas discharge tube due to collision of the gas molecules with electrons. "Thermionic emission" refers to an electron emission phenomenon, that is, an emission of electrons into space that occurs when the temperature of a metal is raised and the thermal kinetic energy increases beyond the electron energy barrier (work function) of the metal, and here, this term refers to an emission of electrons from a metal oxide that is a chemically unstable material likely to emit electrons. "Secondary electron emission" refers to an electron emission phenomenon, that is, an emission of electrons into space from a cathode when an ionized gas collides with the cathode.

A comparison of the box potentials before and after the attaining of an equipotential state in DC operation shows that these box potentials differ significantly as shown in FIG. 64. The present inventor prepared an equipotential interface model and examined the research results of this phenomenon. The modes of discharge in gas discharge can be expressed substantially by the three modes of ion current, thermionic emission, and secondary electron emission, and theoretically, these can be expressed by the relationship equations shown below. The discharge mode in vacuum discharge can be practically expressed by just thermionic emission and thus differs from the discharge modes of gas discharge.

$$Id=Ii+Ie=Ii\,(1+\gamma)+Ith \tag{1}$$

$$Ie=Ith+\gamma Ii \tag{2}$$

$$Vc=\{Vo+(1-Ith/Id)\}/\{\alpha(\gamma+Ith/Id)\} \tag{3}$$

Equations related to the Schottky effect:

$$Ie=Ith\,\exp\{(e/kT)\mathrm{sqr}(eE/4\pi\epsilon\sigma) \tag{4}$$

$$Ith=SAT\hat{}2*\exp(-e\phi/kT) \tag{5}$$

$$Ise=Ith/\exp[(e/kT)\mathrm{sqr}(eE/4\pi\epsilon\sigma)-1] \tag{6}$$

In the above, Ii: ion current
Ie: emission current
Ith: thermionic current
Ise: secondary electron current
Id: discharge current
Vc: cathode fall voltage
$\gamma$: factor (gain) related to secondary electron emission
$\alpha$, Vo: parameters
S: surface area of electrode
A: constant determined by the material
T: cathode temperature
e: negative charge of an electron
$\phi$: work function
k: Boltzmann's constant
$\epsilon o$: dielectric constant of vacuum
E: electric field strength at cathode fall part The ion current (corresponding to Ii) and the emission current (electrons: corresponding to Ie) in a gas discharge tube shall now be considered. In comparison to an electron with a static weight of $9.109\times10^{-31}$ kg, even hydrogen, which is the lightest element, is considerably heavier with amass of $1.675\times10^{-27}$ kg. Furthermore, whereas ionized gas is drawn towards and collides with the cathode, an electron is detached from the cathode. The impact force of ionized gas thus exceeds the impact force of an electron and the damage that ionized gas applies to the cathode is greater than the damage due to an electron. The detrimental effect that an ion current has on the cathode can be understood from the above. Meanwhile, from the standpoint of light emission and discharge phenomenon of a gas discharge tube, the ionized gas contributes as a light emitting material and also provides the effect of drawing out more discharge current into space in accordance to the ion current in comparison to vacuum. With a gas discharge tube, it is important in terms of service life characteristics and stability to minimize the effects on the cathode while taking into consideration the merits and demerits of the ion current.

The box potential approximates the cathode fall voltage, indicates the excitation and ionization states of the gas in relative manner, and serves as a guideline for the amount of ionized gas generated. A lower box potential indicates a lower amount of ionized gas generated.

It was mentioned above that, in gas discharge, there are the three discharge modes of ion current, thermionic emission, and secondary electron emission. Thermionic emission is caused by the heating of barium or other metal oxide as a material likely to emit electrons. Thermionic emission serves the role of causing gas ionization at the beginning of discharge and thereby initiating discharge. In the case of gas discharge, after the initiation of discharge, ionized gas begins to collide in a manner such that it becomes drawn towards the thermions that are emitted from the metal oxide that is the material likely to emit electrons. As a result of the collision of the ionized gas in this process, secondary electron emission occurs mainly from the interface between an electric conductor and the metal oxide that is the material likely to emit electrons. In the case of gas discharge, the discharge current density per unit area becomes several dozen to several hundred times that of vacuum discharge and a large part of the total discharge current is formed by secondary electron emission.

With regard to the supply of secondary electrons, the electrical resistivity of the metal oxide that is the material likely to emit electrons is considerably greater than that of the electrical conductor, the amount supplied by just the metal oxide that is the material likely to emit electrons is limited, and much of the secondary electrons supplied are supplied via the electrical conductor and emitted from the interface between the metal oxide that is the material likely to emit electrons. With regard to how the electrons that become the basis of secondary electrons are supplied to the electrical conductor, these may be supplied directly from an external circuit or may be supplied via the surface of contact with the metal oxide that is the material likely to emit electrons. Though thermionic emission from the metal oxide that is the material likely to emit electrons that does not form an interface with the electrical conductor also occurs, as mentioned above, in regard to the supply of secondary electrons, there is a limit to the supply from just the metal oxide that is the material likely to emit electrons, and in gas discharge, the absolute amount taken up by the discharge current from just the metal oxide that is the material likely to emit electrons is extremely low. To summarize the above, the location in the cathode at which electron emission mainly occurs during gas discharge is the interface of electrical conductor and the metal oxide that is the material likely to emit electrons.

A model of an equipotential interface model shall now be described with reference to FIGS. 64 and 65. FIG. 64 is a graph (model graph) in which the abscissa indicates the heater application voltage (Vf), in other words, the increase and decrease of the cathode temperature due to the amount of forced heating of the cathode, and the ordinate indicates the cathode fall voltage (box potential) (Vc). FIG. 65 is a graph (model graph) in which the abscissa likewise indicates the heater application voltage (Vf) and the ordinate indicates the discharge current (Id). In FIG. 65, the ordinate expresses the proportions (distribution of regions) taken up by thermionic current, secondary electron current, and ion current at a fixed discharge current. In FIG. 64, the ordinate expresses the magnitude.

Besides the heater application voltage (Vf), that is, the amount of forced heating of the cathode, the amount of so-called self-heating, which occurs when the ionized gas collides with the cathode, is also a component factor of the cathode temperature, and the cathode temperature is determined by the total of these heating amounts. In a region in which the amount of heat loss from the cathode is high, the thermion generation amount is low, the ion current becomes dominant in a compensating manner, and the cathode fall voltage becomes greater than or equal to the ionization voltage, thereby accelerating the generation of ionized gas. If in this region, the electric potential distribution of the cathode surface is non-uniform, localized discharge (skewing of the discharge position) due to concentrating of the ion current and secondary electron current occurs readily, leading to large damage of the cathode surface due to ionized gas impact and tending to cause the cathode material (metal oxide that is the material likely to emit electrons) to undergo removal (sputtering) and stabilization (mineralization) by oxidation with the reduced metal.

On the other hand, in the region at the left side of FIG. 64 at which the cathode temperature is high, in other words, the mount of forced heating is high or the amount of heat accumulated in the cathode is high due to the discharge area being small, the thermion generation amount becomes excessive, the ion current decreases in a compensating manner, and the cathode fall voltage becomes less than or equal to the ionization voltage. However, the rise of the cathode temperature increases the vapor pressure of the cathode component material and tends to cause loss of the metal oxide that is the material likely to emit electrons by vaporization. Excess or lack of the heating amount of the cathode is unfavorable for the above reasons. As a guideline of the operation region, operation in the vicinity of the ionization voltage is favorable in terms of the box potential (cathode fall voltage).

An important component factor of the present model is the discharge area. This can be regarded as equivalent to the electrode surface area (S) in the relationship equations. As mentioned above, in gas discharge, electron emission from the interface of the electrical conductor and the metal oxide that is the material likely to emit electrons constitutes the main part of the discharge. In addition, the discharge area differs not only according to the uniformity of temperature but also according to whether or not the potential is uniform (equipotential). That is, the discharge area is proportional to the area of the equipotential surface or the length of the equipotential surface part, and as the equipotential surface becomes wider or longer, the electrode surface (S: discharge area) increases, the proportion of thermionic current (Ith) increases in accordance to the above Equation (5), the amount of ion current decreases in accordance to the above Equation (1), the ion current and the secondary electron current become dispersed across the equipotential surface, the distribution of regions of the model of FIG. 65 shifts from the thin line part (prior to attainment of an equipotential state) to the thick line part (after attainment of an equipotential state), and the box potential (cathode fall voltage) of FIG. 64 drops in accordance to the above Equation (3). By employing the presently described structures of the equipotential surface and the equipotential interface of the metal oxide and the gas, the decrease of the box potential in FIG. 64 can be explained by the decrease of the ion current amount in the discharge current due to increase of the thermion amount.

It can be understood from the above that with gas discharge, by decreasing the amount of ion current in comparison to a conventional cathode that is not put in an equipotential state, the impact of ionized gas per unit discharge area can be relaxed, and as a result, the load on the cathode is lightened, the lowering of the thermion emission ability is lessened, and the service life characteristics are improved, and in accompaniment, the movement of the discharge position is lessened and the stability is improved.

The effectiveness of an equipotential surface for a gas discharge tube shall now be discussed. As mentioned above, with vacuum discharge, the mode of discharge can be expressed by just thermionic emission, and vacuum discharge thus differs in the mode of discharge from gas discharge. The discharge area in vacuum discharge can said to be determined by the surface area formed by the metal oxide that is the material likely to emit electrons at the thermionic emission surface. The discharge area components in a gas discharge tube having the discharge modes of ion current and secondary electron emission in addition to thermionic emission thus differs from the discharge area components in vacuum discharge, and since with a cathode in gas discharge, the location at which electron emission principally occurs is the interface of the electrical conductor and the metal oxide that is the material likely to emit electrons, it was found that an equipotential surface, which is formed of the electrical conductor and is substantially equalized in potential, is effective as a discharge surface in gas discharge.

Furthermore, by making the material, to be used as the means for forming an equipotential surface, have a mesh structure, a wire structure, or a plate-and-filament structure, such as a ribbon structure or a foil structure, the amount of heat loss can be restrained while restraining as much as possible the increase of the surface area that is to be the heat radiating surface and the volume that is to be the heat transfer part. By increasing the parts of contact of the metal oxide and the equipotential surface, as a result, the discharge area is increased. From the above, it was found that by making the material, to be used as the means for forming an equipotential surface, have a mesh structure, a wire structure, or a plate-and-filament structure, the effect of the equipotential surface can be increased.

In a conventional case where the potential distribution of the cathode surface is non-uniform, since the heat generation amount is non-uniform accordingly, the density of thermion generation is also non-uniform and localized discharge (skewing of the discharge position) occurs due to the concentrating of ion current and secondary electron current. Localized discharge causes the cathode material (metal oxide that is the material likely to emit electrons) to undergo removal (sputtering) and stabilization (mineralization) by oxidation with the reduced metal, that is, causes degradation of the thermionic emission ability and movement of the discharge position to another position with better thermionic emission characteristics. By thus repeating localized degradation of thermionic emission, the cathode surface becomes degraded. The abovementioned movement of the discharge position also causes the discharge itself to become unstable.

Based on the above research results, the present invention provides, in an indirectly heated electrode for gas discharge tube, to be used in a gas discharge tube in which gas is sealed in an airtight manner, the indirectly heated electrode for gas discharge tube comprising: a heater, having an electrical insulating layer formed on a surface thereof; an electron emitting part, emitting electrons upon receiving heat from the heater; and an electrical conductor, disposed at the surface most part of the electron emitting part and having a predetermined length.

In the indirectly heated electrode for gas discharge tube of the present invention, since an equipotential surface is effectively formed at the electron emitting part by the electrical conductor and thermionic emission thus occurs over a wide region of the equipotential surface that is formed, the discharge area is increased, the electron emission amount per unit area (electron emission density) is increased, and the load placed on the discharge position is lightened. The occurrence of localized discharge can thus be restrained and long service life of the indirectly heated electrode for gas discharge tube can be realized. Since the movement of the discharge position is also restrained, stable discharge can be obtained over a long period of time. Also due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

Also, the electron emitting part preferably comprises: a metal oxide as a material likely to emit electrons; and a coil member, which holds the metal oxide; and the electrical conductor is preferably put in contact with the metal oxide and in contact with a plurality of coil portions of the coil member along the length direction of the coil member. In this case, the potential of the discharge surface that is made up of a plurality of discharge points or discharge lines by the electrical conductor is made substantially uniform. The sputtering of the metal oxide and stabilization (mineralization) due to oxidation with the reduced metal, which are degradation factors, can thus be restrained, that is, the degradation of the thermionic emission ability can be restrained and the movement of the discharge position can be restrained as well. As a result, long service life and stable discharge of an indirectly heated electrode for gas discharge tube can be realized by a simple arrangement in which an electrical conductor is disposed so as to be in contact with a metal oxide.

Also, the coil member is preferably a multiple coil arranged by winding a coil in coil form. In this case, the metal oxide that is the material likely to emit electrons is held in a manner where it is sandwiched between the pitches (spacings), which are the gaps between the wire material that forms the coil. Since the distance between pitches is small and gap-like, the falling off the metal oxide due to vibration can be restrained. Also, since a plurality of pitches of gap-like structure exist, a large amount of metal oxide can be held, providing the effect of replenishing the metal oxide loss that accompanies the degradation with time during discharge.

Also, the coil member is preferably a multiple coil, arranged by winding a coil having a mandrel in coil form. In this case, the metal oxide that is the material likely to emit electrons is held in a manner where it is sandwiched between the pitches (spacings), which are the gaps between the wire material that forms the coil. Since the distance between pitches is small and gap-like, the falling off the metal oxide due to vibration can be restrained. Also, since a plurality of pitches of gap-like structure exist, a large amount of metal oxide can be held, providing the effect of replenishing the metal oxide loss that accompanies the degradation with time during discharge. Furthermore, since a mandrel is provided, deformation of the multiple coil during processing can be restrained.

Also, the electrical conductor is preferably a high-melting-point metal that has been formed to a mesh. By making the electrical conductor a high-melting-point metal that has been made formed to a mesh, an electrical conductor, which can restrain the degradation of the thermionic emission ability and the movement of the discharge position, can be realized at low cost and in a simpler manner. Since the electrical conductor in this case is a rigid body, it is easy to process and can be put in close contact with the metal oxide. The locations at which the high-melting-point metal contacts the metal oxide can readily made large in number as well.

Also, the electrical conductor is preferably a high-melting-point metal that has been formed to a wire or a plate. By making the electrical conductor a high-melting-point metal that has been formed to a wire or a plate, an electrical conductor, which can restrain the degradation of the thermionic emission ability and the movement of the discharge position, can be realized at low cost and in a simpler manner. Since the electrical conductor in this case is a rigid body, it is easy to process and can be put in close contact with the metal oxide. With the present Specification, "plate" shall refer inclusively to such shapes as a ribbon shape, foil shape, etc.

Also, the metal oxide is preferably an oxide of a single metal among barium (Ba), strontium (Sr), and calcium (Ca) or a mixture of oxides of these metals or contains an oxide of a rare earth metal. By the metal oxide being an oxide of a single metal among barium, strontium, and calcium or a mixture of oxides of these metals or containing an oxide of a rare earth metal, the work function of the electron emitting part can be made small effectively and the emission of thermions can thus be facilitated.

It is also preferable to have in addition a tubular base metal and for the heater to be disposed at the inner side of the base metal and the electron emitting part to be disposed at the outer side of the base metal. In this case, the heat of the heater can be transferred definitely to the electron emitting part in the active state. Though a cylindrical shape is generally used as the shape of the base metal, the shape may also be an arcuate shape with a notched part.

The present invention provides an indirectly heated electrode for gas discharge tube comprising: a coil member, wound in coil form; a heater, disposed at the inner side of the coil member and having an electrical insulating layer formed on a surface thereof; a high-melting-point metal, formed to a mesh and disposed along the length direction of the coil member at the outer side of the coil member; and a metal oxide, serving as a material likely to emit electrons and held by the coil member so as to be in contact with the high-melting-point metal, and wherein the metal oxide is set to a ground potential.

In the indirectly heated electrode for gas discharge tube of the present invention, since an equipotential surface is effectively formed at the electrode surface by the high-melting-point metal that is formed to a mesh and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the indirectly heated electrode for gas discharge tube can be realized. Since the movement of the discharge position is also restrained, stable discharge over a long period of time can be realized. Also, since the high-melting-point metal is a rigid body, it is easy to process and can be put in close contact with the metal oxide. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

The present invention provides an indirectly heated electrode for gas discharge tube comprising: a coil member, wound in coil form; a heater, disposed at the inner side of the coil member and having an electrical insulating layer formed on a surface thereof; a high-melting-point metal, formed to a mesh and disposed along the length direction of the coil member at the outer side of the coil member; and a metal oxide, serving as a material likely to emit electrons and held by the coil member so as to be in contact with the high-melting-point metal, and wherein the coil member is grounded.

In the indirectly heated electrode for gas discharge tube of the present invention, since the coil member is grounded, thermions, secondary electrons, etc. are supplied via this coil member. Also, since an equipotential surface is effectively formed at the electrode surface by the high-melting-point metal that is formed to a mesh and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the indirectly heated electrode for gas discharge tube can be realized. Since the movement of the discharge position is also restrained, stable discharge over a long period of time can be realized. Also, since the high-melting-point metal is a rigid body, it is easy to process and can be put in close contact with the metal oxide. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

The present invention provides an indirectly heated electrode for gas discharge tube comprising: a coil member, wound in coil form; a heater, disposed at the inner side of the coil member and having an electrical insulating layer formed on a surface thereof; a high-melting-point metal, formed to a mesh and disposed along the length direction of the coil member at the outer side of the coil member; and a metal oxide, serving as a material likely to emit electrons and held by the coil member so as to be in contact with the high-melting-point metal, and wherein the high-melting-point metal is grounded.

In the indirectly heated electrode for gas discharge tube of the present invention, since the high-melting-point metal is grounded, thermions, secondary electrons, etc. are supplied via this high-melting-point metal. Also, since an equipotential surface is effectively formed at the electrode surface by the high-melting-point metal that is formed to a mesh and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the indirectly heated electrode for gas discharge tube can be realized. Since the movement of the discharge position is also restrained, stable discharge over a long period of time can be realized. Also, since the high-melting-point metal is a rigid body, it is easy to process and can be put in close contact with the metal oxide. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

The present invention provides an indirectly heated electrode for gas discharge tube comprising: a coil member, wound in coil form; a heater, disposed at the inner side of the coil member and having an electrical insulating layer formed on a surface thereof; a high-melting-point metal, formed to a wire or a plate and disposed along the length direction of the coil member at the outer side of the coil member; and a metal oxide, serving as a material likely to emit electrons and held by the coil member so as to be in contact with the high-melting-point metal; and wherein the high-melting-point metal is in electrical contact with the coil member at a plurality of locations and the coil member is grounded.

In the indirectly heated electrode for gas discharge tube of the present invention, since the coil member is grounded, thermions, secondary electrons, etc. are supplied via this coil member. Also, since an equipotential surface is effectively formed at the electrode surface by the high-melting-point metal that is formed to a wire or a plate and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the electrode can be realized. Since the movement of the discharge position is also restrained, stable discharge over a long period of time can be realized. Also, since the high-melting-point metal is a rigid body, it is easy to process and can be put in close contact with the metal oxide. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

The present invention provides an indirectly heated electrode for gas discharge tube comprising: a coil member, wound in coil form; a heater, disposed at the inner side of the coil member and having an electrical insulating layer formed on a surface thereof; a high-melting-point metal, formed to a wire or a plate and disposed along the length direction of the coil member at the outer side of the coil member; and a metal oxide, serving as a material likely to emit electrons and held by the coil member so as to be in contact with the high-melting-point metal; and wherein the high-melting-point metal is in electrical contact with the coil member at a plurality of locations and the high-melting-point metal is grounded.

In the indirectly heated electrode for gas discharge tube of the present invention, since the high-melting-point metal is grounded, thermions, secondary electrons, etc. are supplied via this high-melting-point metal and the coil member. Also, since an equipotential surface is effectively formed at the electrode surface by the high-melting-point metal that is formed to a wire or a plate and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the electrode can be realized. Since the movement of the discharge position is also restrained, stable discharge over a long period of time can be realized. Also, since the high-melting-point metal is a rigid body, it is easy to process and can be put in close contact with the metal oxide. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

The present invention provides an indirectly heated electrode for gas discharge tube comprising: a coil member, having a mandrel and wound in coil form; a heater, disposed at the inner side of the coil member and having an electrical insulating layer formed on a surface thereof; a high-melting-point metal, formed to a mesh and disposed along the length direction of the coil member at the outer side of the coil member; and a metal oxide, serving as a material likely to emit electrons and disposed so as to be in contact with the coil member, and wherein the metal oxide is set to a ground potential.

In the indirectly heated electrode for gas discharge tube of the present invention, since an equipotential surface is effectively formed at the electrode surface by the high-melting-point metal that is formed to a mesh and the surface part of the coil member, and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the electrode can be realized. Since the movement of the discharge position is also restrained, stable discharge over a long period of time can be realized. Since a mandrel is provided, deformation of the coil member during processing can be restrained. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

The present invention provides an indirectly heated electrode for gas discharge tube comprising: a coil member, having a mandrel and wound in coil form; a heater, disposed at the inner side of the coil member and having an electrical insulating layer formed on a surface thereof; a high-melting-point metal, formed to a mesh and disposed along the length direction of the coil member at the outer side of the coil member; and a metal oxide, serving as a material likely to emit electrons and disposed so as to be in contact with the coil member; and where in the coil member is grounded.

In the indirectly heated electrode for gas discharge tube of the present invention, since the coil member is grounded, thermions, secondary electrons, etc. are supplied via this coil member. Also, since an equipotential surface is effectively formed at the electrode surface by the high-melting-point metal that is formed to a mesh and the surface part of the coil member, and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the electrode can be realized. Since the movement of the discharge position is also restrained, stable discharge over a long period of time can be realized. Since a mandrel is provided, deformation of the coil member during processing can be restrained. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

The present invention provides an indirectly heated electrode for gas discharge tube comprising: a coil member, having a mandrel and wound in coil form; a heater, disposed at the inner side of the coil member and having an electrical insulating layer formed on a surface thereof; a high-melting-point metal, formed to a mesh and disposed along the length direction of the coil member at the outer side of the coil member; and a metal oxide, serving as a material likely to emit electrons and disposed so as to be in contact with the coil member; and wherein the high-melting-point metal is grounded.

In the indirectly heated electrode for gas discharge tube of the present invention, since the high-melting-point metal is grounded, thermions, secondary electrons, etc. are supplied via this high-melting-point metal. Also, since an equipotential surface is effectively formed at the electrode surface by the high-melting-point metal that is formed to a mesh and the surf ace part of the coil member, and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the electrode can be realized. Since the movement of the discharge position is also restrained, stabled is charge over a long period of time can be realized. Since a mandrel is provided, deformation of the coil member during processing can be restrained. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

The present invention provides an indirectly heated electrode for gas discharge tube comprising: a coil member, having a mandrel and wound in coil form; a heater, disposed at the inner side of the coil member and having an electrical insulating layer formed on a surface thereof; a high-melting-point metal, formed to a wire or a plate and disposed along the length direction of the coil member at the outer side of the coil member; and a metal oxide, serving as a material likely to emit electrons and disposed so as to be in contact with the coil member; and wherein the high-melting-point metal is in electrical contact with the coil member at a plurality of locations and the coil member is grounded.

In the indirectly heated electrode for gas discharge tube of the present invention, since the coil member is grounded, thermions, secondary electrons, etc. are supplied via this coil member. Also, since an equipotential surface is effectively formed at the electrode surface by the high-melting-point metal that is formed to a wire or a plate and the surface part of the coil member, and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the electrode can be realized. Since the movement of the discharge position is also restrained, stable discharge over a long period of time can be realized. Since a mandrel is provided, deformation of the coil member during processing can be restrained. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

The present invention provides an indirectly heated electrode for gas discharge tube comprising: a coil member, having a mandrel and wound in coil form; a heater, disposed at the inner side of the coil member and having an electrical insulating layer formed on a surface thereof; a high-melting-point metal, formed to a wire or a plate and disposed along the length direction of the coil member at the outer side of the coil member; and a metal oxide, serving as a material likely to emit electrons and disposed so as to be in contact with the coil member; and wherein the high-melting-point metal is in electrical contact with the coil member at a plurality of locations and the high-melting-point metal is grounded.

In the indirectly heated electrode for gas discharge tube of the present invention, since the high-melting-point metal is grounded, thermions, secondary electrons, etc. are supplied via this high-melting-point metal and the coil member. Also, since an equipotential surface is effectively formed at the electrode surface by the high-melting-point metal that is formed to a wire or a plate and the surface part of the coil member, and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the electrode can be realized. Since the movement of the discharge position is also restrained, stable discharge over a long period of time can be realized. Since a mandrel is provided, deformation of the coil member during processing can be restrained. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

It is favorable for the coil member to be a single coil. It is also favorable for the coil member to be a multiple coil arranged by winding a coil in coil form. In particular, in a case where the coil member is a multiple coil, the metal oxide that is the material likely to emit electrons is held in a manner where it is sandwiched between the pitches (spacings), which are the gaps between the wire material that forms the coil. Since the distance between pitches is small and gap-like, the falling off the metal oxide due to vibration can be restrained. Also, since a plurality of pitches of gap-like structure exist, a large amount of metal oxide can be held, providing the effect of replenishing the metal oxide loss that accompanies the degradation with time during discharge.

In the indirectly heated electrode for gas discharge tube of the present invention, since the high-melting-point metal is grounded, thermions, secondary electrons, etc. are supplied via this high-melting-point metal. Also, since an equipotential surface is effectively formed at the electrode surface by the high-melting-point metal that is formed to a wire or a plate and the surface part of the coil member, and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the electrode can be realized. Since the movement of the discharge position is also restrained, stable discharge over a long period of time can be realized. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

The present invention provides an indirectly heated electrode for gas discharge tube comprising: a base metal, formed to a tubular form; a heater, disposed at the inner side of the base metal and having an electrical insulating layer formed on a surface thereof; a coil member, wound in coil form around the outer side of the base metal; a high-melting-point metal, formed to a mesh and disposed along the length direction of the coil member at the outer side of the coil member; and a metal oxide, serving as a material likely to emit electrons and held by the coil member so as to be in contact with the high-melting-point metal; and wherein the metal oxide is set to a ground potential.

In the indirectly heated electrode for gas discharge tube of the present invention, since an equipotential surface is effectively formed at the electrode surface by the high-melting-point metal that is formed to a mesh and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the electrode can be realized. Since the movement of the discharge position is also restrained, stable discharge over a long period of time can be realized. Also, by the base metal, the heat of the heater can be transferred without fail to the metal oxide in the active state. Also, since the high-melting-point metal is a rigid body, it is easy to process and can be put in close contact with the metal oxide. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

The present invention provides an indirectly heated electrode for gas discharge tube comprising: a base metal, formed to a tubular form; a heater, disposed at the inner side of the base metal and having an electrical insulating layer formed on a surface thereof; a coil member, wound in coil form around the outer side of the base metal; a high-melting-point metal, formed to a mesh and disposed along the length direction of the coil member at the outer side of the coil member; and a metal oxide, serving as a material likely to emit electrons and held by the coil member so as to be in contact with the high-melting-point metal; and wherein the coil member is grounded.

In the indirectly heated electrode for gas discharge tube of the present invention, since the coil member is grounded, thermions, secondary electrons, etc. are supplied via this coil member. Also, since an equipotential surface is effectively formed at the electrode surface by the high-melting-point metal that is formed to a mesh and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the electrode can be realized. Since the movement of the discharge position is also restrained, stable discharge over a long period of time can be realized. Also, by the base metal, the heat of the heater can be transferred without fail to the metal oxide in the active state. Also, since the high-melting-point metal is a rigid body, it is easy to process and can be put in close contact with the metal oxide. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

The present invention provides an indirectly heated electrode for gas discharge tube comprising: a base metal, formed to a tubular form; a heater, disposed at the inner side of the base metal and having an electrical insulating layer formed on a surface thereof; a coil member, wound in coil form around the outer side of the base metal; a high-melting-point metal, formed to a mesh and disposed along the length direction of the coil member at the outer side of the coil member; and a metal oxide, serving as a material likely to emit electrons and held by the coil member so as to be in contact with the high-melting-point metal; and wherein the high-melting-point metal is grounded.

In the indirectly heated electrode for gas discharge tube of the present invention, since the high-melting-point metal is grounded, thermions, secondary electrons, etc. are supplied via this high-melting-point metal. Also, since an equipotential surface is effectively formed at the electrode surface by the high-melting-point metal that is formed to a mesh and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the electrode can be realized. Since the movement of the discharge position is also restrained, stable discharge over a long period of time can be realized. Also, by the base metal, the heat of the heater can be transferred without fail to the metal oxide in the active state. Also, since the high-melting-point metal is a rigid body, it is easy to process and can be put in close contact with the metal oxide. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

The present invention provides an indirectly heated electrode for gas discharge tube comprising: a base metal, formed to a tubular form; a heater, disposed at the inner side of the base metal and having an electrical insulating layer formed on a surface thereof; a coil member, wound in coil form around the outer side of the base metal; a high-melting-point metal, formed to a wire or a plate and disposed along the length direction of the coil member at the outer side of the coil member; and a metal oxide, serving as a material likely to emit electrons and held by the coil member so as to be in contact with the high-melting-point metal; and wherein the high-melting-point metal is in electrical contact with the coil member at a plurality of locations and the coil member is grounded.

In the indirectly heated electrode for gas discharge tube of the present invention, since the coil member is grounded, thermions, secondary electrons, etc. are supplied via this coil member. Also, since an equipotential surface is effectively formed at the electrode surface by the high-melting-point metal that is formed to a wire or a plate and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the electrode can be realized. Since the movement of the discharge position is also restrained, stable discharge over a long period of time can be realized. Also, by the base metal, the heat of the heater can be transferred without fail to the metal oxide in the active state. Also, since the high-melting-point metal is a rigid body, it is easy to process and can be put in close contact with the metal oxide. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

The present invention provides an indirectly heated electrode for gas discharge tube comprising: a base metal, formed to a tubular form; a heater, disposed at the inner side of the base metal and having an electrical insulating layer formed on a surface thereof; a coil member, wound in coil form around the outer side of the base metal; a high-melting-point metal, formed to a wire or a plate and disposed along the length direction of the coil member at the outer side of the coil member; and a metal oxide, serving as a material likely to emit electrons and held by the coil member so as to be in contact with the high-melting-point metal; and wherein the high-melting-point metal is in electrical contact with the coil member at a plurality of locations and the high-melting-point metal is grounded.

In the indirectly heated electrode for gas discharge tube of the present invention, since the high-melting-point metal is grounded, thermions, secondary electrons, etc. are supplied via this high-melting-point metal and the coil member. Also, since an equipotential surface is effectively formed at the electrode surface by the high-melting-point metal that is formed to a wire or a plate and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the electrode can be realized. Since the movement of the discharge position is also restrained, stabled is charge over a long period of time can be realized. Also, by the base metal, the heat of the heater can be transferred without fail to the metal oxide in the active state. Also, since the high-melting-point metal is a rigid body, it is easy to process and can be put in close contact with the metal oxide. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

The present invention provides an indirectly heated electrode for gas discharge tube comprising: a heater, having an electrical insulating layer formed on a surface thereof; a high-melting-point metal, formed to a mesh and disposed along the length direction of the heater at the outer side of the heater; and a metal oxide, serving as a material likely to emit electrons and disposed so as to be in contact with the high-melting-point metal; and wherein the high-melting-point metal is grounded.

In the indirectly heated electrode for gas discharge tube of the present invention, since an equipotential surface is effectively formed at the electrode surface by the high-melting-point metal that is formed to a mesh and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the electrode can be realized. Since the movement of the discharge position is also restrained, stable discharge over a long period of time can be realized. Also, since the high-melting-point metal is a rigid body, it is easy to process and can be put in close contact with the metal oxide. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

The present invention provides an indirectly heated electrode for gas discharge tube comprising: a heater, having an electrical insulating layer formed on a surface thereof; a high-melting-point metal, formed to a mesh, extended in the length direction in a waving manner, and disposed along the length direction of the heater at the outer side of the heater; a conductive wire, having a shape that spans a depressed part at one side of the high-melting-point metal in one direction along the width direction of the high-melting-point metal and spans a depressed part at the other side of the high-melting-point metal in the reverse direction along the width direction of the high-melting-point metal; and a metal oxide, serving as a material likely to emit electrons and disposed so as to be in contact with the high-melting-point metal; and wherein the high-melting-point metal is grounded.

In the indirectly heated electrode for gas discharge tube of the present invention, since an equipotential surface is effectively formed at the electrode surface by the high-melting-point metal that is formed to a mesh and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the electrode can be realized. Since the movement of the discharge position is also restrained, stable discharge over a long period of time can be realized. Also, since the high-melting-point metal is a rigid body, it is easy to process and can be put in close contact with the metal oxide. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

The conductive wire preferably comprises a mandrel and a filament wound around the outer circumference of the mandrel. In this case, since the conductive wire has a mandrel, the deformation of the conductive wire during processing can be restrained.

The present invention provides an indirectly heated electrode for gas discharge tube comprising: a base metal, formed to a tubular form; a heater, disposed at the inner side of the base metal and having an electrical insulating layer formed on a surface thereof; a high-melting-point metal, formed to a mesh and disposed on the surface of the base metal along the length direction of the heater; and a metal oxide, serving as a material likely to emit electrons and disposed so as to be in contact with the high-melting-point metal; and wherein the high-melting-point metal is grounded.

In the indirectly heated electrode for gas discharge tube of the present invention, since an equipotential surface is effectively formed at the electrode surface by the high-melting-point metal that is formed to mesh and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the electrode can be realized. Since the movement of the discharge position is also restrained, stable discharge over a long period of time can be realized. Also, since the high-melting-point metal is a rigid body, it is easy to process and can be put in close contact with the metal oxide. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

The present invention provides a gas discharge tube using an indirectly heated electrode for gas discharge tube comprising: a sealed container, having a fluorescent film formed on the inner surface thereof; and wherein the indirectly heated electrode for gas discharge tube as set forth in any of the first to twenty ninth Claims of the invention is sealed in an airtight manner along with a rare gas in the sealed container.

In the present invention, since the gas discharge tube using an indirectly heated electrode for gas discharge tube of the present invention has the indirectly heated electrode for gas discharge tube as set forth in any of the first to twenty ninth Claims of the invention sealed in an airtight manner therein, a gas discharge tube of long service life and stable operation can be realized.

The present invention provides a gas discharge tube using an indirectly heated electrode for gas discharge tube comprising: a sealed container, having a fluorescent film formed on the inner surface thereof; and wherein the indirectly heated electrode for gas discharge tube as set forth in any of the first to twenty ninth Claims of the invention is sealed in an airtight manner along with a rare gas and mercury in said container.

In the present invention, since the gas discharge tube using an indirectly heated electrode for gas discharge tube of the present invention has the indirectly heated electrode for gas discharge tube as set forth in any of the first to twenty ninth Claims of the invention sealed in an airtight manner therein, a gas discharge tube of long service life and stable operation can be realized.

The present invention provides a gas discharge tube using an indirectly heated electrode for gas discharge tube, wherein the indirectly heated electrode for gas discharge tube as set forth in any of the first to twenty ninth Claims of the invention is sealed in an airtight manner along with a rare gas in a container.

In the present invention, since the gas discharge tube using an indirectly heated electrode for gas discharge tube of the present invention has the indirectly heated electrode for gas discharge tube as set forth in any of the first to twenty ninth Claims of the invention sealed in an airtight manner therein, a gas discharge tube of long service life and stable operation can be realized.

The present invention provides a gas discharge tube using an indirectly heated electrode for gas discharge tube, wherein the indirectly heated electrode for gas discharge tube as set forth in any of the first to twenty ninth Claims of the invention is sealed in an airtight manner along with a rare gas and mercury in a container.

In the present invention, since the gas discharge tube using an indirectly heated electrode for gas discharge tube of the present invention has the indirectly heated electrode for gas discharge tube as set forth in any of the first to twenty ninth Claims of the invention sealed in an airtight manner therein, a gas discharge tube of long service life and stable operation can be realized.

The present invention provides a gas discharge tube using an indirectly heated electrode for gas discharge tube, wherein a pair of the indirectly heated electrodes for gas discharge tube as set forth in any of the first to twenty ninth Claims of the invention are sealed in an airtight manner along with a rare gas in a translucency container while being set apart by a predetermined gap.

In the present invention, since the gas discharge tube using an indirectly heated electrode for gas discharge tube has a pair of the indirectly heated electrodes for gas discharge tube as set forth in any of the first to twenty ninth Claims of the invention sealed in an airtight manner while being set apart by a predetermined gap, a gas discharge tube of long service life and stable operation can be realized. In particular, an arrangement suitable for a gas discharge tube, with which a negative glow discharge due to AC discharge across a pair of electrodes is to be mainly performed, is provided.

The present invention provides a gas discharge tube using an indirectly heated electrode for gas discharge tube comprising: the indirectly heated electrode for gas discharge tube as set forth in any of the first to twenty ninth Claims of the invention; an anode, receiving electrons emitted from the indirectly heated electrode for gas discharge tube; a focusing electrode, disposed between the indirectly heated electrode for gas discharge tube and the anode and converging the thermions; and an electrically-insulating, discharge shielding part, housing the anode; and wherein the indirectly heated electrode for gas discharge tube, the anode, the focusing electrode and the discharge shielding part are equipped inside a sealed container in which a gas is sealed.

In the present invention, since the present invention's gas discharge tube using an indirectly heated electrode for gas discharge tube uses the indirectly heated electrode for gas discharge tube as set forth in any of the first to twenty ninth Claims of the invention, a gas discharge tube of long service life and stable operation can be realized.

The present inventors also found anew as a result of research that the gas discharge tube using an indirectly heated electrode for gas discharge tube of the thirty fifth Claim can be driven under the relationships expressed by the following equations (7) and (8):

$$I_{f0}=Ip \tag{7}$$

$$V_{f1}=0 \tag{8}$$

In the above, $I_{f0}$: initial current supplied to the heater in the starting state Ip: discharge current $V_{f1}$: voltage applied to the heater during operation.

Based on the above research results, the present invention provides in a gas discharge tube lighting device using an indirectly heated electrode for gas discharge tube, which is installed in and connected to the indirectly heated electrode for gas discharge tube, the anode, and the focusing electrode in the gas discharge tube using an indirectly heated electrode for gas discharge tube of the thirty fifth Claim, a gas discharge tube lighting device using an indirectly heated electrode for gas discharge tube comprising: a power supply, connected between the indirectly heated electrode for gas discharge tube and the anode; an auxiliary lighting circuit unit, connected between the anode and the focusing electrode and generating a trigger discharge across the indirectly heated electrode for gas discharge tube and the focusing electrode; and a make-and-break switching circuit unit, connected between the indirectly heated electrode for gas discharge tube and the anode and supplying electricity to the heater for a predetermined period and then cutting off the supply of electricity to the heater after the elapse of the predetermined period.

In the present invention, lighting device for a gas discharge tube using an indirectly heated electrode for gas discharge tube, a lighting device for lighting the thirty fifth Claim's gas discharge tube using an indirectly heated electrode for gas discharge tube can be realized. Also, a single power supply can be used as the power supply for the pre-heating of the indirectly heated electrode for gas discharge tube, the starting of trigger discharge (discharge due to initial gas ionization), and the main discharge, making unnecessary a separate power supply for the pre-heating of the indirectly heated electrode for gas discharge tube (for the heater) and thereby enabling significant reduction of the number of parts and simplification of arrangement.

The auxiliary lighting circuit unit preferably includes a capacitor that is installed and serially connected between the anode and the focusing electrode. By the auxiliary lighting circuit unit including a capacitor that is installed and serially connected between the anode and the focusing electrode, the auxiliary lighting circuit unit can be realized in a simple and low-cost manner.

The auxiliary lighting circuit unit preferably furthermore includes a fixed resistor that is connected in parallel to the capacitor. By the auxiliary lighting circuit unit furthermore including a fixed resistor that is connected in parallel to the capacitor, the gas discharge tube lighting property can be improved.

It is also preferable that a fixed resistor for current detection, which is serially connected and installed between the anode and the power supply, be equipped furthermore. By furthermore equipping a fixed resistor for current detection, which is serially connected and installed between the anode and the power supply, the voltage can be lowered during operation and the consumption power of the gas discharge tube can thereby be reduced.

BEST MODE FOR CARRYING OUT THE INVENTION

Preferred embodiments of the present invention's indirectly heated electrode for gas discharge tube, gas discharge tube using the abovementioned indirectly heated electrode, and lighting device for the abovementioned gas discharge tube shall now be described in detail with reference to the drawings. In the following description, the same symbol shall be used for the same elements or elements with the same functions and redundant description shall be omitted.

FIRST EMBODIMENT

Figure 1:
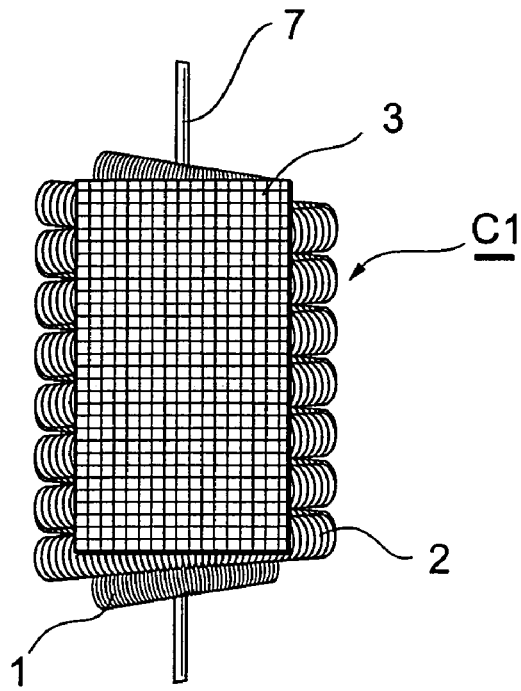
FIG. 1 is a schematic front view, showing an indirectly heated cathode for gas discharge tube of a first embodiment.
Figure 2:
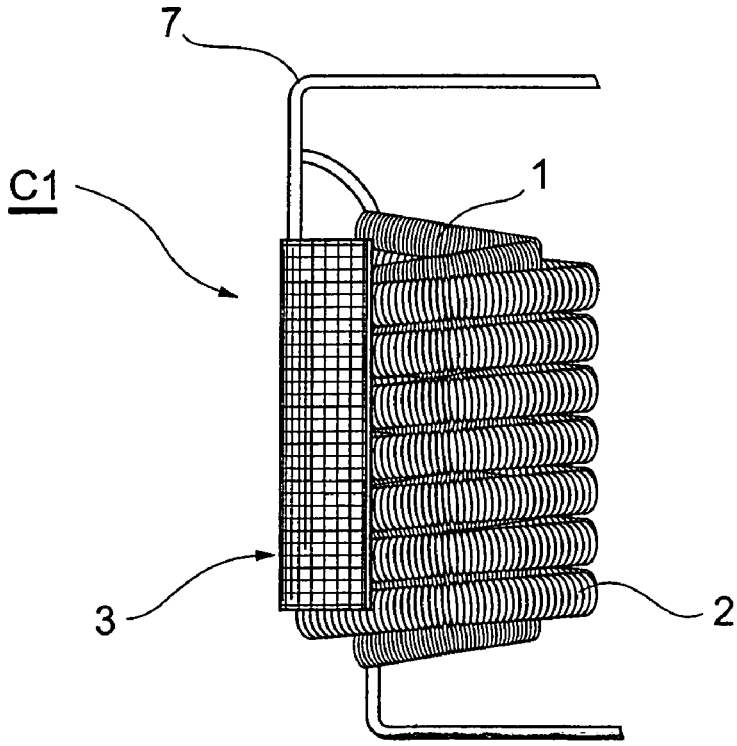
FIG. 2 is a schematic side view, showing an indirectly heated cathode for gas discharge tube of the first embodiment.
Figure 3A:
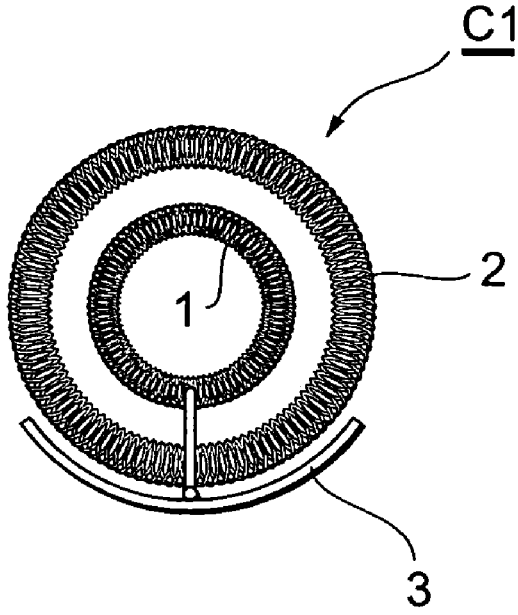
FIG. 3A is a schematic top view, showing an indirectly heated cathode for gas discharge tube of the first embodiment.
Figure 3B:
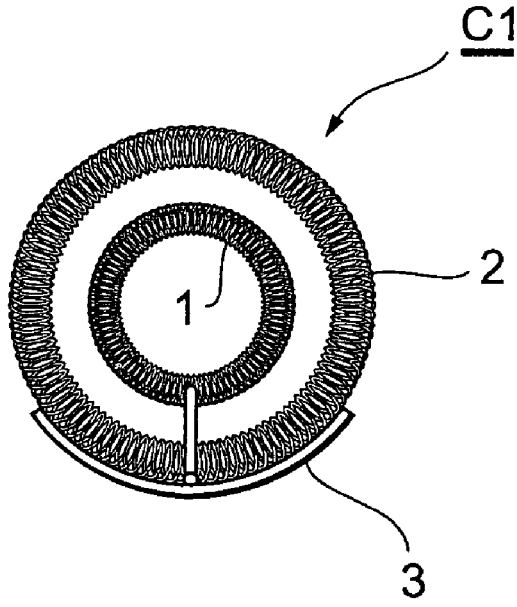
FIG. 3B is a schematic top view, showing an indirectly heated cathode for gas discharge tube of the first embodiment.
Figure 4:
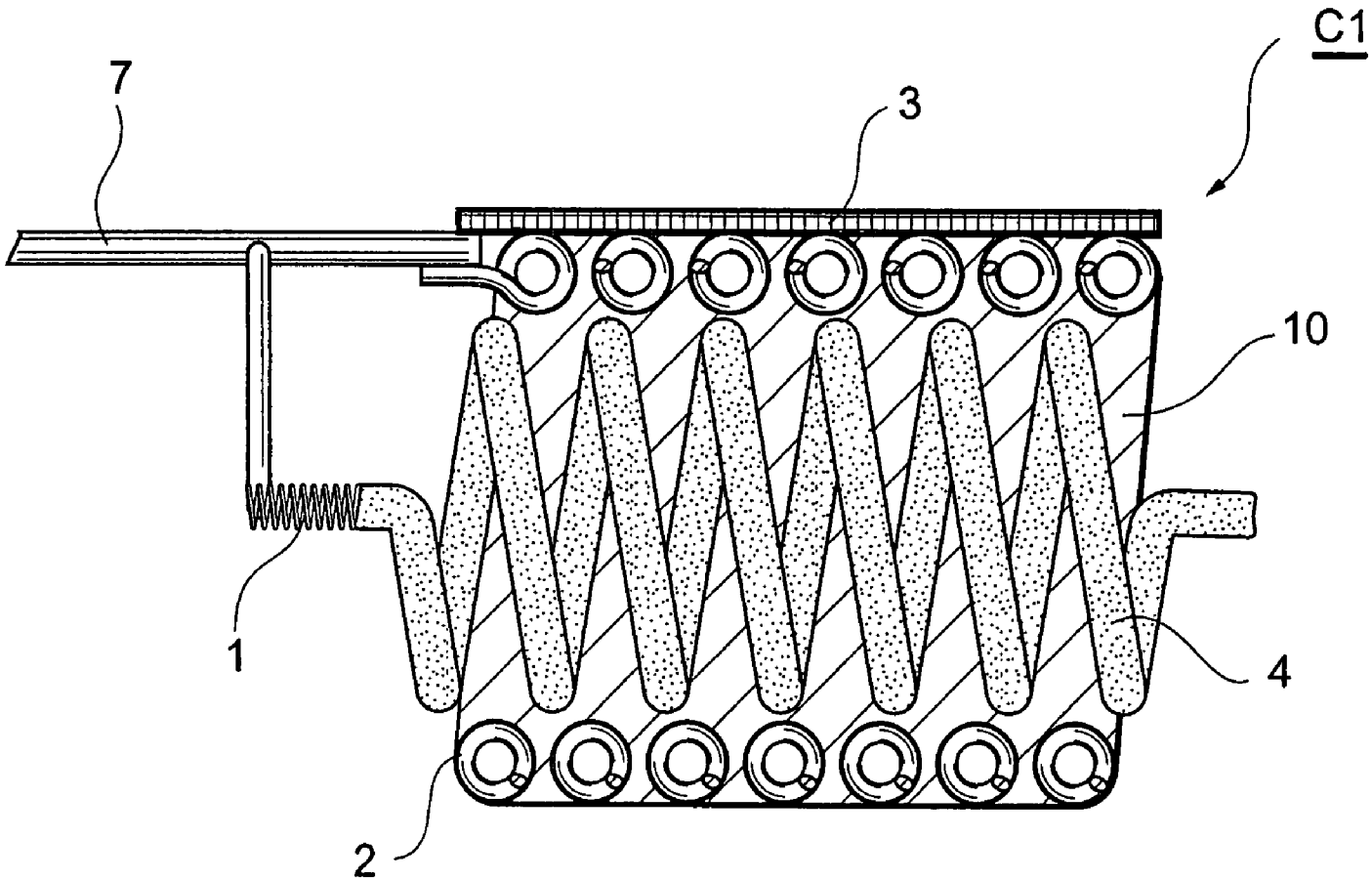
FIG. 4 is a schematic sectional view, showing an indirectly heated cathode for gas discharge tube of the first embodiment.

FIG. 1 is a schematic front view of an indirectly heated cathode for gas discharge tube of a first embodiment, FIG. 2 is likewise a schematic side view of an indirectly heated cathode for gas discharge tube of the first embodiment, FIGS. 3A and 3B are likewise schematic top views of indirectly heated cathodes for gas discharge tube of the first embodiment, and FIG. 4 is likewise a schematic sectional view of an indirectly heated cathode for gas discharge tube of the first embodiment. With FIGS. 1, 2, 3A, and 3B, illustrations of an electrical insulating layer 4 and a metal oxide 10 are omitted for the sake of description. This embodiment is an example of application of an indirectly heated electrode for gas discharge tube to a cathode (indirectly heated cathode for gas discharge tube).

As shown in FIGS. 1 through 4, an indirectly heated cathode for gas discharge tube C1 has a heater 1, a double coil 2 as a coil member, a mesh member 3 as an electrical conductor, and metal oxide 10 as a material likely to emit electrons (cathode material). Heater 1 comprises a filament coil, with which a tungsten element wire of 0.03 to 0.1 mm diameter, that is for example, a tungsten element wire of 0.07 mm diameter is wound in double, and an electrical insulating material (for example, alumina, zirconia, magnesia, silica, etc.) is coated by electro deposition, etc. and formed as electrical insulating layer 4 on the surface of this tungsten filament coil. Also, an arrangement, which uses a cylindrical pipe of an electrical insulating material (for example, alumina, zirconia, magnesia, silica, etc.) and with which heater 1 is inserted inside this cylindrical pipe insulate heater 1, maybe employed in place of electrical insulating layer 4. Here, double coil 2 and metal oxide 10, which is the material likely to emit electrons, make up an electron emitting part that emits electrons upon receiving the heat from heater 1.

Double coil 2 is a multiple coil arranged from a coil that is wound in coil form, and a tungsten element wire of 0.091 mm diameter is formed into a primary coil with a diameter of 0.25 mm and a pitch of 0.146 mm and this primary coil is formed into a double coil with a diameter of 1.7 mm and a pitch of 0.6 mm. Heater 1 is inserted into and disposed at the inner side of double coil 2. As a holding means (coil member), a triple coil or a single coil, etc. may be used in place of double coil 2. Also, a mesh member may be used in place of a coil member. By using such a coil or mesh member, the holding member that holds metal oxide 10, which is the material likely to emit electrons, can be reduced in heat radiating area.

Mesh member 3 is a conductive rigid body (metal conductor) formed of a single, high-melting-point metal (with a melting point of at least 1000° C.) selected from among groups IIIa to VIIa, VIII, and Ib of the periodic table or, more specifically, from among tungsten, tantalum, molybdenum, rhenium, niobium, osmium, iridium, iron, nickel, cobalt, titanium, zirconium, manganese, chromium, vanadium, rhodium, rare earth metals, etc. or an alloy of these metals. With the present embodiment, a mesh member made by weaving tungsten element wires of 0.03 mm diameter into mesh form is used. The mesh size of mesh member 3 is set to 80 mesh. Mesh member 3 has a predetermined length and is disposed across the length direction of double coil 2 at the outer side of double coil 2 so as to be substantially orthogonal to the discharge direction. This mesh member 3 is disposed at the surface most part of the electron emitting part that includes double coil 2 and metal oxide 10, which is the material likely to emit electrons.

Double coil 2 and mesh member 3 are connected via a lead rod 7 to the ground terminal of heater 1 and is thereby grounded (set to GND). Metal oxide 10, which is the material likely to emit electrons, is thereby set to the ground potential.

In FIG. 3A, mesh member 3 is disposed with there being a gap between double coil 2. In FIGS. 3B and 4, mesh member 3 is disposed to be in electrical contact with a plurality of coil portions of double coil 2 along the length direction of double coil 2.

An example of a process for manufacturing indirectly heated cathode for gas discharge tube C1 (for positioning heater 1 and mesh member 3 with respect to double coil 2) shall now be described based on FIGS. 5A to 7B.

Figure 5A:
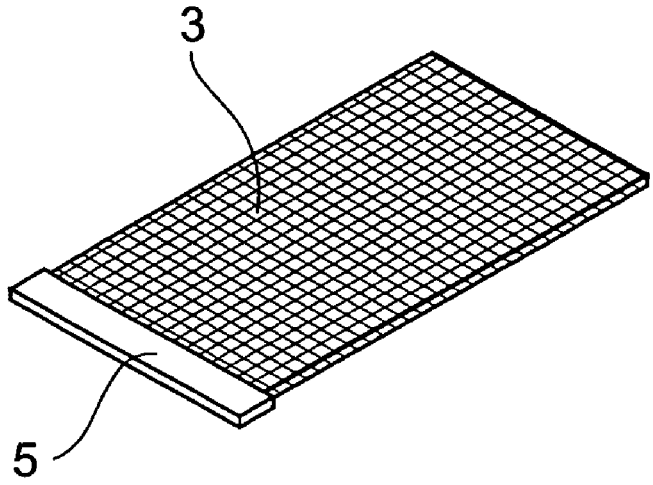
FIG. 5A is a diagram for explaining an example of a manufacturing process of the indirectly heated cathode for gas discharge tube of the first embodiment.
Figure 5B:
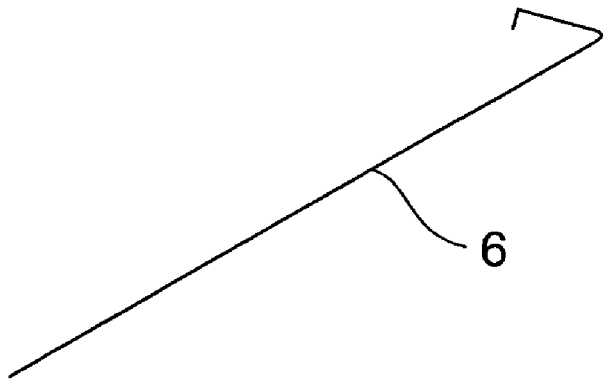
FIG. 5B is a diagram for explaining an example of the manufacturing process of the indirectly heated cathode for gas discharge tube of the first embodiment.
Figure 6A:
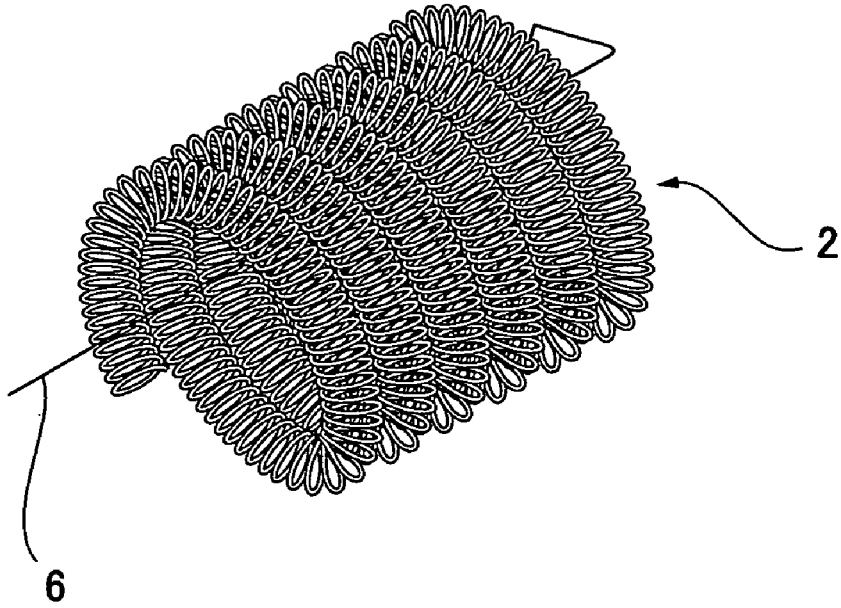
FIG. 6A is a diagram for explaining the example of the manufacturing process of the indirectly heated cathode for gas discharge tube of the first embodiment.
Figure 6B:
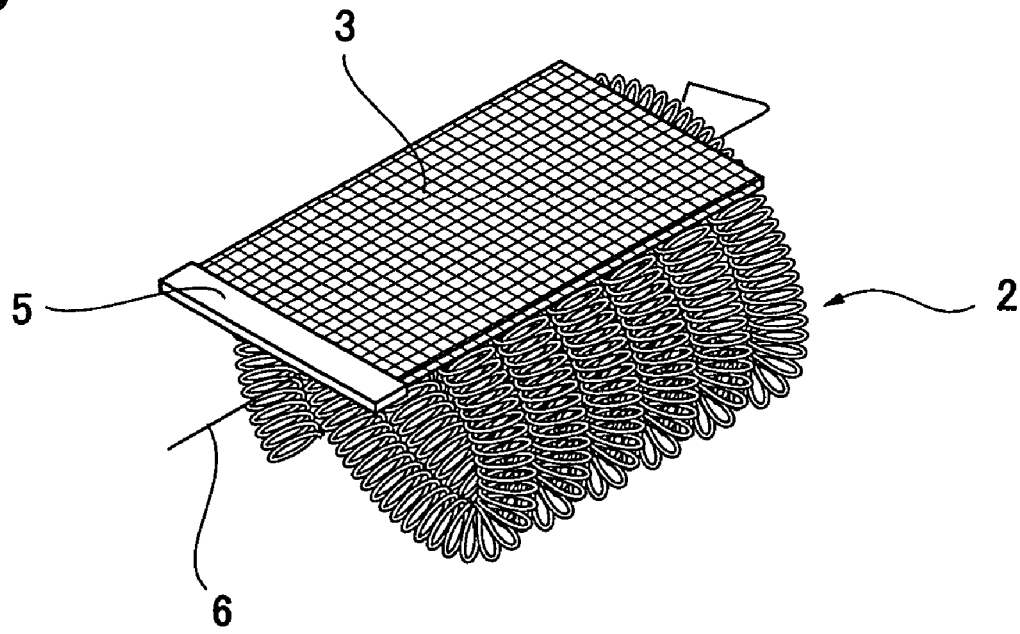
FIG. 6B is a diagram for explaining the example of the manufacturing process of the indirectly heated cathode for gas discharge tube of the first embodiment.

First as shown in FIG. 5A, plate member 5 is welded to an end part of mesh member 3. Meanwhile, the end part of a wire member 6, made of nickel, is bent in two stages as shown in FIG. 5B. Wire member 6 is then passed through the inner side of double coil 2 as shown in FIG. 6A. Then as shown in FIG. 6B, mesh member 3, having plate member 5 welded thereto, is set on the outer side of double coil 2, through which wire member 6 has been passed, and plate member 5 and wire member 6 are welded.

Figure 7A:
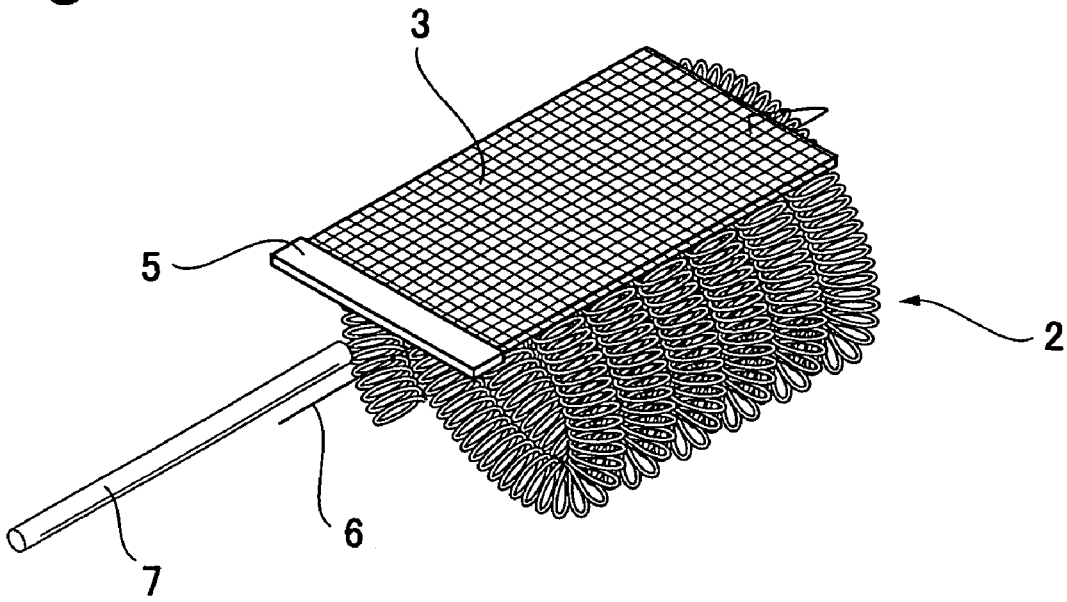
FIG. 7A is a diagram for explaining the example of the manufacturing process of the indirectly heated cathode for gas discharge tube of the first embodiment.
Figure 7B:
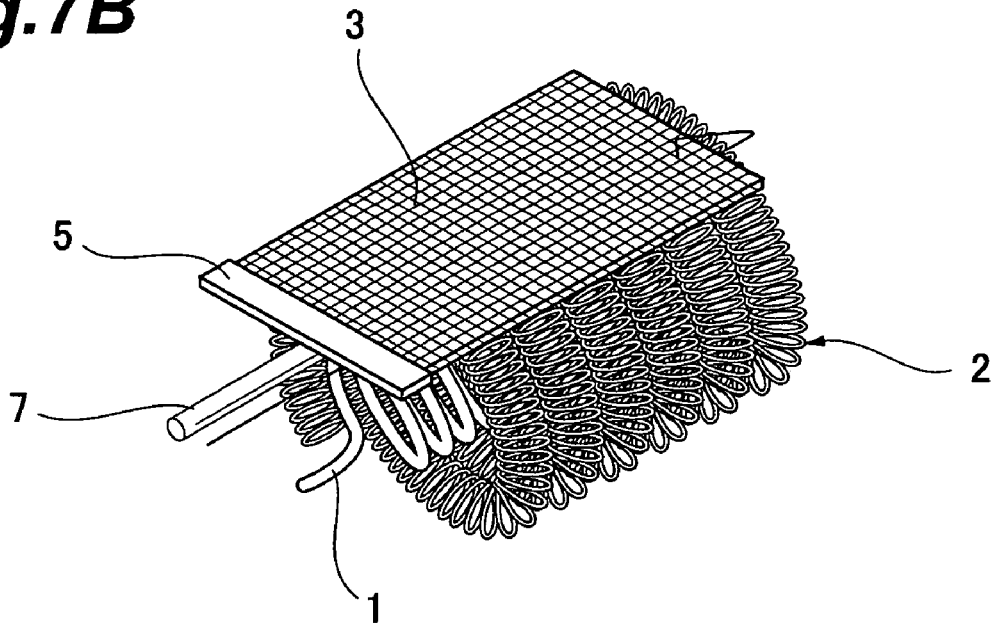
FIG. 7B is a diagram for explaining the example of the manufacturing process of the indirectly heated cathode for gas discharge tube of the first embodiment.

Next as shown in FIG. 7A, the end part of wire member 6 that has been bent in two stages is bent and caulked onto mesh member 3. Thereafter, heater 1 is inserted into the inner side of double coil 2, and as shown in FIG. 7B, the end parts of plate member 5 and heater 1 are welded to lead rod 7 for connection to the ground terminal. By the above process, an arrangement is provided with which heater 1 is positioned at the inner side of double coil 2 and mesh member 3 is positioned at the outer side of double coil 2.

Figure 8A:
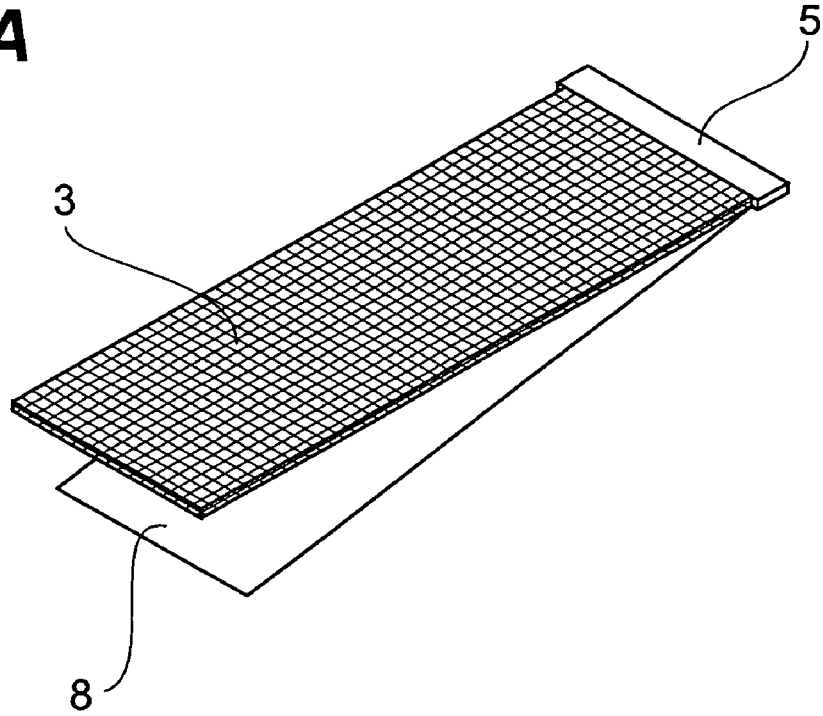
FIG. 8A is a diagram for explaining an example of the manufacturing process of the indirectly heated cathode for gas discharge tube of the first embodiment.
Figure 8B:
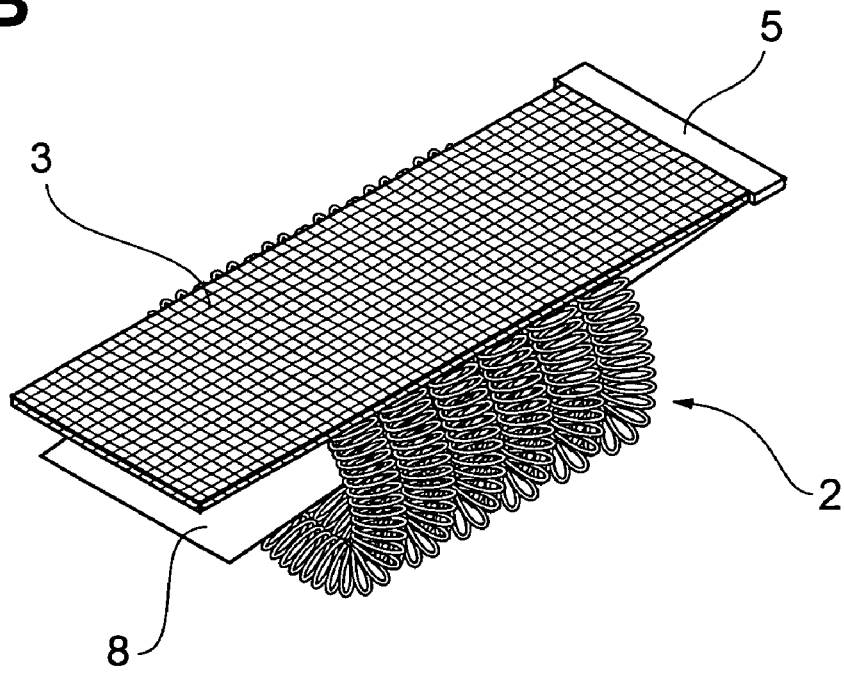
FIG. 8B is a diagram for explaining the example of the manufacturing process of the indirectly heated cathode for gas discharge tube of the first embodiment.

Also, in place of using wire member 6, made of nickel, a plate member 8, made of molybdenum, may be used as shown in FIGS. 8A and 8B. In this case, by welding plate member 8 to plate member 5 as shown in FIG. 8A, plate member 8 is connected to mesh member 3. Then with plate member 8 being passed through inner side of double coil 2 and double coil 2 being sandwiched by mesh member 3 and plate member 8 as shown in FIG. 8B, mesh member 3 and plate member 8 are welded using a plate member 9, made of nickel, as an adherend. Thereafter, heater 1 is inserted into the inner side of double coil 2 and the end parts of plate member 5 and heater 1 are welded to lead rod 7 as was shown in FIG. 7B.

Returning now to FIG. 4, indirectly heated cathode for gas discharge tube C1 is provided with metal oxide 10 as the material likely to emit electrons. Metal oxide 10 is held by double coil 2 and put in contact with mesh member 3. Metal oxide 10 and mesh member 3 are exposed to the outer side of indirectly heated cathode for gas discharge tube C1 so that the surface of metal oxide 10 and the surface of mesh member 3 make up a discharge surface and the surface part of metal oxide 10 is put in contact with mesh member 3.

As metal oxide 10, a single oxide of a metal selected from among barium (Ba), strontium (Sr), and calcium (Ca), or a mixture of such oxides, or an oxide, with which the principle component is a single oxide of a metal selected from among barium (Ba), strontium (Sr), and calcium (Ca) or a mixture of such oxides and a sub-component is an oxide of a metal selected among rare earth metals including lanthanum (metals of group IIIa of the periodic table), is used. Each of barium, strontium, and calcium is low in work function, can emit thermions readily, and enable the thermion supply amount to be increased. Also, in a case where a rare earth metal (metal of group IIIa of the periodic table) is added as a sub-component, the thermion supply amount can be increased further and the sputter resistance can be improved as well.

As the cathode material, metal oxide 10 is coated in the form of a metal carbonate (for example, barium carbonate, strontium carbonate, calcium carbonate, etc.) and obtained by vacuum thermal decomposition of the coated metal carbonate. If vacuum thermal decomposition is to be performed by passage of electricity through the heater, AC thermal decomposition is preferred over DC thermal decomposition. In the final stage, the metal oxide 10 that is thus obtained becomes the material likely to emit electrons. The metal carbonate that is to be the cathode material is coated from the mesh member 3 side in the condition where heater 1 is positioned at the inner side of double coil 2 and mesh member 3 is positioned at the outer side of double coil 2 as shown in FIGS. 1 through 3B. The metal carbonate need not be coated so as to cover the entire periphery of indirectly heated cathode for gas discharge tube C1 (double coil 2) but may be coated onto just the part at which mesh member 3 is provided.

Also, a metal carbonate may be coated as the cathode material onto double coil 2 (mesh member 3) in the condition in which heater 1 is not positioned at the inner side of double coil 2 and heater 1 may be inserted after the coating of the metal carbonate. If there are pores in the electrical insulating layer 4 formed on heater 1 and the metal carbonate is coated with heater 1 being positioned, the coated metal carbonate may enter inside the pores and cause short-circuiting of heater 1 with the metal oxide 10 that is obtained from the metal carbonate. The above-described insertion and positioning of heater 1 after the coating of the metal carbonate is performed to avoid such a situation.

As shown in FIG. 4, heater 1 is in contact with metal oxide 10 via electrical insulating layer 4. The heat of heater 1 can thus be transferred definitely and efficiently to metal oxide 10 in the preheating process. Also, in comparison to an arrangement having a cylinder of good thermal conductivity, such as that of the indirectly heated cathode for gas discharge tube disclosed in Japanese Examined Patent Publication No. Sho 62-56628, the heat radiation area is lessened and the loss of the heat amount necessary for hot cathode operation can be restrained. This enable designs, which require neither the supplying of heat to the electrode from the exterior nor forced heating and with which the electrode will operate with just the heat amount provided by self-heating. When electrons are emitted from an electrode in a gas discharge tube, the ionized gas in the discharge space collides and causes electrical neutralization, and here, "self-heating" refers to the heat that is generated by the impact of collision of the gas molecules with the electrode.

Though besides the abovementioned metal oxides, the use of a metal boride, such lanthanum boride, a metal carbide, a metal nitride, etc. as the thermion supply source may be considered, metal borides, metal carbides, metal nitrides are poor in performance as a thermion supply source that can serve as a hot cathode for gas discharge tube and there is no meaning in adding such compounds as a principle component or a sub-component. However, such compounds may be used at peripheral parts of the cathode for effects besides the effect as a thermion supply source, such as for improving the insulation effect in order to restrain the amount of heat dissipation to parts besides the discharge part.

Also, though indirectly heated cathode for gas discharge tube C1 may be arranged by setting the double coil 2, which holds metal oxide 10 in advance, to be in contact with mesh member 3, so as to set up a condition wherein mesh member 3 contacts metal oxide 10 definitely, it is preferable to coat a metal carbonate as a cathode material in the condition where mesh member 3 has been positioned at the outer side of double coil 2 and to then convert the metal carbonate to metal oxide 10 as described above.

Here, if the line (longitudinal line) resistance in one direction of mesh member 3 is R1*h* and the line (transverse line) resistance in the other direction is R1*s*, the relationships of resistance values R1A, R1B, and R1C with respect to the ground (GND) of three predetermined points (designated as point 1A, point 1B, and point 1C, starting from the point closer to the ground (GND) that is the electron supply source) of mesh member 3 will be as follows:

$$R1A=1/(R1h+2\times(R1h+R1s)) \quad (9)$$

$$R1A<R1B<R1C \quad (10)$$

and the discharge will occur in a continuous manner from the vicinity of the part including metal oxide 10 on mesh member 3. Though the discharge current amount will differ according to the work function of each location, suppose that:

$$I1A>I1B>I1C \quad (11)$$

As a result, the potential difference among point 1A, point 1B, and point 1C will then be small and proportional to the mesh number and at an approximate level, the potential difference will be small enough to be virtually negligible. Furthermore, a part of the discharge current will not enter mesh member 3 directly from the ground (GND) but will be supplied via metal oxide 10, and this current that is supplied via metal oxide 10 becomes a base for a discharge distribution that is a wide, gradual, continuous, single-peak distribution. This distribution also approximates the temperature distribution of the surface of metal oxide 10.

Since with indirectly heated cathode for gas discharge tube C1 of the first embodiment, mesh member 3 is put in contact with metal oxide 10 as described above, mesh member 3 effectively forms an equipotential surface at the discharge surface (surface of metal oxide 10 and surface of mesh member 3) of indirectly heated cathode for gas discharge tube C1. That is, mesh member 3 is arranged from a plurality of electrical wiring (conductive paths) and does not restrict the flow of current to a single direction. The electrical resistances across ends of the surface of mesh member 3 are thus considerably small, the surface of mesh member 3 is thus put in a substantially equipotential state, and the potential of the discharge surface that is made up of a plurality of discharge points or discharge lines will be substantially uniform. In other words, by mesh member 3, a plurality of electrical circuits, with which discharge currents can flow in directions parallel to the discharge surface, are formed on the discharge surface, that is, a plurality of paths (equipotential circuits) for emission electrons (emissions) are formed.

With indirectly heated cathode for gas discharge tube C1, since an equipotential surface is thus formed effectively by mesh member 3 in contact with metal oxide 10 and thermionic emission thus occurs over a wide region of the equipotential surface that is formed, the discharge area is increased, the electron emission a mount per unit area (electron emission density) is increased, and the load placed on the discharge position is lightened. The sputtering of metal oxide 10 and stabilization (mineralization) due to oxidation with the reduced metal, which are degradation factors, can thus be restrained, that is, the degradation of the thermionic emission ability can be restrained. As a result, the occurrence of localized discharge can be restrained and long service life of the cathode can be realized. Since the movement of the discharge position is also restrained, stable discharge over a long period of time can be realized. Also, since the discharge area is increased, the operation voltage and the generated heat amount of indirectly heated cathode for gas discharge tube C1 can be reduced.

Also, with indirectly heated cathode for gas discharge tube C1, due to the increase of the discharge area, even if the current density is slightly increased and the load is somewhat increased, that is, even if the discharge current is increased, the damage can be made less than that of the prior art. This enables the provision of an indirectly heated cathode for gas discharge tube of large discharge current with substantially the same shape as that of the prior art and the realization of pulse operation and large current operation.

Also since mesh member 3 is used as the electrical conductor, an electrical conductor of an arrangement, which can restrain the degradation of the thermionic emission ability and the movement of the discharge position, can be realized at low cost and in a simpler manner. Also, since mesh member 3 (electrical conductor) is a rigid body, it is easy to process and can be put in close contact with metal oxide 10. Furthermore, the locations at which mesh member 3 contacts metal oxide 10 can be made numerous readily.

With indirectly heated cathode for gas discharge tube C1 of the first embodiment, since heater 1 is used as a core at the outer side of which double coil 2, which holds metal oxide 10, is positioned in a surrounding manner, and mesh member 3 is positioned so as to be in contact with the surface part of metal oxide 10 that is held by double coil 2, the vibration restraining effect of double coil 2 is put to work and the falling off of metal oxide 10 can be prevented thereby. Also, since a large amount of metal oxide 10 will be held between the pitches of double coil 2, the effect of replenishing the metal oxide loss that accompanies the degradation with time during discharge is provided.

As the mesh size of mesh member 3 becomes smaller, the exposed area of metal oxide 10 decreases and thus the sputter resistance of metal oxide 10 improves. However, theoretically, a certain size by which excited or ionized gas that collide with metal oxide 10 will pass through will be necessary in order to cause secondary electron emission. Also, by making the mesh size small, since the area of the equipotential surface is increased, the discharge area can be increased further.

Figure 9:
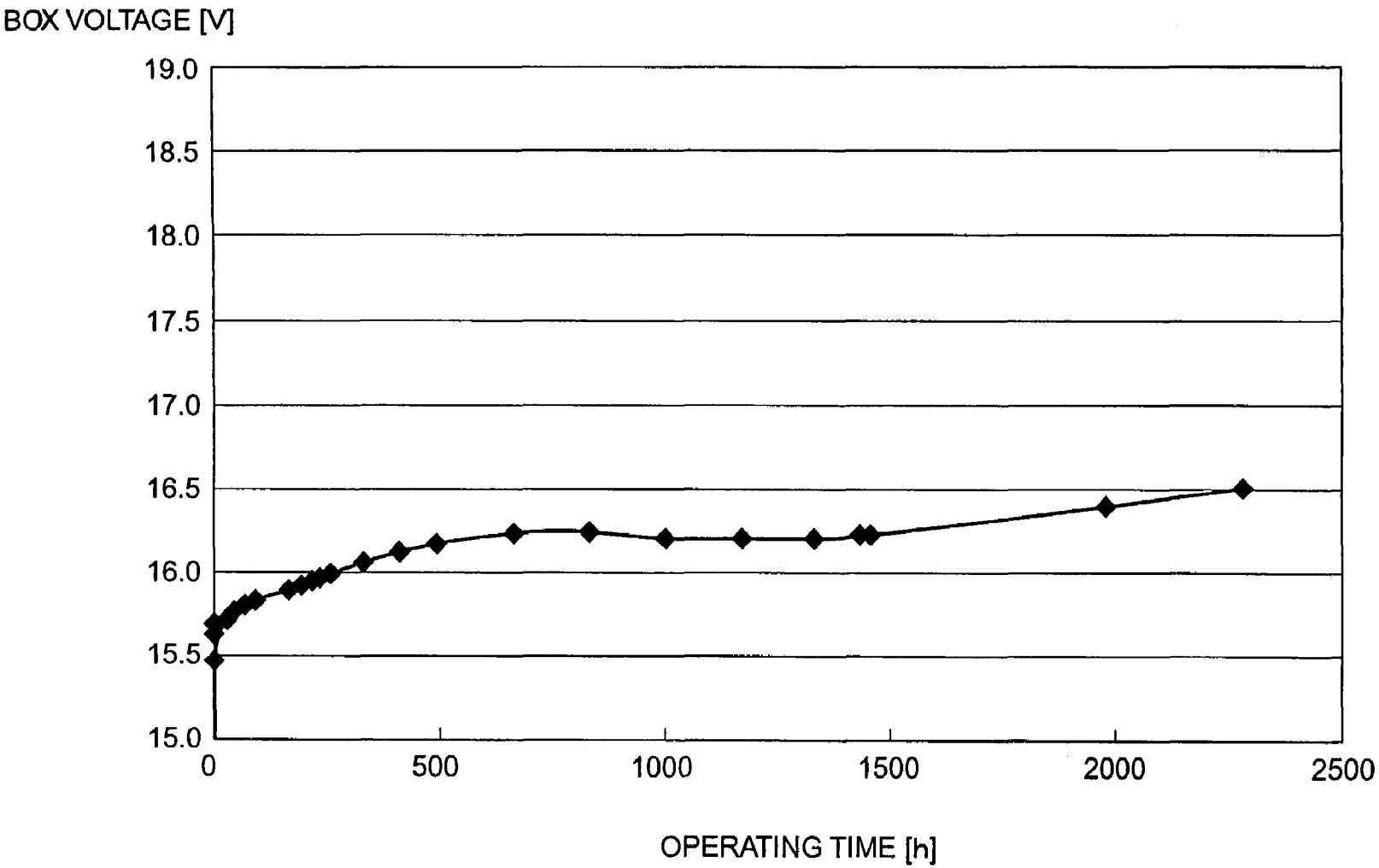
FIG. 9 is a graph concerning the variation with time of the box potential of the present invention's indirectly heated electrode for gas discharge tube (indirectly heated cathode for gas discharge tube).

An experiment was conducted to confirm the long service life effect that is obtained by forming an equipotential surface by means of an electrical conductor in the present invention's indirectly heated electrode for gas discharge tube. The results are shown in FIG. 9. FIG. 9 shows the variation with time of the box potential. In the experiment, a simple deuterium gas discharge tube, comprising indirectly heated cathode for gas discharge tube C1, a slit (aperture diameter: 3 mm), and an anode, was prepared and the variation with time of the box potential was measured. To heater 1, whereas a power of 6 W (12V, 0.5 A) was supplied during preheating of indirectly heated cathode for gas discharge tube C1, voltage was not applied during operation. Also, the discharge current was set to a constant current of 300 mA, which is a rated current for a general deuterium gas discharge tube.

As can be understood from FIG. 9, a stable value is indicated for the box potential over a long period of time, showing that the amount of ion current generated at indirectly heated cathode for gas discharge tube C1 is low and that indirectly heated cathode for gas discharge tube C1 has a long service life.

Figure 10:
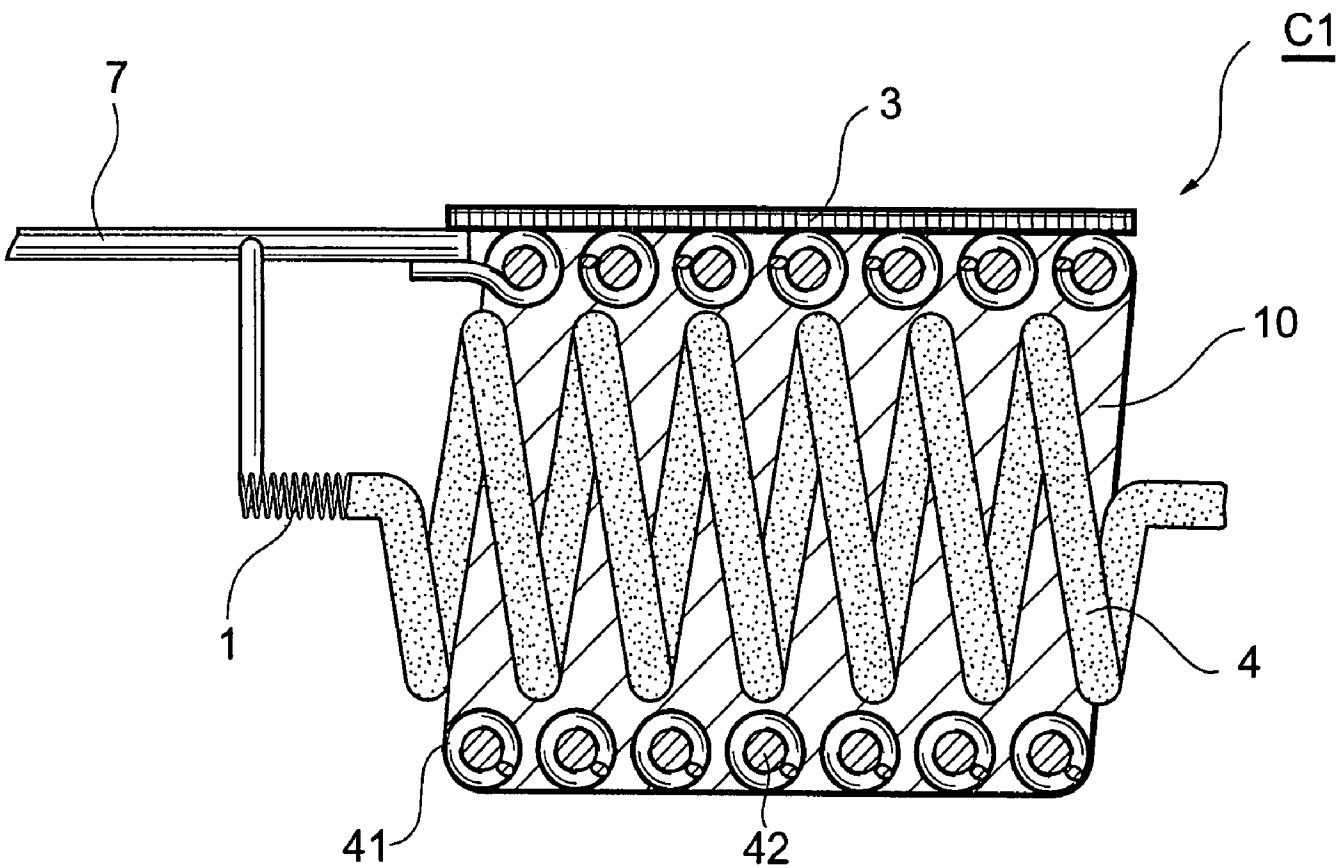
FIG. 10 is a schematic sectional view, showing a modification example of the indirectly heated cathode for gas discharge tube of the first embodiment.

A modification example of the first embodiment shall now be described with reference to FIG. 10. FIG. 10 is a schematic sectional view of a modification example of the indirectly heated cathode for gas discharge tube of the first embodiment. This modification example differs from the first embodiment in that the double coil has a mandrel.

As shown in FIG. 10, indirectly heated cathode for gas discharge tube C1 has heater 1, a double coil 41 as the coil member, mesh member 3, and metal oxide 10 as the material likely to emit electrons.

Double coil 41, like double coil 2 of the first embodiment, is a multiple coil arranged from a coil wound in coil form and has a mandrel 42. Heater 1 is disposed at the inner side of double coil 41. Mesh member 3 is disposed between heater 1 and double coil 41 and so as to be substantially orthogonal to the discharge direction along the length direction of double coil 41 (heater 1). As shown in FIG. 10, this mesh member 3 is disposed to be in electrical contact with a plurality of coil portions of double coil 41 along the length direction of double coil 41. Here, the mandrel is a core wire that serves the role of a mold that determines the winding diameter in the process of preparing the filament coil. As the material of the mandrel, for example, molybdenum is used.

With this modification example, since double coil 41 has mandrel 42, the additional effect that the deformation of double coil 41 during processing can be restrained is provided.

SECOND EMBODIMENT

Figure 11:
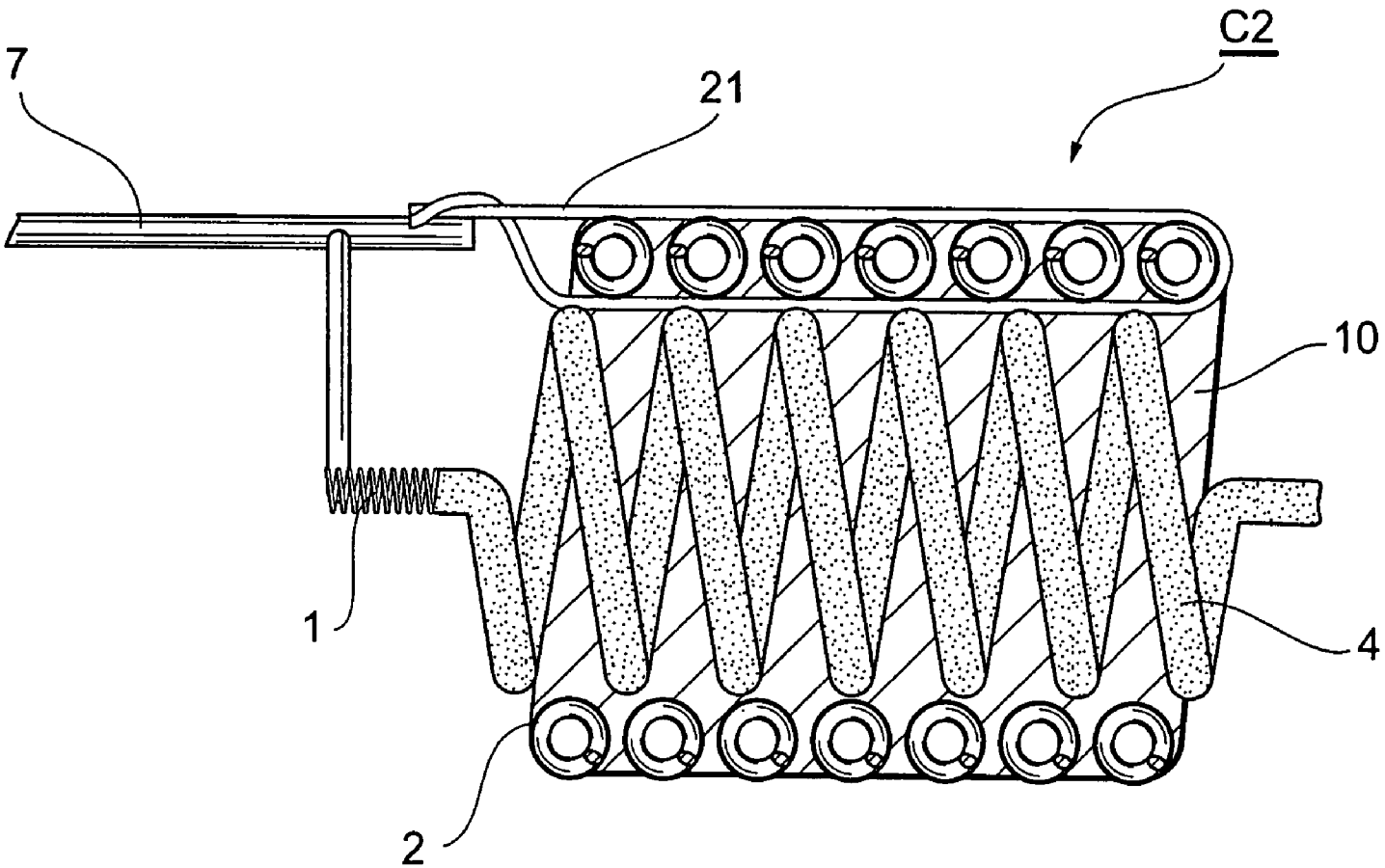
FIG. 11 is a schematic sectional view, showing an indirectly heated cathode for gas discharge tube of a second embodiment.

FIG. 11 is a schematic sectional view of an indirectly heated cathode for gas discharge tube of a second embodiment. The second embodiment differs from the first embodiment in that the electrical conductor is a wire member.

As shown in FIG. 11, an indirectly heated cathode for gas discharge tube C2 has a heater 1, a double coil 2, a wire member 21 as an electrical conductor, and a metal oxide 10.

Wire member 21, which is formed in wire form, is, like mesh member 3, a conductive rigid body (metal conductor) formed of a single, high-melting-point metal (with a melting point of at least 1000° C.) selected from among groups IIIa to VIIa, VIII, and Ib of the periodic table or, more specifically, from among tungsten, tantalum, molybdenum, rhenium, niobium, osmium, iridium, iron, nickel, cobalt, titanium, zirconium, manganese, chromium, vanadium, rhodium, rare earth metals, etc. or an alloy of these metals. With the present embodiment, a wire member made of tungsten is used. The diameter of wire member 21 is set to approximately 0.1 mm. Wire member 21 has a predetermined length and is disposed across the length direction of double coil 2 at the outer side of double coil 2 so as to be substantially orthogonal to the discharge direction. As shown in FIG. 11, this wire member 21 is put in electrical contact with a plurality of coil portions of double coil 2 along the length direction of double coil 2. Preferably, wire member 21 is put in electrical contact across the entire length in the length direction of double coil 2. This wire member 21 is disposed at the surface most part of the electron emitting part that includes double coil 2 and metal oxide 10, which is the material likely to emit electrons.

Wire member 21 is grounded by being connected to the ground terminal of heater 1. The number of wire member 21 is not limited to one and a plurality of two or more may be provided. Also, welding may be performed at the respective points of contact of wire member 21 with double coil 2.

Wire member 21 is grounded (set to GND) by being connected via lead rod 7 to the ground terminal of heater 1. Double coil 2 is thereby grounded and metal oxide 10, which is the material likely to emit electrons, is thereby set to the ground potential.

An example of a process for manufacturing indirectly heated cathode for gas discharge tube C2 (positioning heater 1 and wire member 21 with respect to double coil 2) shall now be described based on FIGS. 12A to 12C.

Figure 12A:
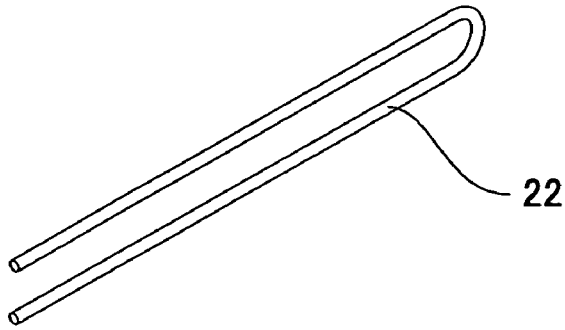
FIG. 12A is a diagram for explaining an example of the manufacturing process of the indirectly heated cathode for gas discharge tube of the second embodiment.
Figure 12B:
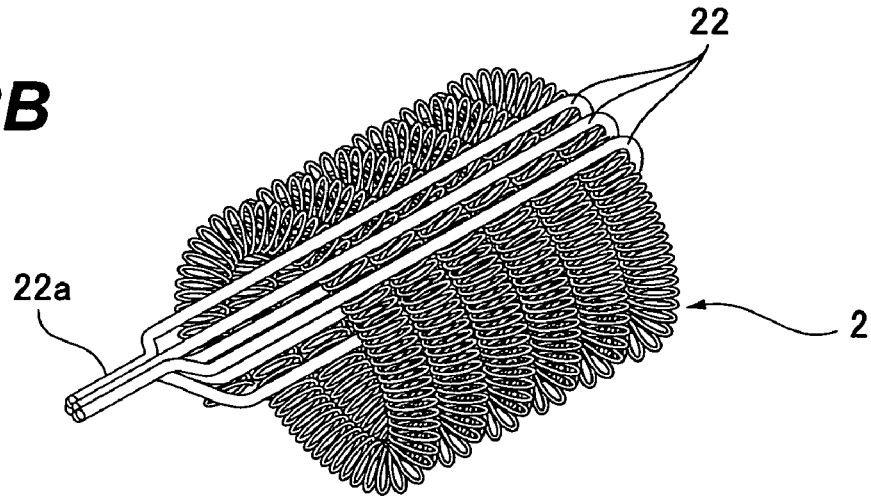
FIG. 12B is a diagram for explaining the example of the manufacturing process of the indirectly heated cathode for gas discharge tube of the second embodiment.

First as shown in FIG. 12A, a plurality (three or four) of tungsten wires 22 are cut and bent into hairpin form. Each cut tungsten wire 22 becomes a wire member 21. Parts at one side of tungsten wires 22 that have been bent into hairpin form are then passed through the inner side of double coil 2, and with double coil 2 being sandwiched by parts at one side of tungsten wires 22 and parts at the other side of tungsten wires 22, the respective ends of tungsten wires 22 are bundled together as shown in FIG. 12B.

Figure 12C:
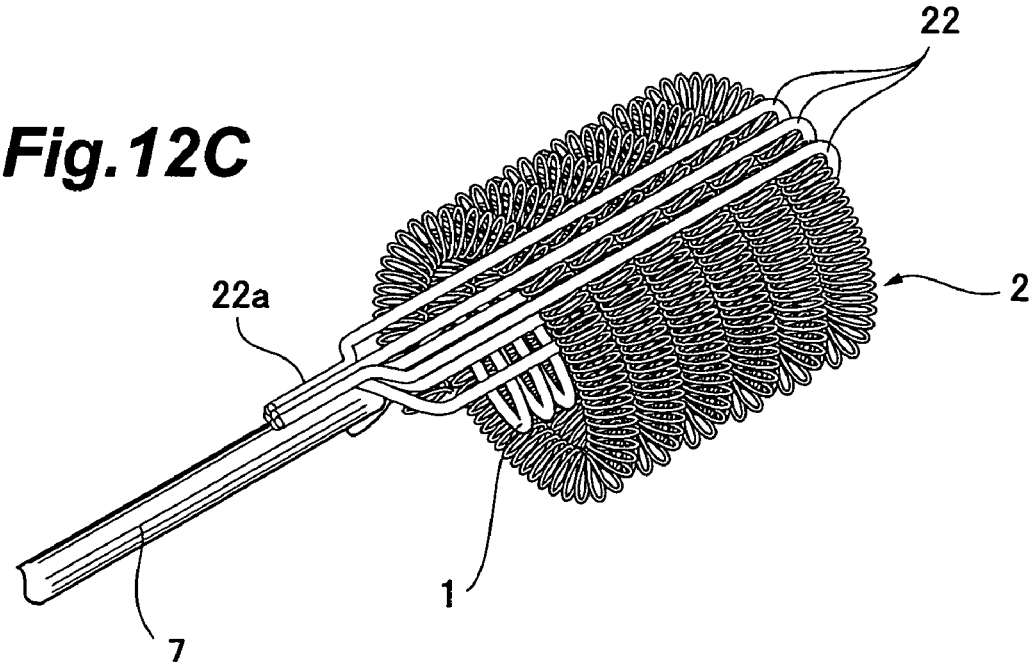
FIG. 12C is a diagram for explaining the example of the manufacturing process of the indirectly heated cathode for gas discharge tube of the second embodiment.

Thereafter, heater 1 is inserted into the inner side of double coil 2, and as shown in FIG. 12C, the bundled parts 22*a* of tungsten wires 22 and the end part of heater 1 are welded to lead rod 7. By the above process, an arrangement is obtained in which heater 1 is positioned at the inner side of double coil 2 and wire members 21 (tungsten wires 22) are positioned at the outer side of double coil 2.

An example of a process for manufacturing indirectly heated cathode for gas discharge tube C2 (positioning heater 1 and wire member 21 with respect to double coil 2) shall now be described based on FIGS. 13A to 13C.

Figure 13A:
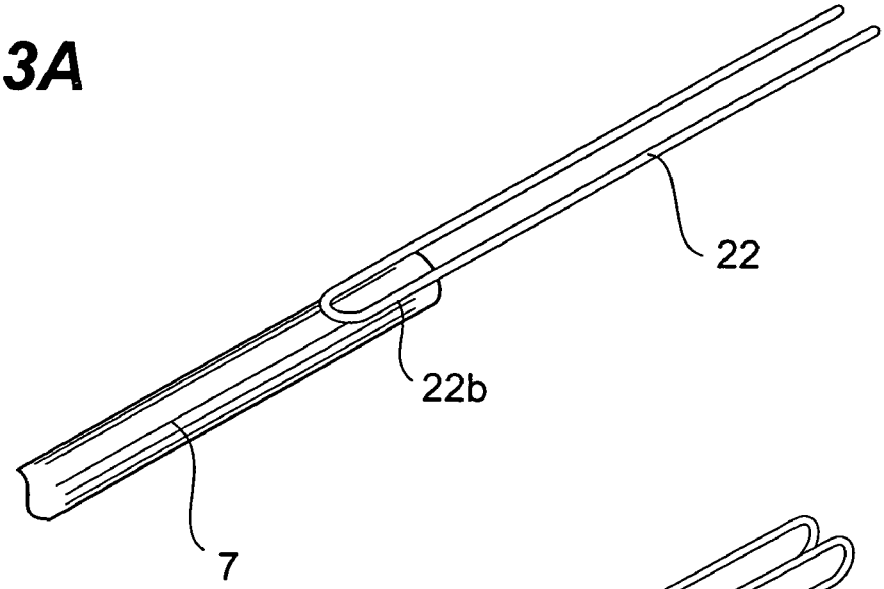
FIG. 13A is a diagram for explaining an example of the manufacturing process of the indirectly heated cathode for gas discharge tube of the second embodiment.
Figure 13B:
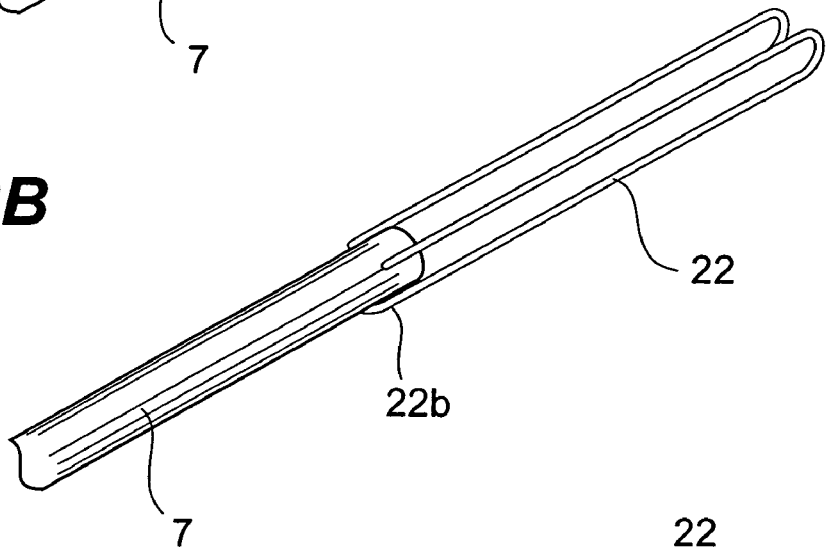
FIG. 13B is a diagram for explaining the example of the manufacturing process of the indirectly heated cathode for gas discharge tube of the second embodiment.
Figure 13C:
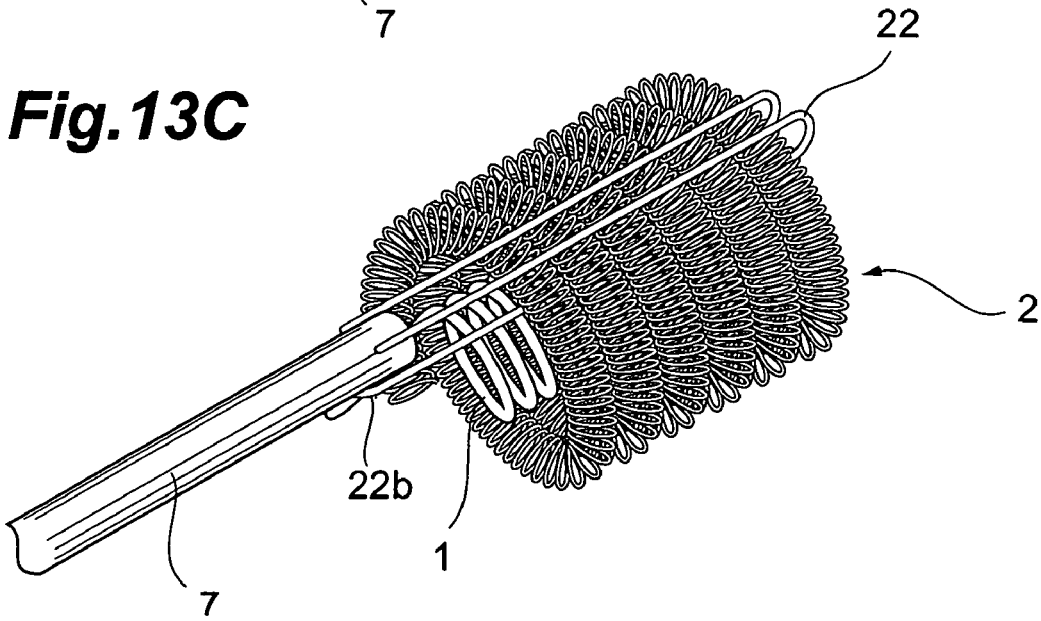
FIG. 13C is a diagram for explaining the example of the manufacturing process of the indirectly heated cathode for gas discharge tube of the second embodiment.

First as shown in FIG. 13A, one (or a plurality of) tungsten wire 22 is cut and bent into hairpin form, and as shown in FIG. 13A, the bent part 22*b* of tungsten wire 22 that has been bent into hairpin form is welded to lead rod 7. The respective end parts of tungsten wire 22 are then bent as shown in FIG. 13B.

Double coil 2 is then passed through the bent tungsten wire 22 and then the end parts of tungsten wire 22 are welded to lead rod 7. Thereafter, heater 1 is inserted into the inner side of double coil 2 and, as shown in FIG. 13C, the end part of heater 1 is welded to lead rod 7.

An example of a process for manufacturing indirectly heated cathode for gas discharge tube C2 (positioning heater 1 and wire member 21 with respect to double coil 2) shall now be described based on FIGS. 14A to 14C.

Figure 14A:
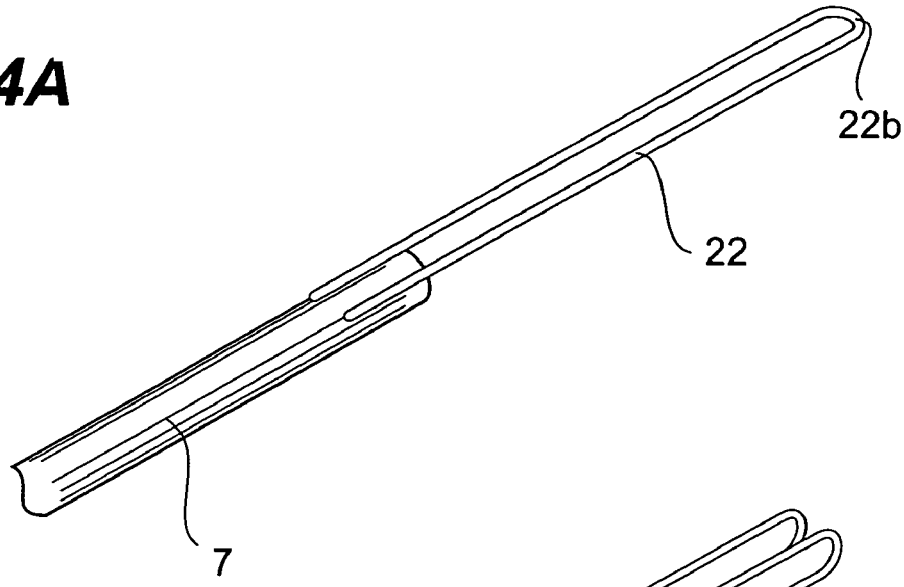
FIG. 14A is a diagram for explaining an example of the manufacturing process of the indirectly heated cathode for gas discharge tube of the second embodiment.
Figure 14B:
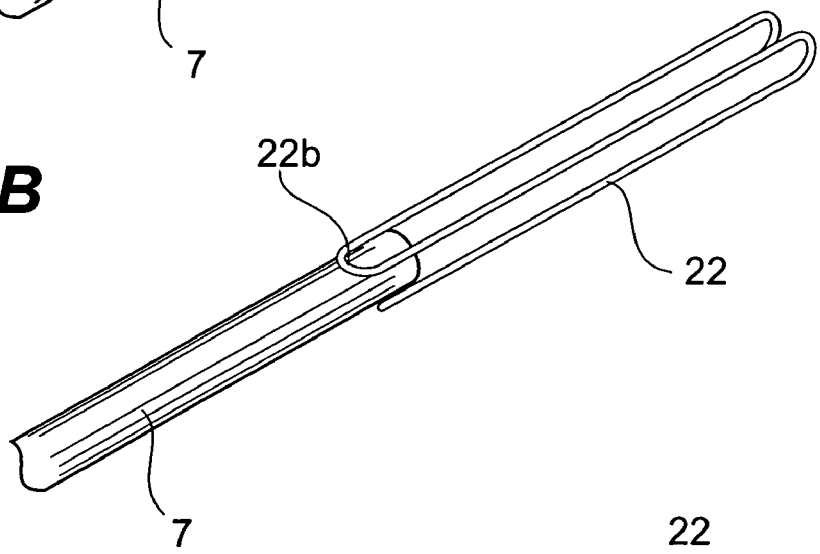
FIG. 14B is a diagram for explaining the example of the manufacturing process of the indirectly heated cathode for gas discharge tube of the second embodiment.
Figure 14C:
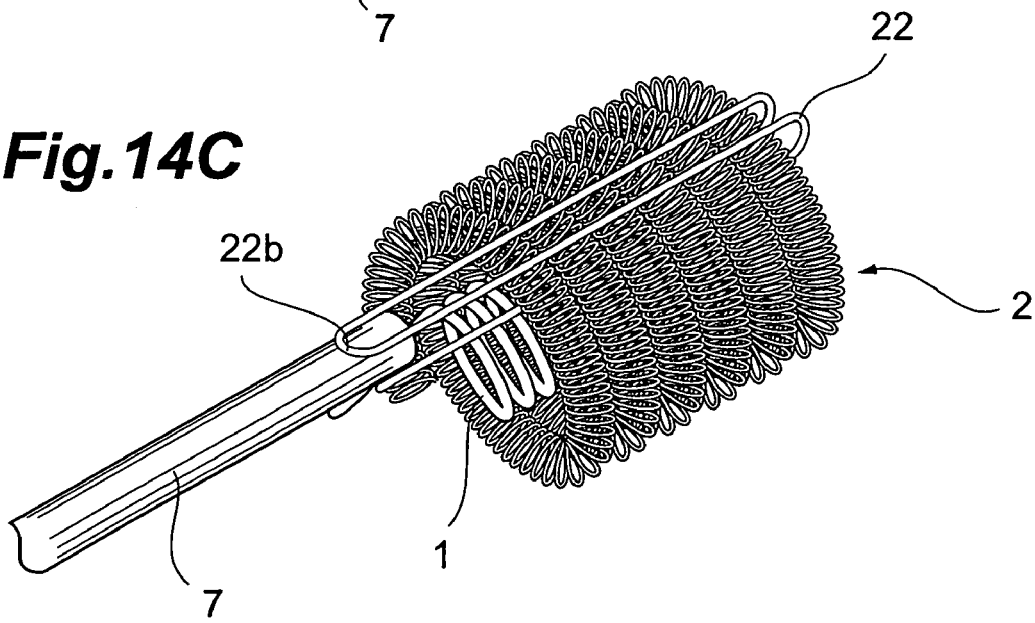
FIG. 14C is a diagram for explaining the example of the manufacturing process of the indirectly heated cathode for gas discharge tube of the second embodiment.
Figure 15:
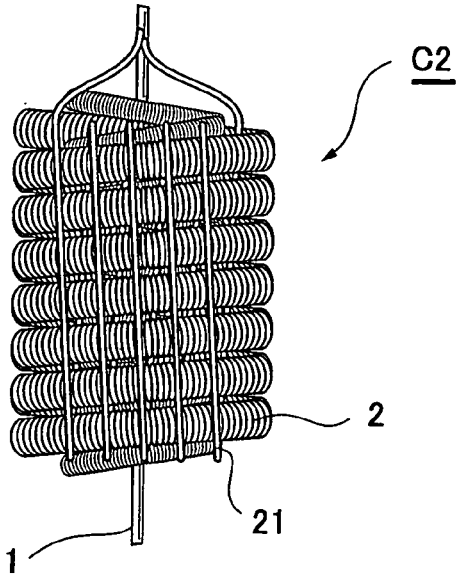
FIG. 15 is a schematic front view, showing a modification example of the indirectly heated cathode for gas discharge tube of the second embodiment.
Figure 16A:
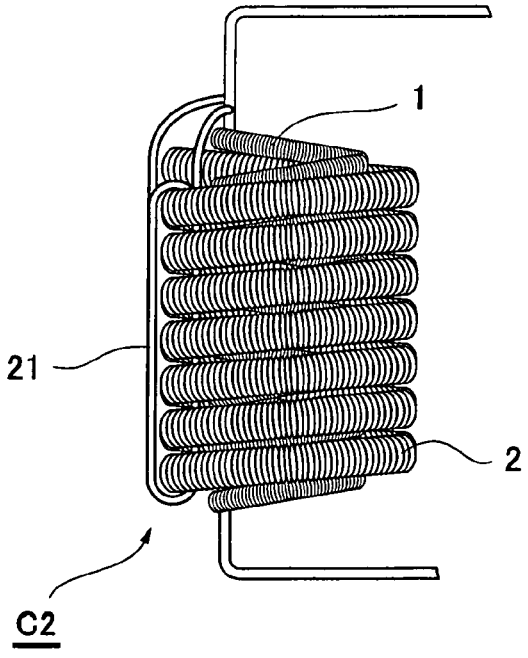
FIG. 16A is a schematic side view, showing a modification example of the indirectly heated cathode for gas discharge tube of the second embodiment.
Figure 16B:
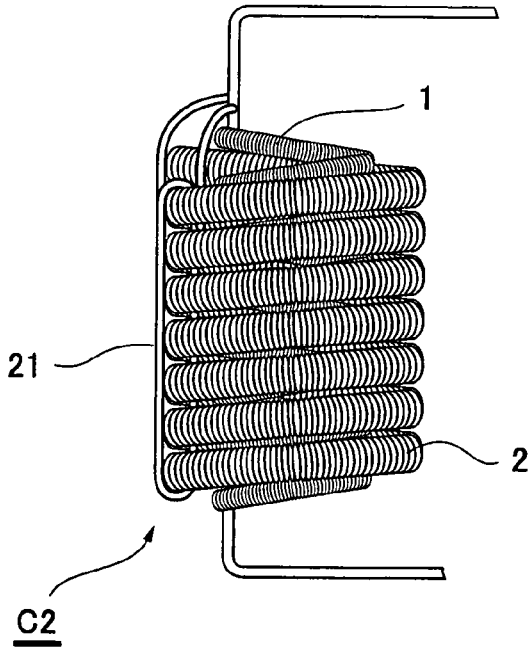
FIG. 16B is a schematic side view, showing a modification example of the indirectly heated cathode for gas discharge tube of the second embodiment.

First as shown in FIG. 14A, one (or a plurality of) tungsten wire 22 is cut and bent into hairpin form, and as shown in FIG. 14A, the respective end parts of tungsten wire 22 that has been bent into hairpin form are welded to lead rod 7. The bent part 22*b* side of tungsten wire 22 is then bent as shown in FIG. 14B.

Double coil 2 is then passed through the bent tungsten wire 22 and then the bent parts 22*b* of tungsten wire 22 are welded to lead rod 7. Thereafter, heater 1 is inserted into the inner side of double coil 2 and, as shown in FIG. 14C, the end part of heater 1 is welded to lead rod 7.

Returning now to FIG. 11, indirectly heated cathode for gas discharge tube C2 has metal oxide 10 as the material likely to emit electrons. Metal oxide 10 is held by double coil 2 and is put in contact with wire member 21. Metal oxide 10 and wire member 21 are exposed to the outer side of indirectly heated cathode for gas discharge tube C2 so that the surface of metal oxide 10 and the surface of wire member 21 make up a discharge surface and the surface part of metal oxide 10 is put in contact with wire member 21. Metal oxide 10 is disposed in the same manner as in the first embodiment.

As a further example of a process for manufacturing indirectly heated cathode for gas discharge tube C2, the process described using FIGS. 8A and 8B for the first embodiment may be used with mesh member 3 being replaced by one or a plurality of wire members 21.

As described above, with indirectly heated cathode for gas discharge tube C2 of the second embodiment, since wire member 21 is put in contact with metal oxide 10, an equipotential surface is formed effectively by wire member 21 by wire member 21 being in electrical contact with double coil 2 at a plurality of locations, and thermionic emission thus occurs over a wide region of the equipotential surface that is formed, the discharge area is increased, the electron emission amount per unit area (electron emission density) is increased, and the load placed on the discharge position is lightened, thereby enabling the sputtering of metal oxide 10 and stabilization (mineralization) due to oxidation with the reduced metal, which are degradation factors, to be restrained, that is, the degradation of the thermionic emission ability to be restrained. As a result, the occurrence of localized discharge can be restrained and long service life of the cathode can be realized. Since the movement of the discharge position is also restrained, stable discharge over a long period of time can be realized.

Also, with indirectly heated cathode for gas discharge tube C2, due to the increase of the discharge area, even if the current density is slightly increased and the load is somewhat increased, that is, even if the discharge current is increased, the damage can be made less than that of the prior art. This enables the provision of an indirectly heated cathode for gas discharge tube of large discharge current with substantially the same shape as that of the prior art and the realization of pulse operation and large current operation.

Also since wire member 21 is used as the electrical conductor, an electrical conductor of an arrangement, which can restrain the degradation of the thermionic emission ability and the movement of the discharge position, can be realized at low cost and in a simpler manner. Also, since wire member 21 (electrical conductor) is a rigid body, it is easy to process and can be put in close contact with metal oxide 10.

Figure 17A:
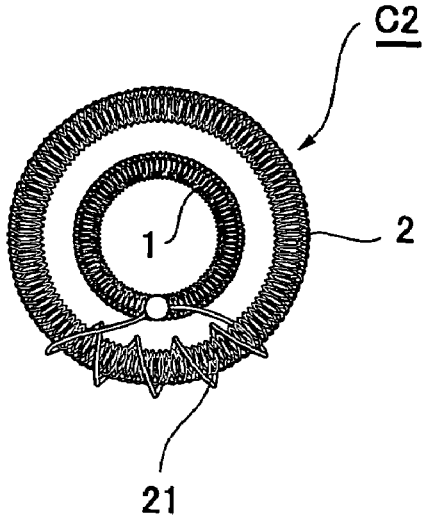
FIG. 17A is a schematic top view, showing a modification example of the indirectly heated cathode for gas discharge tube of the second embodiment.
Figure 17B:
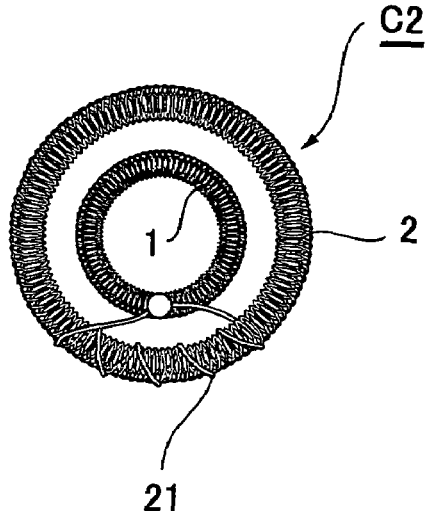
FIG. 17B is a schematic top view, showing a modification example of the indirectly heated cathode for gas discharge tube of the second embodiment.
Figure 18:
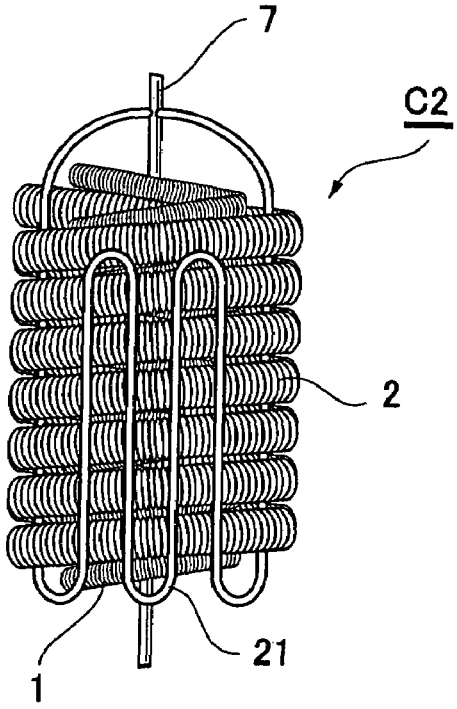
FIG. 18 is a schematic front view, showing a modification example of the indirectly heated cathode for gas discharge tube of the second embodiment.
Figure 19A:
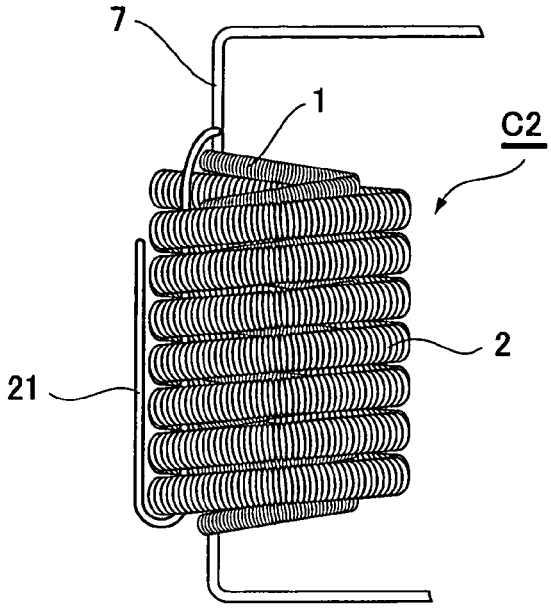
FIG. 19A is a schematic side view, showing a modification example of the indirectly heated cathode for gas discharge tube of the second embodiment.
Figure 19B:
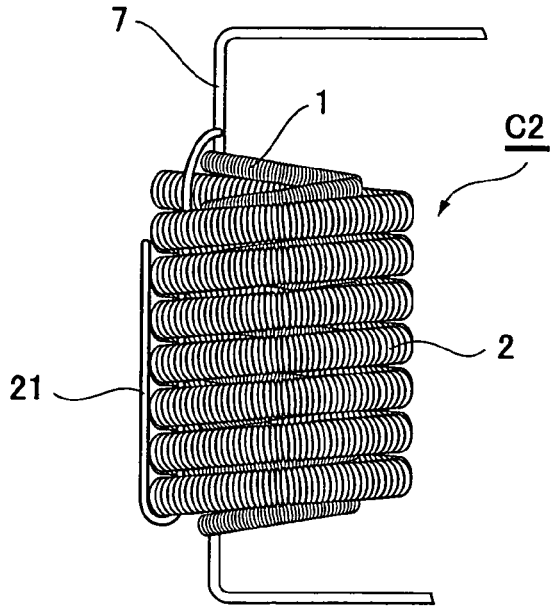
FIG. 19B is a schematic side view, showing a modification example of the indirectly heated cathode for gas discharge tube of the second embodiment.

As modification examples of indirectly heated cathode for gas discharge tube C2 of the second embodiment, a single wire member 21 may be disposed along the length direction of double coil 2 while being wound a plurality of times around double coil 2 as shown in FIGS. 15 through 17B. In FIGS. 16A and 17A, wire member 21 is disposed with there being a gap between double coil 2. In FIGS. 16B and 17B, wire member 21 is disposed so as to be in electrical contact with a plurality of coil portions of double coil 2 along the length direction of double coil 2.

Figure 20A:
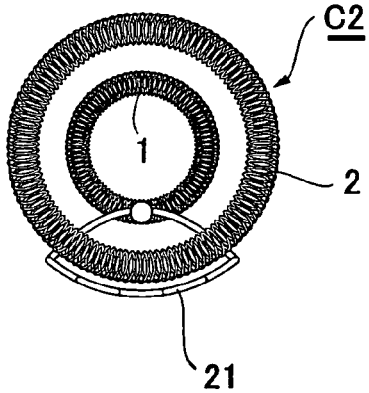
FIG. 20A is a schematic top view, showing a modification example of the indirectly heated cathode for gas discharge tube of the second embodiment.
Figure 20B:
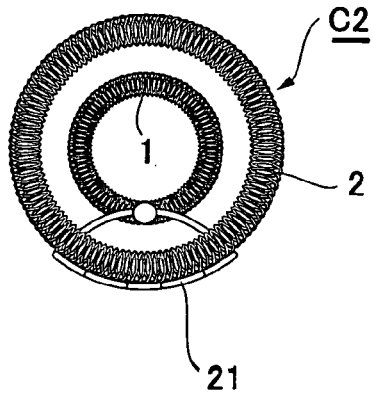
FIG. 20B is a schematic top view, showing a modification example of the indirectly heated cathode for gas discharge tube of the second embodiment.
Figure 21:
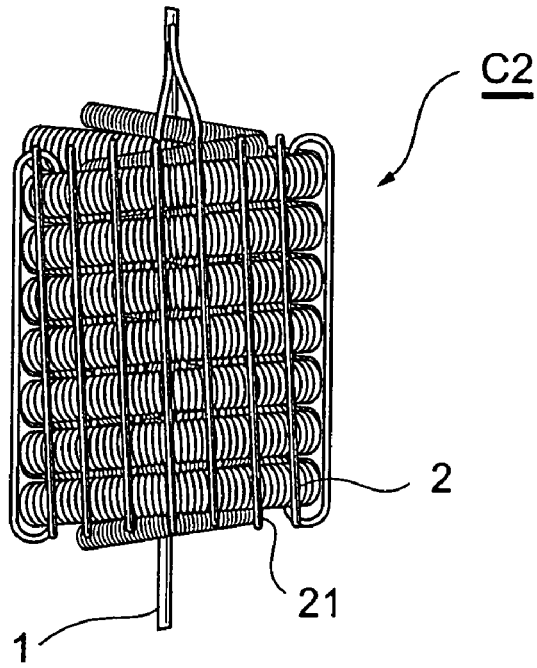
FIG. 21 is a schematic front view, showing a modification example of the indirectly heated cathode for gas discharge tube of the second embodiment.
Figure 22:
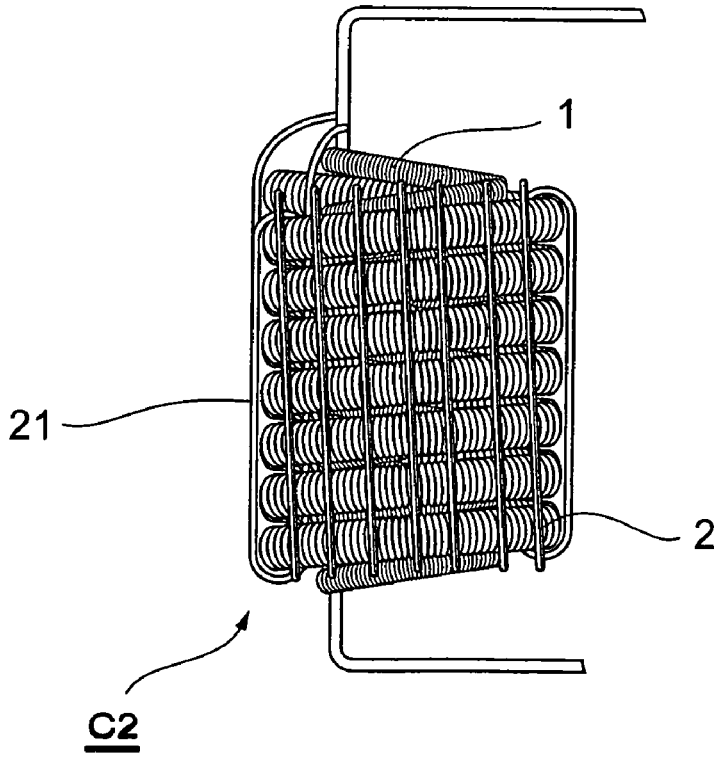
FIG. 22 is a schematic side view, showing a modification example of the indirectly heated cathode for gas discharge tube of the second embodiment.

Also as modification examples of indirectly heated cathode for gas discharge tube C2 of the second embodiment, a single wire member 21 may be disposed along the length direction of double coil 2 while being bent a plurality of times in a meandering manner at the outer side of double coil 2 as shown in FIGS. 18 to 20B. In FIGS. 19A and 20A, wire member 21 is disposed with there being a gap between double coil 2. In FIGS. 19B and 20B, wire member 21 is disposed so as to be in electrical contact with a plurality of coil portions of double coil 2 along the length direction of double coil 2.

Figure 23A:
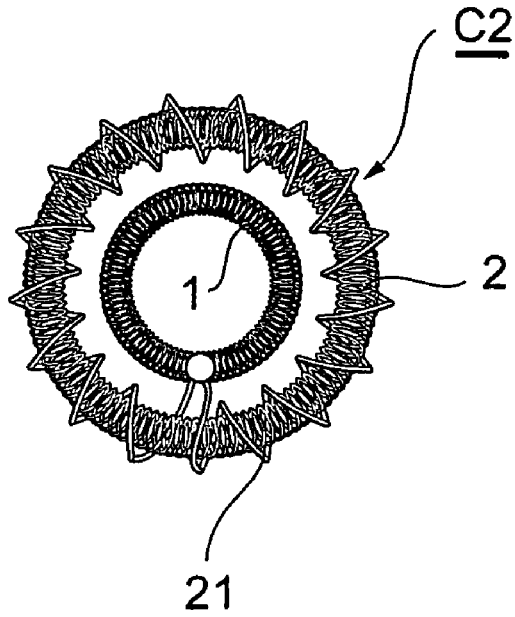
FIG. 23A is a schematic top view, showing a modification example of the indirectly heated cathode for gas discharge tube of the second embodiment.
Figure 23B:
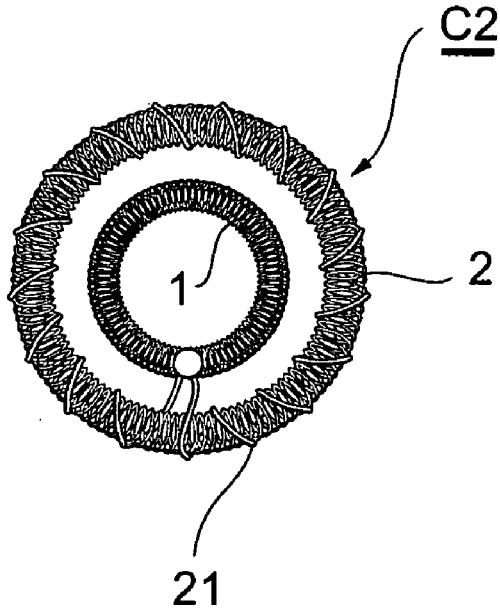
FIG. 23B is a schematic top view, showing a modification example of the indirectly heated cathode for gas discharge tube of the second embodiment.

As further modification examples of indirectly heated cathode for gas discharge tube C2 of the second embodiment, a single wire member 21 may be wound a plurality of times over the entire periphery of double coil 2 as shown in FIGS. 21 to 23B. In FIG. 23A, wire member 21 is disposed with there being a gap between double coil 2. In FIG. 23B, wire member 21 is disposed so as to be in electrical contact with a plurality of coil portions of double coil 2 along the length direction of double coil 2.

Figure 24:
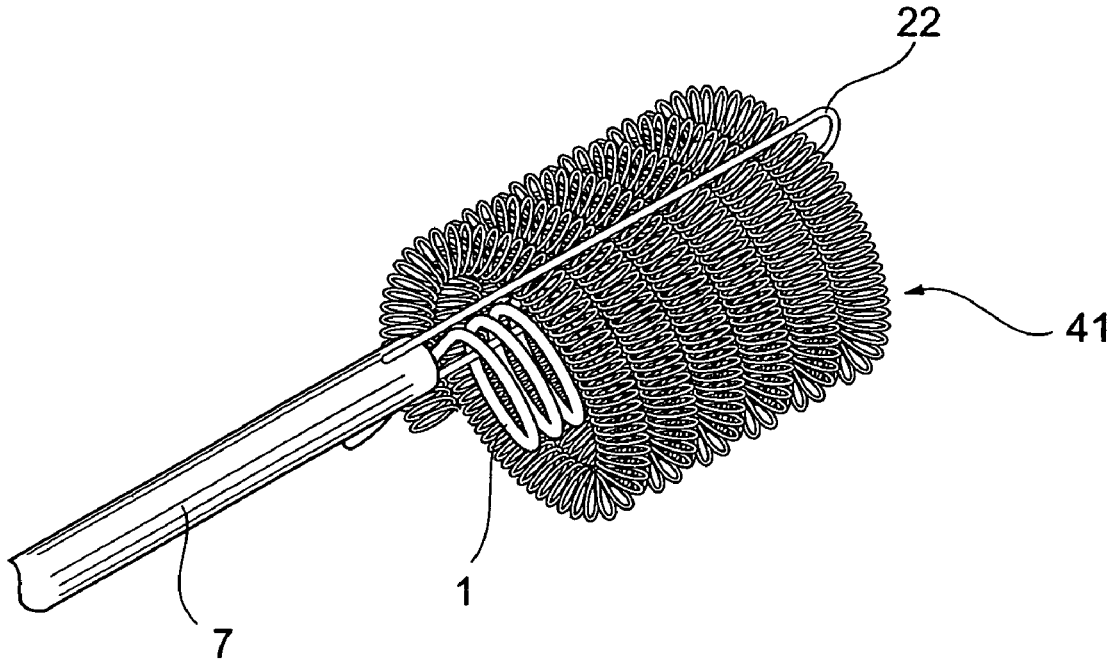
FIG. 24 is a schematic perspective view, showing a modification example of the indirectly heated cathode for gas discharge tube of the second embodiment.

As yet a further modification example of indirectly heated cathode for gas discharge tube C2 of the second embodiment, an arrangement may be considered wherein a tungsten wire 22 is bent into hairpin form, a part at one side of the single tungsten wire 22 (corresponding to wire member 21) that has been bent into hairpin form is passed through the inner side of double coil 2, and, with double coil 2 being sandwiched by the part at one side of wire 22 and a part at the other side of wire 22, the end parts of wire 22 are welded to lead rod 7 as shown in FIG. 24. In FIG. 24, wire member 21 is disposed so as to be in electrical contact with a plurality of coil portions of double coil 2 along the length direction of double coil 2.

Though illustrations of metal oxide 10 and electrical insulating layer 4 are omitted for the sake of description in FIGS. 14A to 24, needless to say, wire member 21 is disposed in contact with metal oxide 10 and electrical insulating layer 4 is formed on heater 1 in these modification examples as well.

Figure 25:
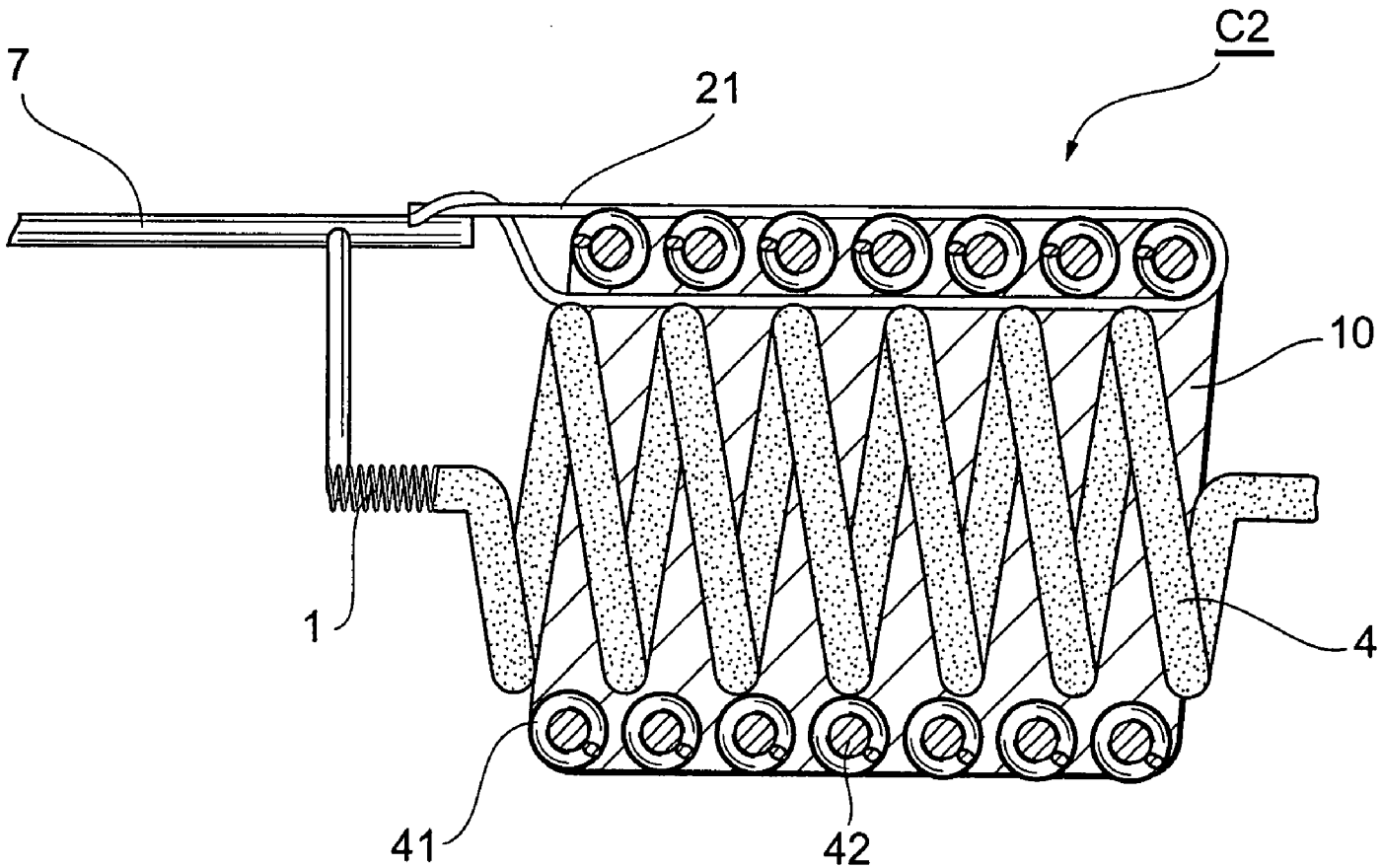
FIG. 25 is a schematic sectional view, showing a modification example of the indirectly heated cathode for gas discharge tube of the second embodiment.

A modification example of the second embodiment shall now be described based on FIG. 25. FIG. 25 is a schematic sectional view of a modification example of the indirectly heated cathode for gas discharge tube of the second embodiment. This modification example differs from the second embodiment in that the double coil has a mandrel.

As shown in FIG. 25, indirectly heated cathode for gas discharge tube C2 has heater 1, a double coil 41 as the coil member, wire member 21, and metal oxide 10 as the material likely to emit electrons.

Double coil 41, like double coil 2 of the second embodiment, is a multiple coil arranged from a coil wound in coil form and has a mandrel 42. Heater 1 is disposed at the inner side of double coil 41. Wire member 21 is disposed at the outer side of double coil 41 so as to be substantially orthogonal to the discharge direction along the length direction of double coil 41 (heater 1). As shown in FIG. 25, this wire member 21 is disposed so as to be in electrical contact with a plurality of coil portions of double coil 41 along the length direction of double coil 41.

With this modification example, since double coil 41 has mandrel 42, the additional effect that the deformation of double coil 41 during processing can be restrained is provided.

Figure 26:
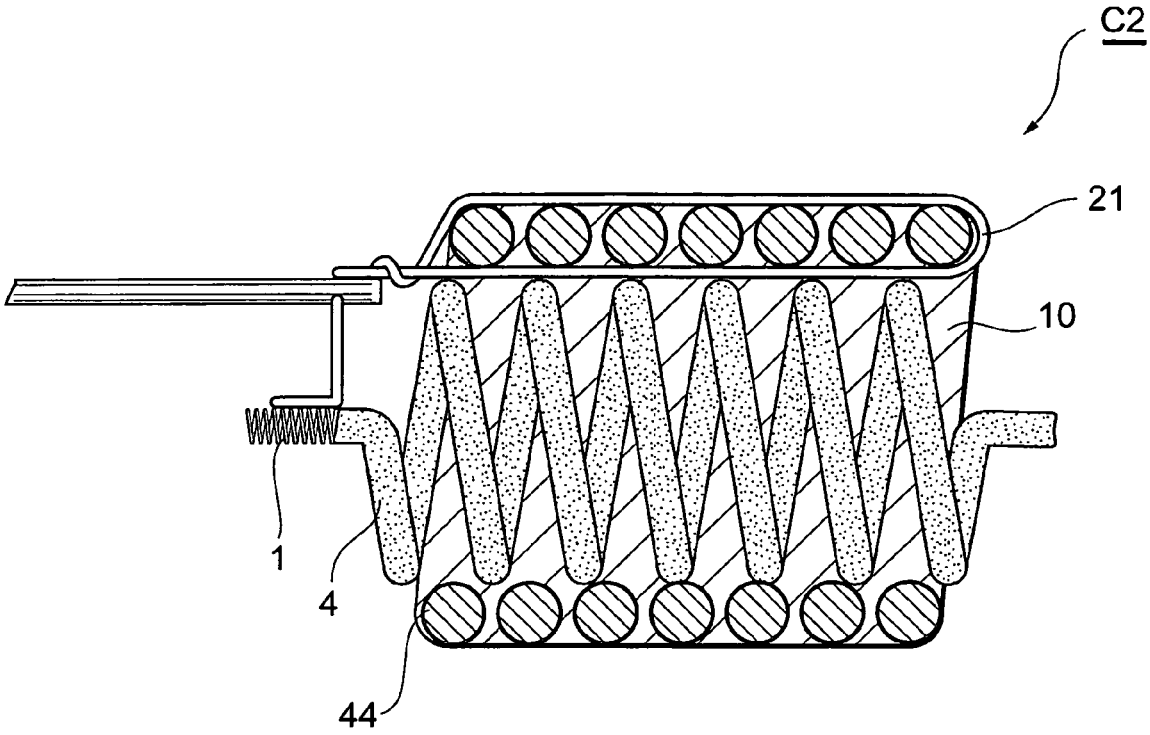
FIG. 26 is a schematic sectional view, showing a modification example of the indirectly heated cathode for gas discharge tube of the second embodiment.
Figure 27:
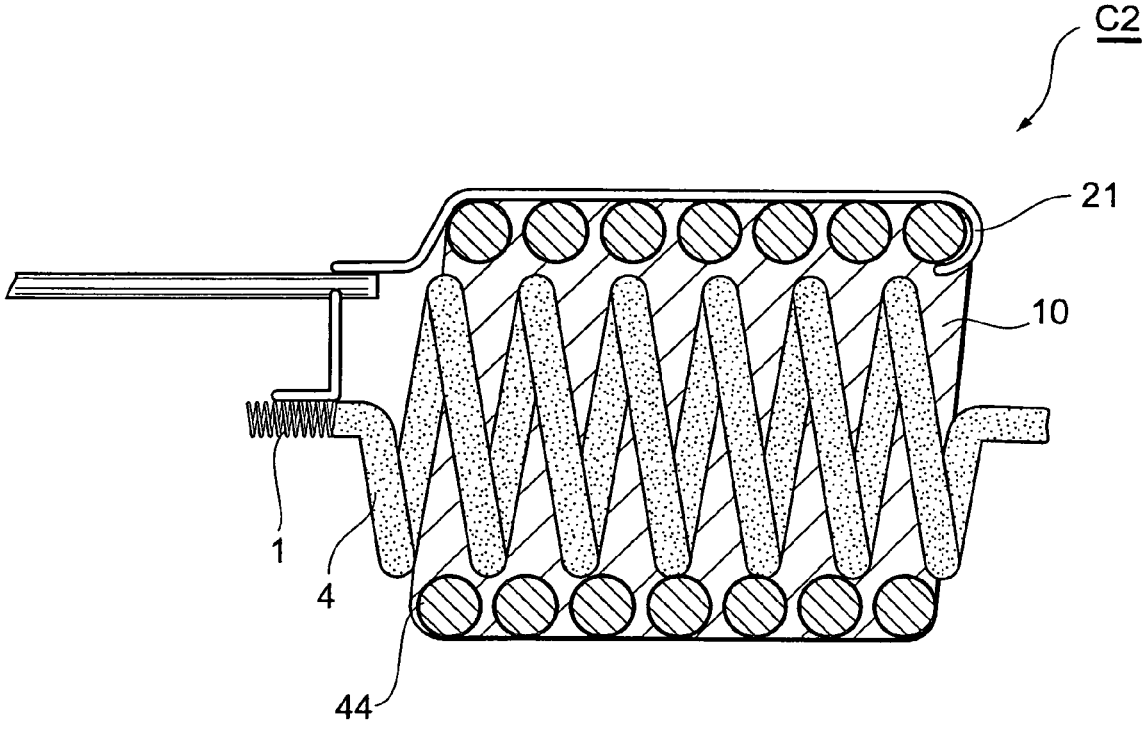
FIG. 27 is a schematic sectional view, showing a modification example of the indirectly heated cathode for gas discharge tube of the second embodiment.

A modification example of the second embodiment shall now be described based on FIGS. 26 and 27. FIGS. 26 and 27 are schematic sectional views of a modification example of the indirectly heated cathode for gas discharge tube of the second embodiment. This modification example differs from the second embodiment in having a single coil.

As shown in FIG. 26 and 27, indirectly heated cathode for gas discharge tube C2 has heater 1, a single coil 44 as the coil member, wire member 21, and metal oxide 10 as the material likely to emit electrons.

Single coil 44 is a coil member arranged from a coil wound in the form of a single coil and is formed of a tungsten element wire. Heater 1 is disposed at the inner side of single coil 44. Wire member 21 is disposed at the outer side of single coil 44 so as to be substantially orthogonal to the discharge direction along the length direction of single coil 44 (heater 1). As shown in FIGS. 26 and 27, this wire member 21 is disposed so as to be in electrical contact with a plurality of coil portions of single coil 44 along the length direction of single coil 44.

THIRD EMBODIMENT

Figure 28:
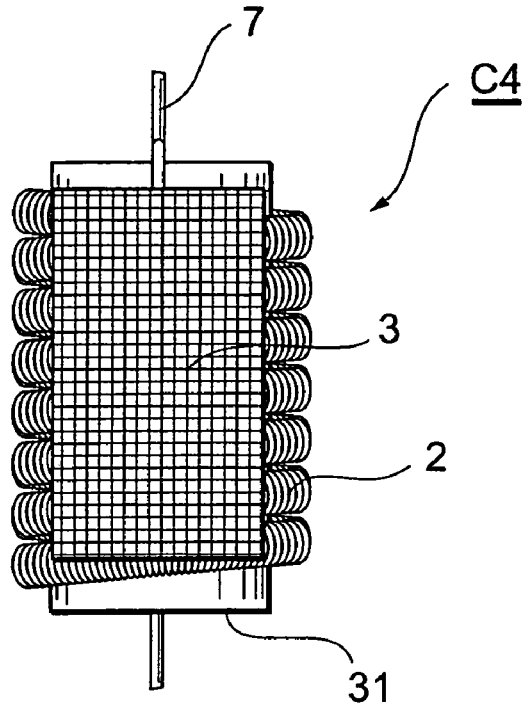
FIG. 28 is a schematic top view, showing an indirectly heated cathode for gas discharge tube of a third embodiment.
Figure 29:
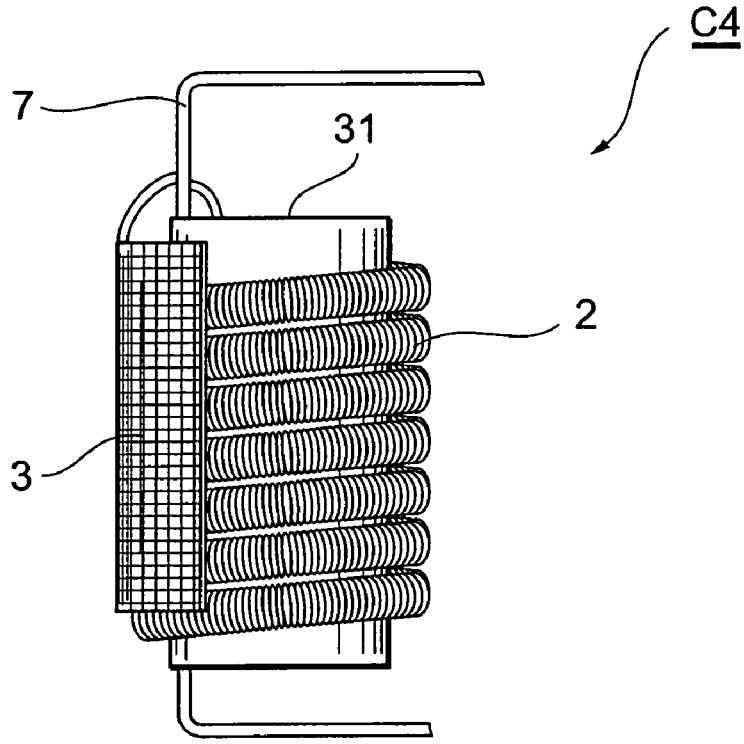
FIG. 29 is a schematic side view, showing an indirectly heated cathode for gas discharge tube of the third embodiment.
Figure 30A:
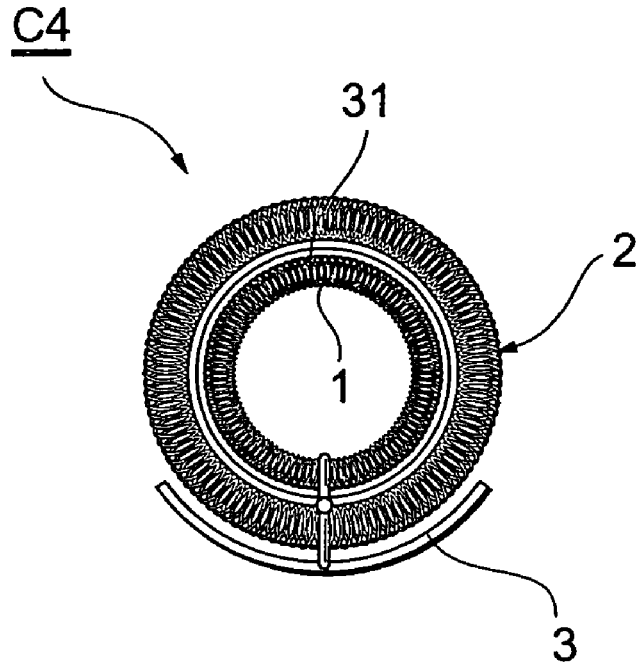
FIG. 30A is a schematic top view, showing an indirectly heated cathode for gas discharge tube of the third embodiment.
Figure 30B:
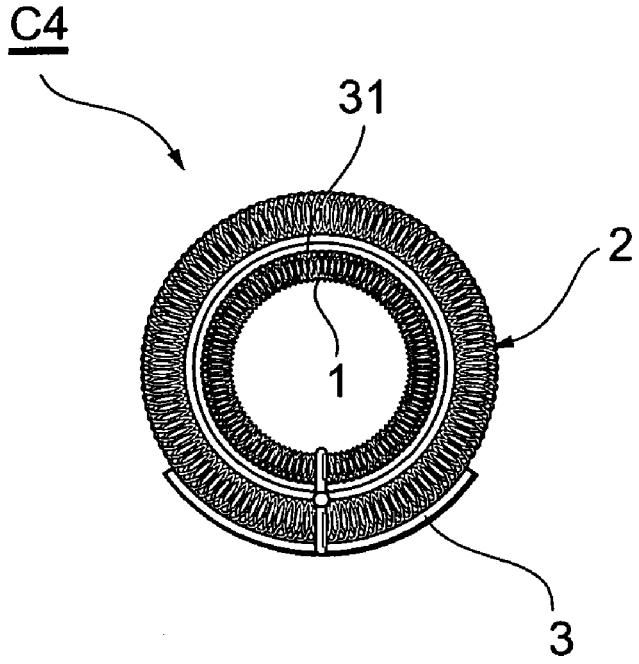
FIG. 30B is a schematic top view, showing an indirectly heated cathode for gas discharge tube of the third embodiment.
Figure 31:
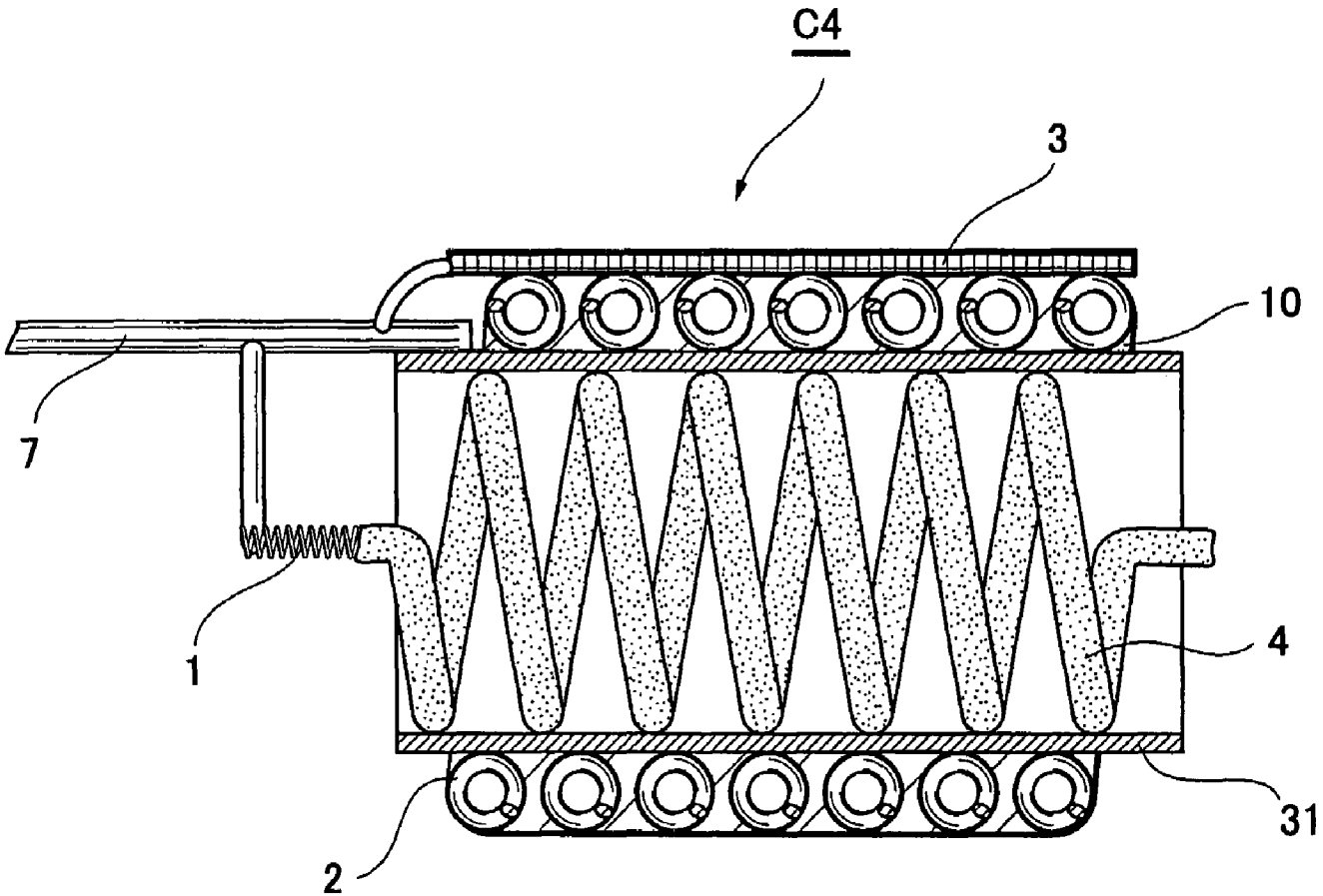
FIG. 31 is a schematic sectional view, showing an indirectly heated cathode for gas discharge tube of the third embodiment.

FIG. 28 is a schematic top view of an indirectly heated cathode for gas discharge tube of a third embodiment, FIG. 29 is likewise a schematic side view of an indirectly heated cathode for gas discharge tube of the third embodiment, FIGS. 30A and 30B are likewise schematic top views of indirectly heated cathodes for gas discharge tube of the third embodiment, and FIG. 31 is likewise a schematic sectional view of an indirectly heated cathode for gas discharge tube of the third embodiment. With FIGS. 28 through 31, illustrations of an electrical insulating layer 4 and a metal oxide 10 are omitted for the sake of description. The third embodiment differs from the first and second embodiments in having a base metal.

As shown in FIGS. 28 through 31, an indirectly heated cathode for gas discharge tube C4 has a heater 1, a double coil 2, a mesh member 3, a metal oxide 10 as a material likely to emit electrons, and a base metal 31.

Base metal 31 is formed to a tubular form and is conductive. Base metal 31 is formed for example of molybdenum, etc. Heater 1 is inserted into and disposed at the inner side of this base metal 31. Double coil 2 is wound a plurality of times around and fixed to the outer surface of base metal 31. Mesh member 3 is positioned substantially orthogonal to the discharge direction. Base metal 31 and mesh member 3 are put in a grounded state by being connected to lead rod 7 and double coil 2 is grounded via base metal 31. Metal oxide 10, which is the material likely to emit electrons, is thereby set to the ground potential. Base metal 31 also functions as a barrier between metal oxide 10, which is the material likely to emit electrons, and electrical insulating layer 4, which is formed on heater 1.

As base metal 31, a high-melting-point metal with a melting point that is higher than the cathode temperature during operation may be used. Also, in place of using double coil 2, a double coil 41 having a mandrel or a single coil may be used. Also, though a tubular member of cylindrical shape is generally used as base metal 31, a tubular member having an arcuate shape with a notch (an open shape) may be used instead.

Metal oxide 10 is held by double coil 2 and is put in contact with mesh member 3. Metal oxide 10 and mesh member 3 are exposed to the outer side of indirectly heated cathode for gas discharge tube C4 so that the surface of metal oxide 10 and the surface of mesh member 3 make up a discharge surface and the surface part of metal oxide 10 is put in contact with mesh member 3. Metal oxide 10 is disposed in the same manner as in the first embodiment. In FIG. 30A, mesh member 3 is disposed with there being a gap between double coil 2. In FIGS. 30B and 31, mesh member 3 is disposed so as to be in electrical contact with a plurality of coil portions of double coil 2 along the length direction of double coil 2.

As described above, with indirectly heated cathode for gas discharge tube C4 of the third embodiment, since mesh member 3 is put in contact with metal oxide 10, an equipotential surface is formed effectively by mesh member 3 in contact with metal oxide 10, and thermionic emission thus occurs over a wide region of the equipotential surface that is formed, the discharge area is increased, the electron emission amount per unit area (electron emission density) is increased, and the load placed on the discharge position is lightened, thereby enabling the sputtering of metal oxide 10 and stabilization (mineralization) due to oxidation with the reduced metal, which are degradation factors, to be restrained, that is, the degradation of the thermionic emission ability to be restrained. As a result, the occurrence of localized discharge can be restrained and long service life of the cathode can be realized. Since the movement of the discharge position is also restrained, stable discharge over a long period of time can be realized.

Also, with indirectly heated cathode for gas discharge tube C4, due to the increase of the discharge area, even if the current density is slightly increased and the load is somewhat increased, that is, even if the discharge current is increased, the damage can be made less than that of the prior art. This enables the provision of an indirectly heated cathode for gas discharge tube of large discharge current with substantially the same shape as that of the prior art and the realization of pulse operation and large current operation.

Also, base metal 31 is provided and can act as a heat conductor for aiding thermal decomposition when a metal carbonate is converted (thermally decomposed) to metal oxide 10 as a thermion supply source. Also, metal oxide 10 and heater 1 can be separated definitely. Furthermore, the reducing ability possessed by base metal 31 can be put to use to reduce metal oxide 10 and produce the free metal element during operation to improve the electron emission ability. Furthermore, the heat from heater 1 can be transferred to metal oxide 10 definitely in the active state.

Figure 32:
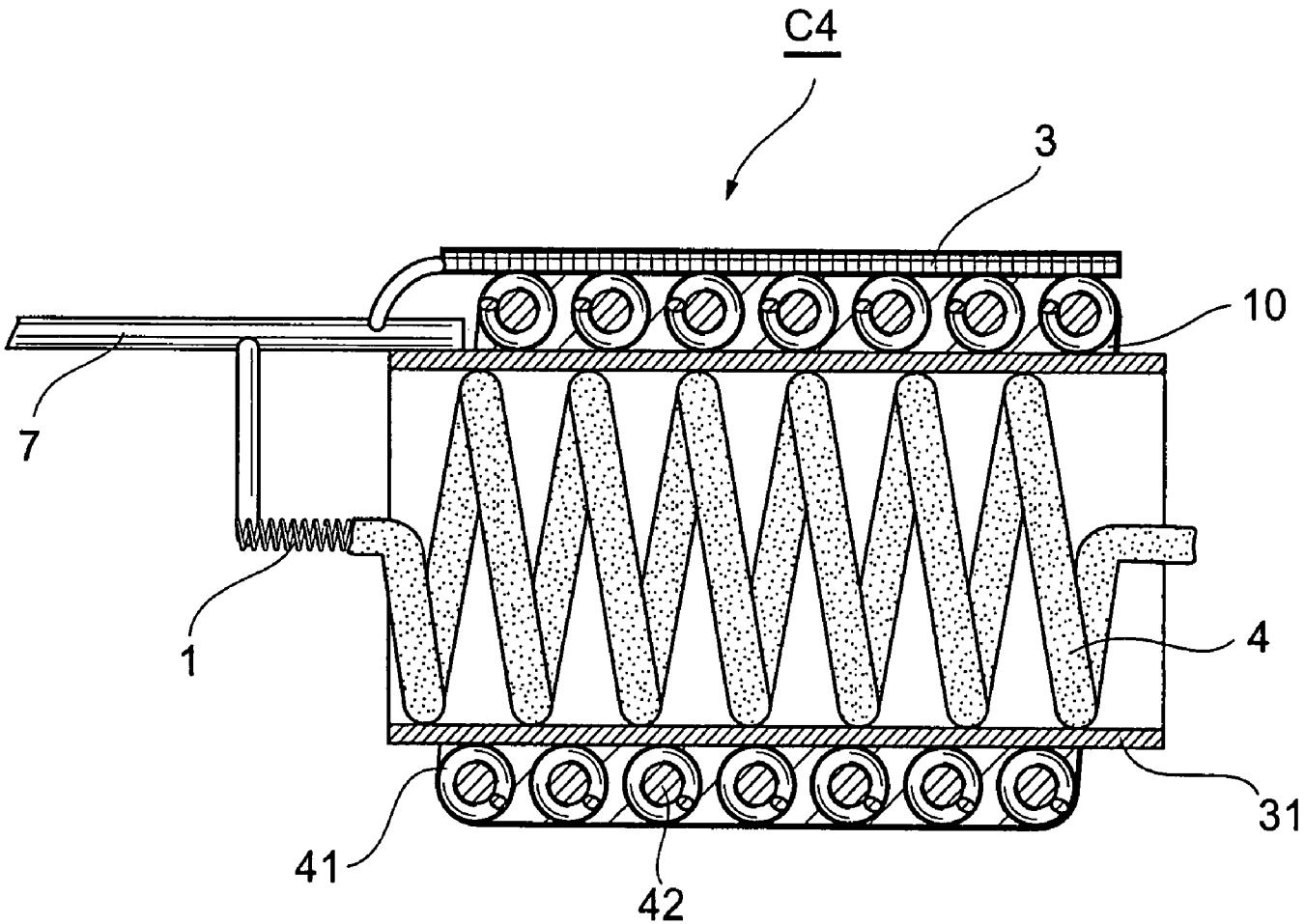
FIG. 32 is a schematic sectional view, showing a modification example of the indirectly heated cathode for gas discharge tube of the third embodiment.

A modification example of the third embodiment shall now be described based on FIG. 32. FIG. 32 is a schematic sectional view of a modification example of the indirectly heated cathode for gas discharge tube of the third embodiment. This modification example differs from the third embodiment in that the double coil has a mandrel.

As shown in FIG. 32, indirectly heated cathode for gas discharge tube C4 has heater 1, a double coil 41 as the coil member, mesh member 3, metal oxide 10 as the material likely to emit electrons, and base metal 31.

Double coil 41, like double coil 2 of the third embodiment, is a multiple coil arranged from a coil wound in coil form and has a mandrel 42. Heater 1 is disposed at the inner side of double coil 41. Mesh member 3 is disposed between heater 1 and double coil 41 so as to be substantially orthogonal to the discharge direction along the length direction of double coil 41 (heater 1). As shown in FIG. 32, this mesh member 3 is disposed so as to be in electrical contact with a plurality of coil portions of double coil 41 along the length direction of double coil 41.

With this modification example, since double coil 41 has mandrel 42, the additional effect that the deformation of double coil 41 during processing can be restrained is provided.

FOURTH EMBODIMENT

Figure 33:
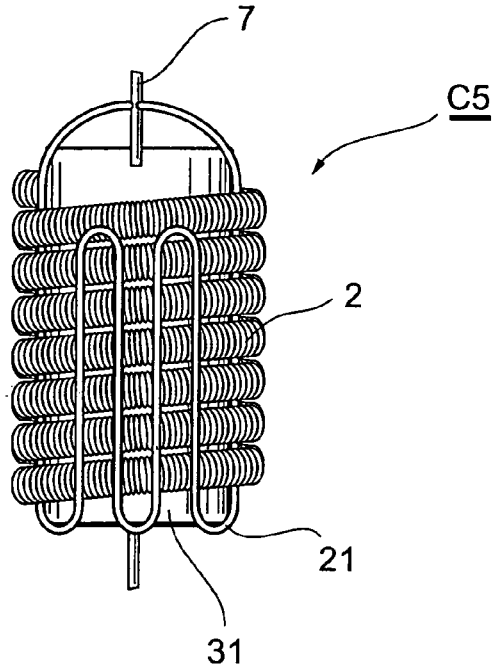
FIG. 33 is a schematic top view, showing an indirectly heated cathode for gas discharge tube of a fourth embodiment.
Figure 34A:
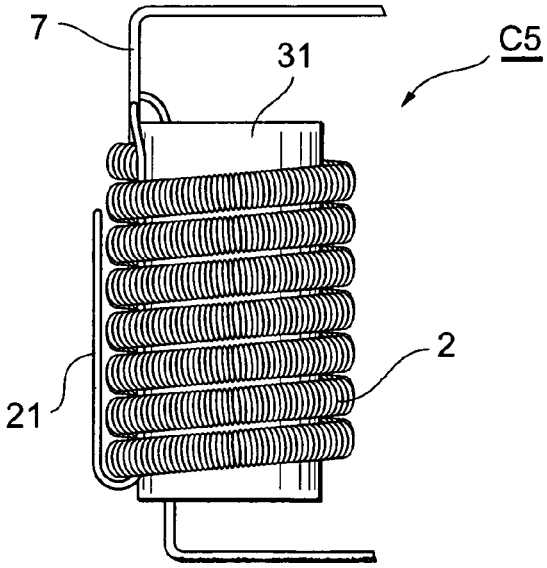
FIG. 34A is a schematic side view, showing an indirectly heated cathode for gas discharge tube of the fourth embodiment.
Figure 34B:
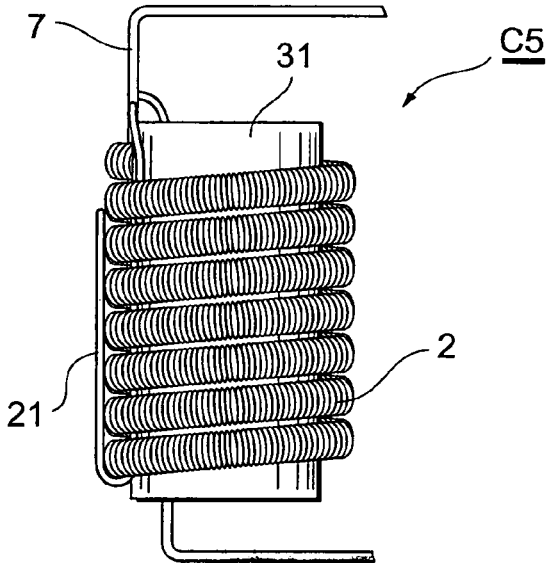
FIG. 34B is a schematic side view, showing an indirectly heated cathode for gas discharge tube of the fourth embodiment.
Figure 35A:
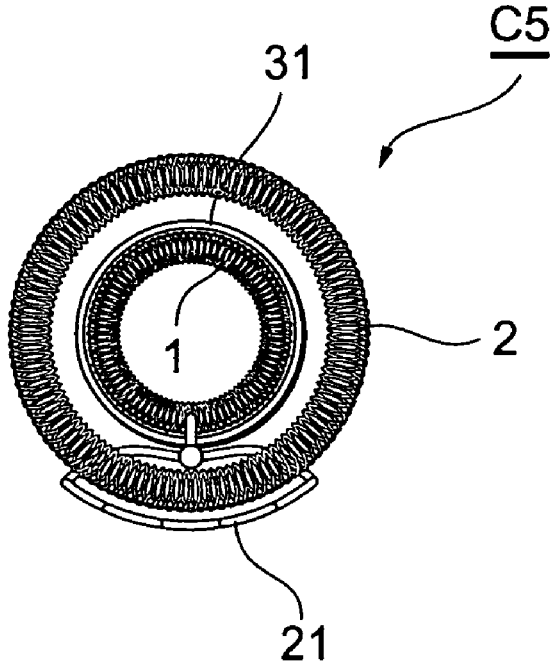
FIG. 35A is a schematic top view, showing an indirectly heated cathode for gas discharge tube of the fourth embodiment.
Figure 35B:
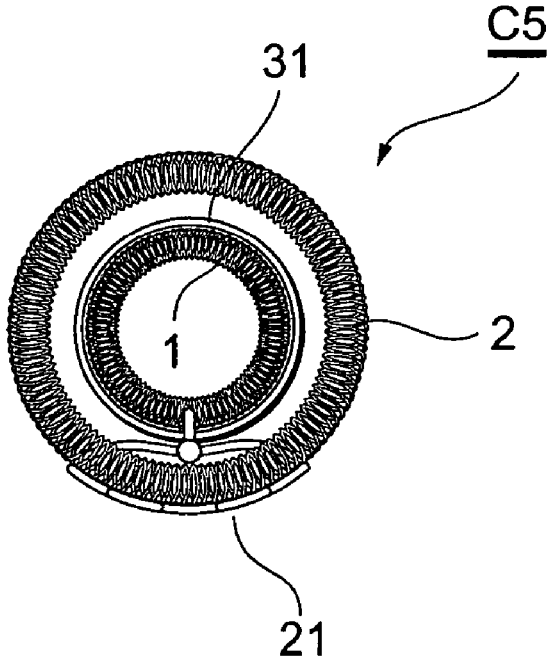
FIG. 35B is a schematic top view, showing an indirectly heated cathode for gas discharge tube of the fourth embodiment.
Figure 36:
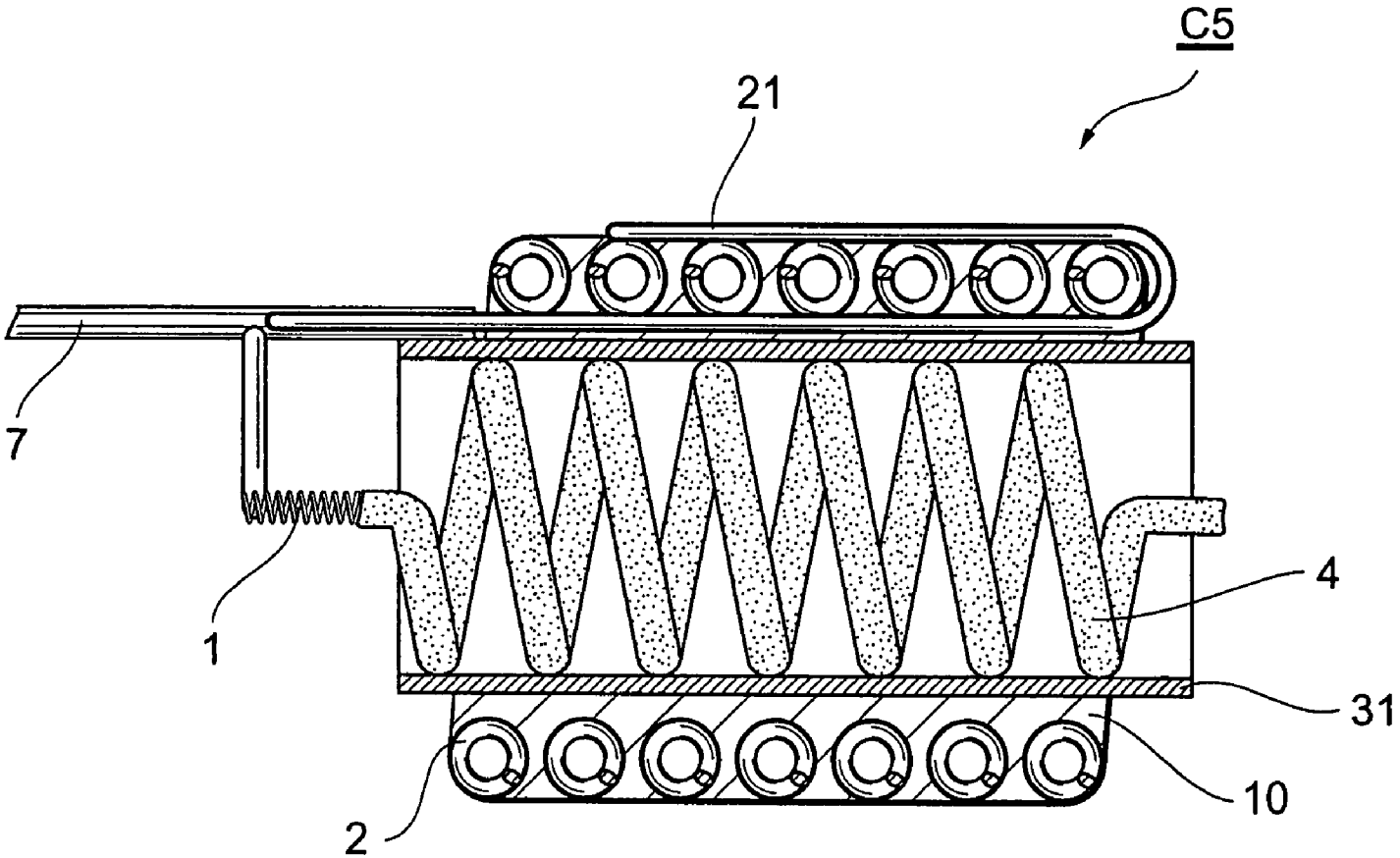
FIG. 36 is a schematic sectional view, showing an indirectly heated cathode for gas discharge tube of the fourth embodiment.

FIG. 33 is a schematic top view of an indirectly heated cathode for gas discharge tube of a fourth embodiment, FIGS. 34A and 34B are likewise schematic side views of indirectly heated cathodes for gas discharge tube of the fourth embodiment, FIGS. 35A and 35B are likewise schematic top views of indirectly heated cathodes for gas discharge tube of the fourth embodiment, and FIG. 36 is likewise a schematic sectional view of an indirectly heated cathode for gas discharge tube of the fourth embodiment. With FIGS. 33 through 36, illustrations of an electrical insulating layer 4 and a metal oxide 10 are omitted for the sake of description. The fourth embodiment differs from the third embodiment in that the electrical conductor is a wire member.

As shown in FIGS. 33 through 36, an indirectly heated cathode for gas discharge tube C5 has a heater 1, a double coil 2, a wire member 21, a metal oxide 10 as a material likely to emit electrons, and a base metal 31.

Wire member 21, which is formed to a wire form, is arranged by bending a single wire member a plurality of times in a meandering manner at the outer side of double coil 2 and disposing the wire member so as to be substantially orthogonal to the discharge direction along the length direction of double coil 2. As shown in FIG. 36, this wire member 21 is disposed so as to be in electrical contact with a plurality of coil portions of double coil 2 along the length direction of double coil 2. Wire member 21 is also grounded by being connected to the ground terminal of heater 1. Double coil 2 is thereby grounded and metal oxide 10, which is the material likely to emit electrons, is set to the ground potential. The base metal is also grounded via a lead rod 7.

Figure 37:
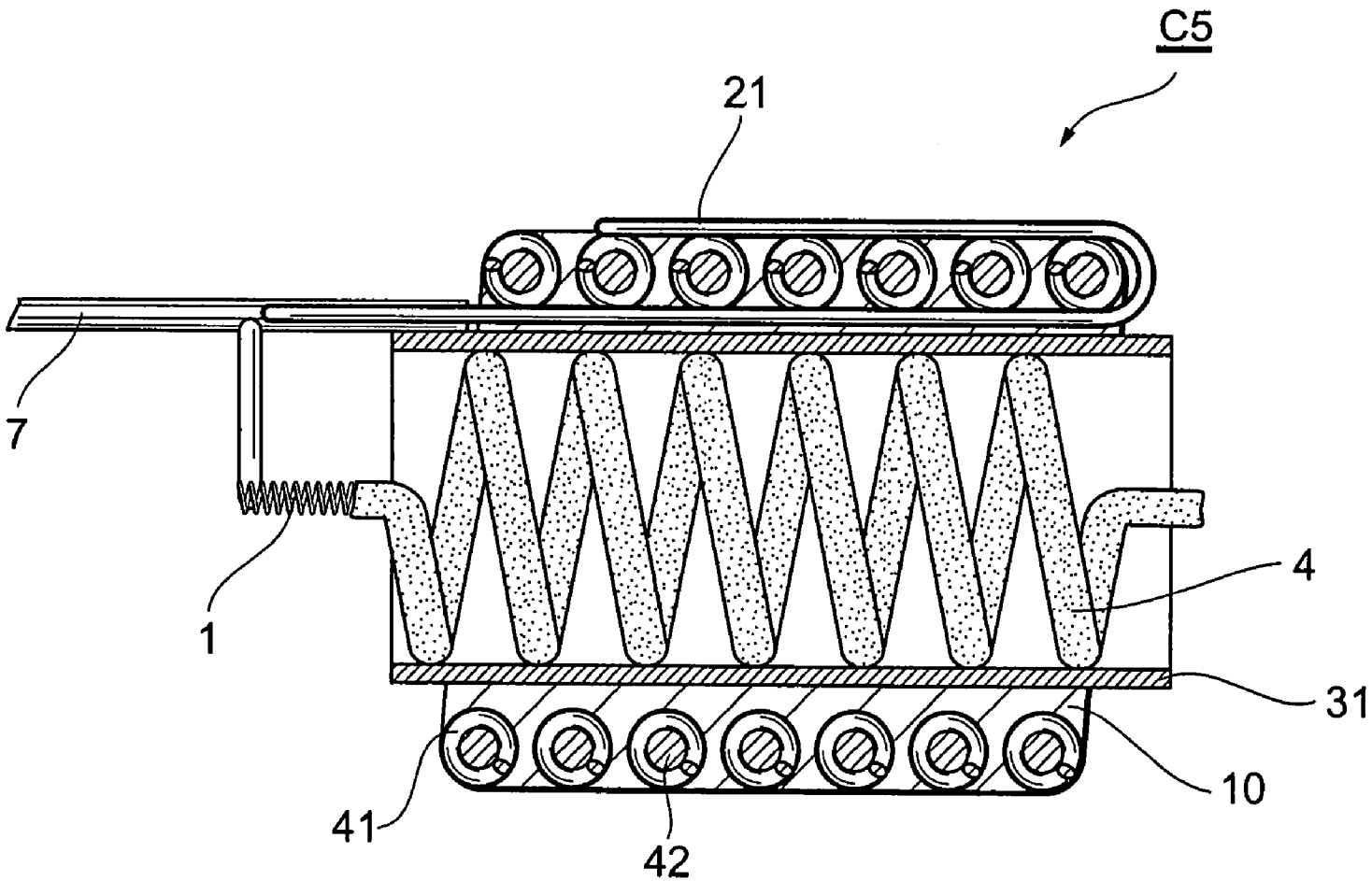
FIG. 37 is a schematic sectional view, showing a modification example of the indirectly heated cathode for gas discharge tube of the fourth embodiment.

Wire member 21 may be disposed in the same manner as in the above-described second embodiment or modification examples thereof and is not limited in number to one but may be provided in plurality of two or more. Also, in place of using double coil 2, a double coil 41, having a mandrel 42 such as that shown in FIG. 37, or a single coil may be used.

In FIGS. 34A and 35A, wire member 21 is disposed with there being a gap between double coil 2. In FIGS. 34B and 35B, wire member 21 is disposed so as to be in electrical contact with a plurality of coil portions of double coil 2 along the length direction of double coil 2.

As described above, with indirectly heated cathode for gas discharge tube C5 of the fourth embodiment, since wire member 21 is disposed in contact with metal oxide 10, an equipotential surface is formed effectively by wire member 21 being in electrical contact with double coil 2 at a plurality of locations, and thermionic emission thus occurs over a wide region of the equipotential surface that is formed, the discharge area is increased, the electron emission amount per unit area (electron emission density) is increased, and the load placed on the discharge position is lightened, thereby enabling the sputtering of metal oxide 10 and stabilization (mineralization) due to oxidation with the reduced metal, which are degradation factors, to be restrained, that is, the degradation of the thermionic emission ability to be restrained. As a result, the occurrence of localized discharge can be restrained and long service life of the cathode can be realized. Since the movement of the discharge position is also restrained, stable discharge over a long period of time can be realized.

Also, with indirectly heated cathode for gas discharge tube C5, due to the increase of the discharge area, even if the current density is slightly increased and the load is somewhat increased, that is, even if the discharge current is increased, the damage can be made less than that of the prior art. This enables the provision of an indirectly heated cathode for gas discharge tube of large discharge current with substantially the same shape as that of the prior art and the realization of pulse operation and large current operation.

Also base metal 31 is provided and can act as a heat conductor for aiding thermal decomposition when a metal carbonate is converted (thermally decomposed) to metal oxide 10 as a thermion supply source. Also, metal oxide 10 and heater 1 can be separated definitely. Furthermore, the reducing ability possessed by base metal 31 can be put to use to reduce the metal oxide 10 and produce the free metal element during operation to improve the electron emission ability. Furthermore, the heat from heater 1 can be transferred to metal oxide 10 definitely in the active state.

An example of a process for manufacturing indirectly heated cathode for gas discharge tube C5 (positioning double coil 2 and wire member 21 with respect to base metal 31) in a case where there is a single wire member 21 shall now be described based on FIGS. 38A to 38C.

Figure 38A:
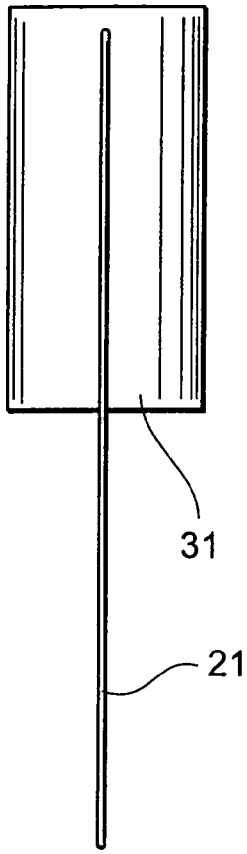
FIG. 38A is a diagram for explaining an example of the manufacturing process of the indirectly heated cathode for gas discharge tube of the fourth embodiment.
Figure 38B:
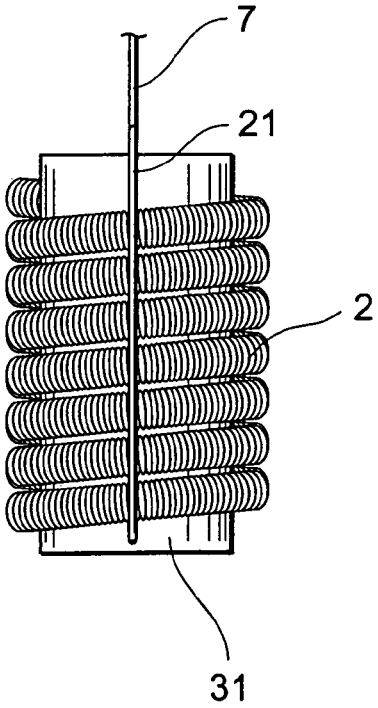
FIG. 38B is a diagram for explaining the example of the manufacturing process of the indirectly heated cathode for gas discharge tube of the fourth embodiment.
Figure 38C:
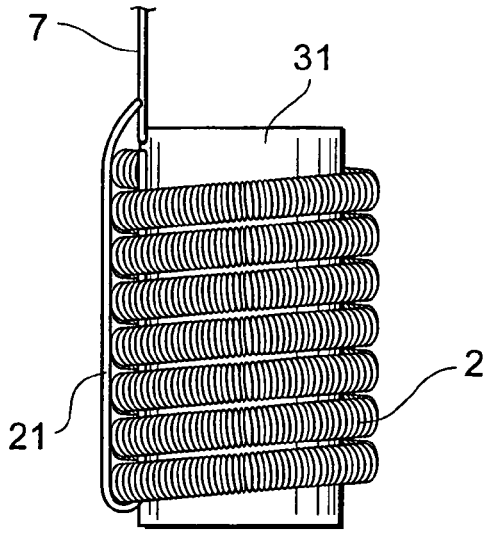
FIG. 38C is a diagram for explaining the example of the manufacturing process of the indirectly heated cathode for gas discharge tube of the fourth embodiment.

As shown in FIG. 38A, one end of wire member 21 is welded to one end part of base metal 31. Double coil 2 is then fitted onto base metal 31 from above the welded wire member 21, and wire member 21 is then bent as shown in FIGS. 38B and 38C. Double coil 2 is thereby sandwiched by the bent wire member 21 and double coil 2 is made to contact with wire member 21. The other end of the bent wire member 21 is then welded to lead rod 7. The other end of the bent wire member 21 may be welded to base metal 31 instead of lead rod 7.

FIFTH EMBODIMENT

Figure 39:
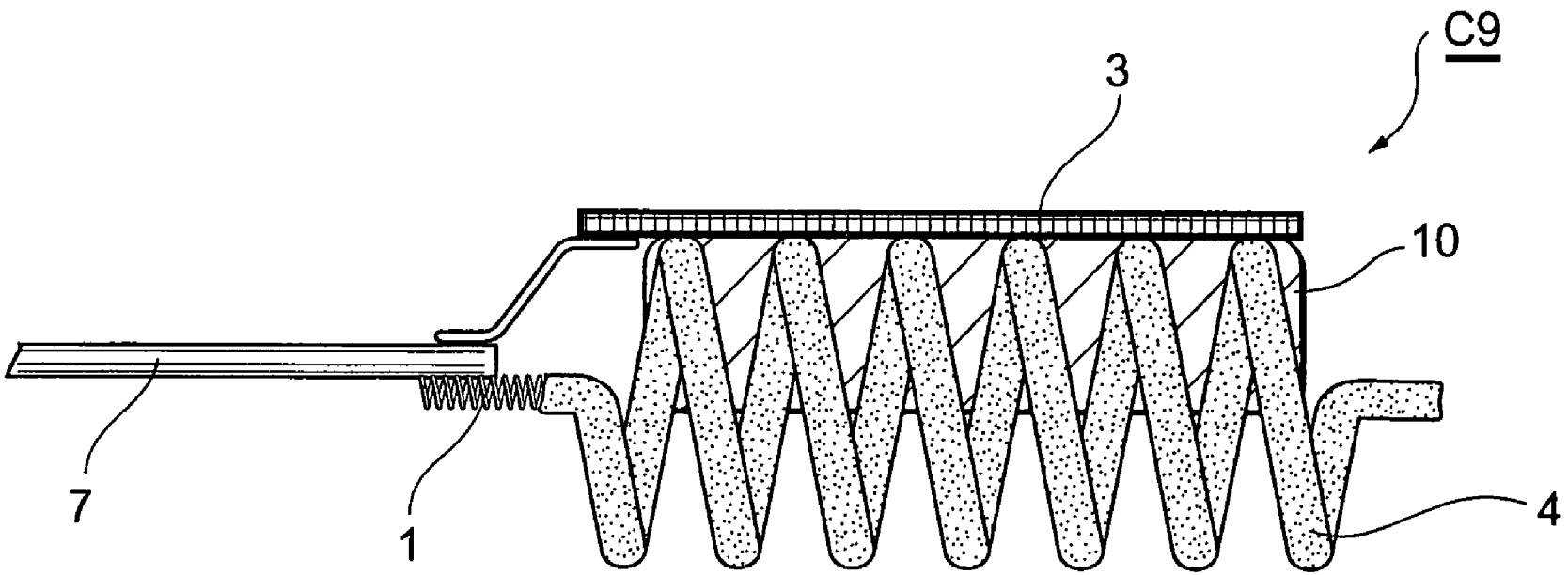
FIG. 39 is a schematic sectional view, showing an indirectly heated cathode for gas discharge tube of a fifth embodiment.

FIG. 39 is a schematic sectional view of an indirectly heated cathode for gas discharge tube of a fifth embodiment. The fifth embodiment differs from the first to fourth embodiments in not having a coil member.

As shown in FIG. 39, an indirectly heated cathode for gas discharge tube C9 has a heater 1, a mesh member 3, and a metal oxide 10 as a material likely to emit electrons. Mesh member 3 is put in a grounded state via lead rod 7. Metal oxide 10, which is the material likely to emit electrons, is thereby set to the ground potential.

Indirectly heated cathode for gas discharge tube C9 is manufactured by adhering mesh member 3 (in the grounded state) to the outer side of heater 1, coating a metal carbonate from the mesh member 3 side, and converting this metal carbonate to metal oxide 10. It is sufficient that heater 1 have an arrangement wherein an electrical insulating layer 4 is formed at the part to which mesh member 3 is adhered in order to prevent short-circuiting with mesh member 3, and the entire surface of the tungsten filament coil does not necessary have to be coated with an electrical insulating material. Mesh member 3 is disposed substantially orthogonal to the discharge direction, that is, along the length direction of heater 1.

As described above, with indirectly heated cathode for gas discharge tube C9 of the fifth embodiment, since mesh member 3 is put in contact with metal oxide 10, an equipotential surface is formed effectively by mesh member 3 in contact with metal oxide 10, and thermionic emission thus occurs over a wide region of the equipotential surface that is formed, the discharge area is increased, the electron emission amount per unit area (electron emission density) is increased, and the load placed on the discharge position is lightened, thereby enabling the sputtering of metal oxide 10 and stabilization (mineralization) due to oxidation with the reduced metal, which are degradation factors, to be restrained, that is, the degradation of the thermionic emission ability to be restrained. As a result, the occurrence of localized discharge can be restrained and long service life of the cathode can be realized. Since the movement of the discharge position is also restrained, stable discharge over a long period of time can be realized.

Also, with indirectly heated cathode for gas discharge tube C9, due to the increase of the discharge area, even if the current density is slightly increased and the load is somewhat increased, that is, even if the discharge current is increased, the damage can be made less than that of the prior art. This enables the provision of an indirectly heated cathode for gas discharge tube of large discharge current with substantially the same shape as that of the prior art and the realization of pulse operation and large current operation.

Mesh member 3 may be folded or laminated and thereby be made thick to increase the amount of metal oxide 10 held and improve the holding performance.

SIXTH EMBODIMENT

Figure 40:
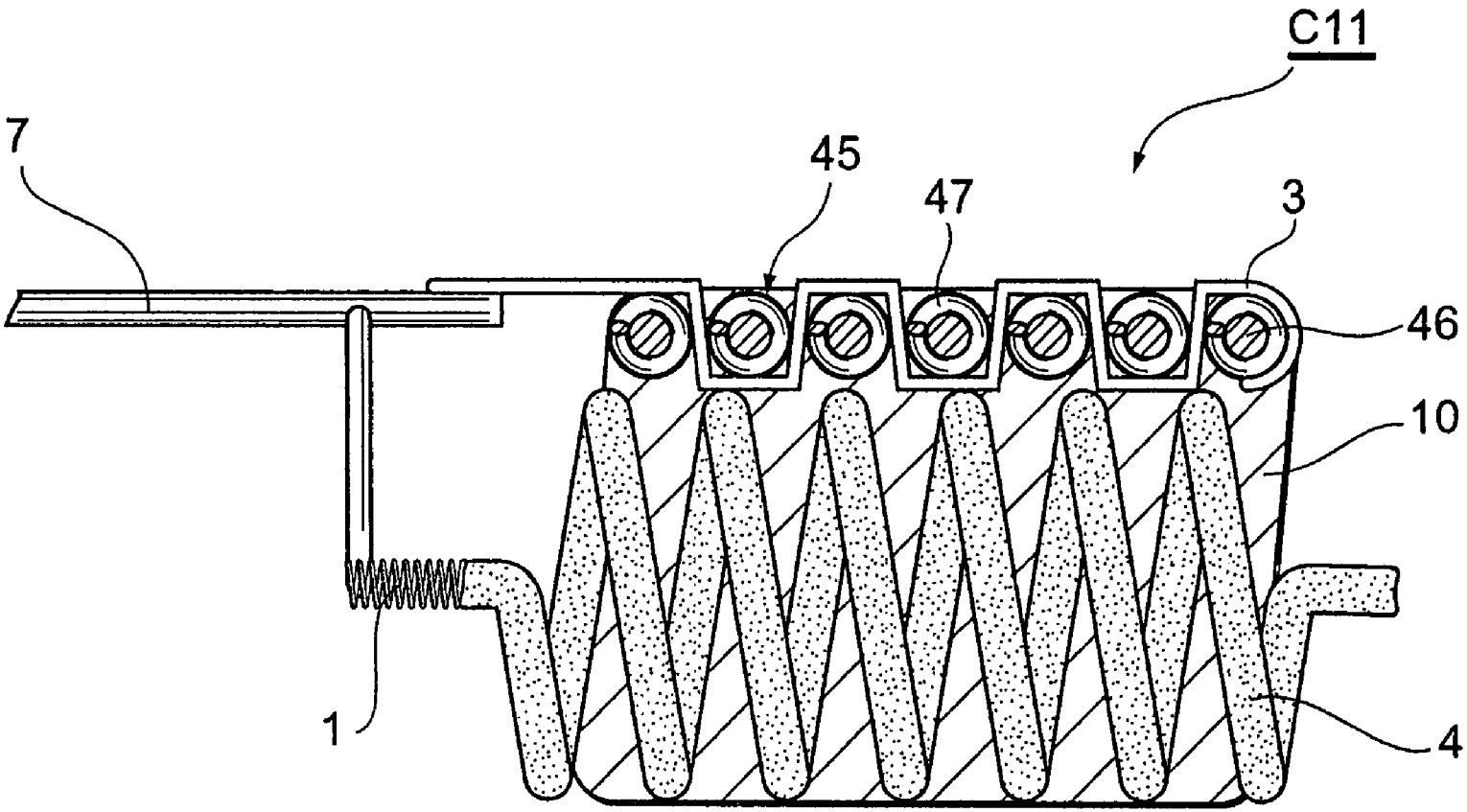
FIG. 40 is a schematic sectional view, showing a modification example of an indirectly heated cathode for gas discharge tube of a sixth embodiment.

FIG. 40 is a schematic sectional view of an indirectly heated cathode for gas discharge tube of a sixth embodiment. The sixth embodiment differs from the fifth embodiment in having a conductive wire.

As shown in FIG. 40, an indirectly heated cathode for gas discharge tube C11 has a heater 1, a mesh member 3, a metal oxide 10 as a material likely to emit electrons, and a conductive wire 45. Mesh member 3 is put in a grounded state via lead rod 7. Conductive wire 45 is thereby grounded and metal oxide 10, which is the material likely to emit electrons, is set to the ground potential. Mesh member 3 is disposed along the length direction of heater 1 at the outer side of heater 1 and extends in a waving manner along this length direction.

Conductive wire 45 comprises a mandrel (core wire) 46 and a filament (for example, a tungsten element wire) 47, which is wound around the outer periphery of mandrel 46, and has the same arrangement as double coil 41. Conductive wire 45 has a shape that spans a depressed part at one side of mesh member 3 in one direction along the width direction of mesh member 3 and spans a depressed part at the other side of mesh member 3 in the reverse direction along the width direction of mesh member 3.

As described above, with indirectly heated cathode for gas discharge tube C11 of the sixth embodiment, since mesh member 3 is put in contact with metal oxide 10, an equipotential surface is formed effectively by mesh member 3 in contact with metal oxide 10, and thermionic emission thus occurs over a wide region of the equipotential surface that is formed, the discharge area is increased, the electron emission amount per unit area (electron emission density) is increased, and the load placed on the discharge position is lightened, thereby enabling the sputtering of metal oxide 10 and stabilization (mineralization) due to oxidation with the reduced metal, which are degradation factors, to be restrained, that is, the degradation of the thermionic emission ability to be restrained. As a result, the occurrence of localized discharge can be restrained and long service life of the cathode can be realized. Since the movement of the discharge position is also restrained, stable discharge over a long period of time can be realized.

Also, with indirectly heated cathode for gas discharge tube C11, due to the increase of the discharge area, even if the current density is slightly increased and the load is somewhat increased, that is, even if the discharge current is increased, the damage can be made less than that of the prior art. This enables the provision of an indirectly heated cathode for gas discharge tube of large discharge current with substantially the same shape as that of the prior art and the realization of pulse operation and large current operation.

Also, with indirectly heated cathode for gas discharge tube C11, since conductive wire 45 has mandrel 46, the additional effect that the deformation of conductive wire 45 during processing can be restrained is provided.

SEVENTH EMBODIMENT

Figure 41:
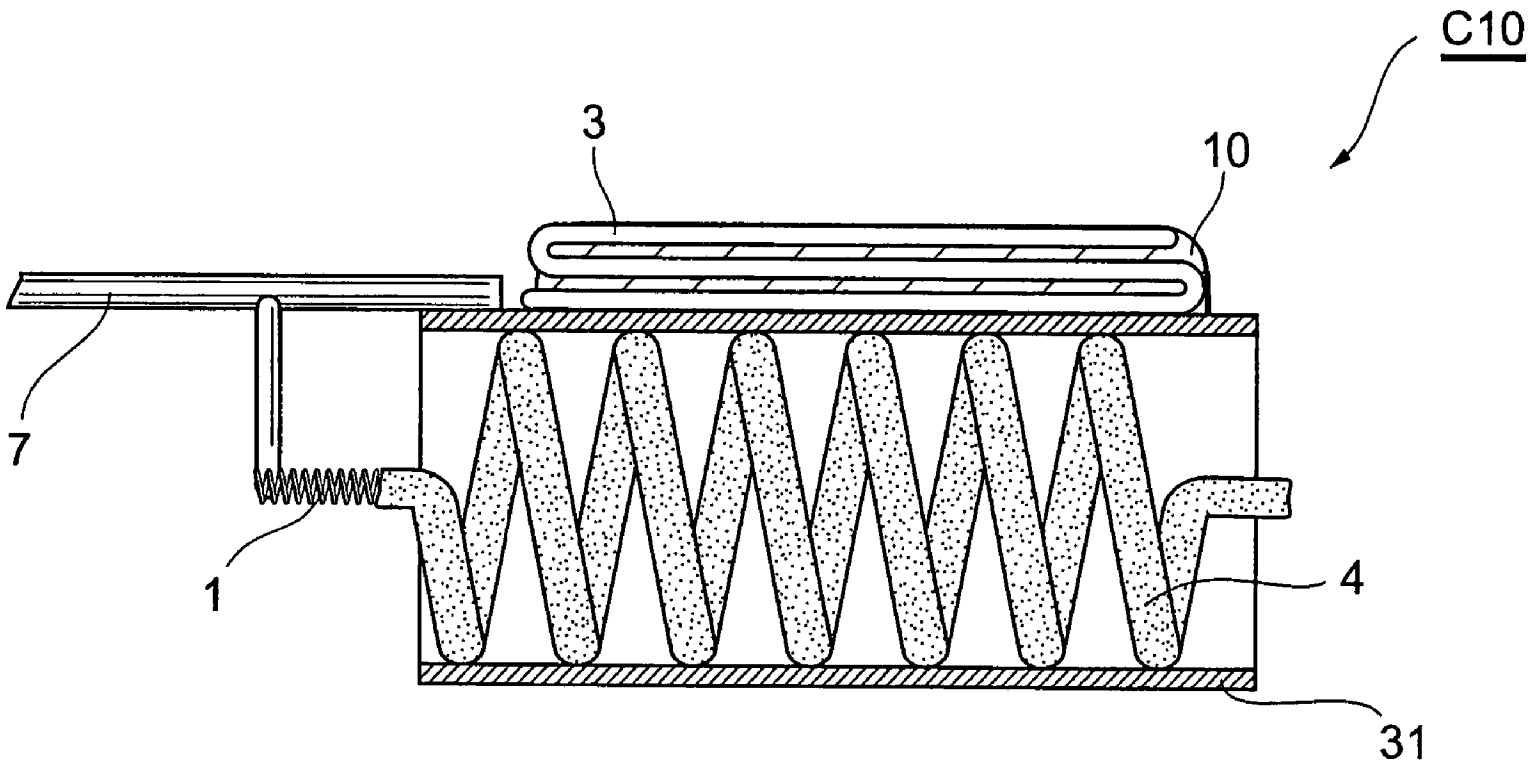
FIG. 41 is a schematic sectional view, showing an indirectly heated cathode for gas discharge tube of a seventh embodiment.

FIG. 41 is a schematic sectional view of an indirectly heated cathode for gas discharge tube of a seventh embodiment. As with the fifth and sixth embodiments, the seventh embodiment differs from the first to fourth embodiments in not having a coil member.

As shown in FIG. 41, an indirectly heated cathode for gas discharge tube C10 has a heater 1, a mesh member 3 (electrical conductor), a metal oxide 10 as a material likely to emit electrons, and a base metal 31. Mesh member 3 is put in a folded and laminated state and then set and fixed on the outer surface of base metal 31. Metal oxide 10 is held by the laminated mesh member 3. Base metal 31 is put in a grounded state by being connected to lead rod 7. Mesh member 3 is also put in the grounded state via base metal 31. Metal oxide 10, which is the material likely to emit electrons, is thereby set to the ground potential.

Indirectly heated cathode for gas discharge tube C10 is manufactured by fixing mesh member 3, in the grounded state, to the outer side of base metal 31, coating a metal carbonate from the mesh member 3 side, and converting this metal carbonate to metal oxide 10.

As described above, with indirectly heated cathode for gas discharge tube C10 of the seventh embodiment, since mesh member 3 is put in contact with metal oxide 10, an equipotential surface is formed effectively by mesh member 3 in contact with metal oxide 10, and thermionic emission thus occurs over a wide region of the equipotential surface that is formed, the discharge area is increased, the electron emission amount per unit area (electron emission density) is increased, and the load placed on the discharge position is lightened, thereby enabling the sputtering of metal oxide 10 and stabilization (mineralization) due to oxidation with the reduced metal, which are degradation factors, to be restrained, that is, the degradation of the thermionic emission ability to be restrained. As a result, the occurrence of localized discharge can be restrained and long service life of the cathode can be realized. Since the movement of the discharge position is also restrained, stable discharge over a long period of time can be realized.

Also, with indirectly heated cathode for gas discharge tube C10, due to the increase of the discharge area, even if the current density is slightly increased and the load is somewhat increased, that is, even if the discharge current is increased, the damage can be made less than that of the prior art. This enables the provision of an indirectly heated cathode for gas discharge tube of large discharge current with substantially the same shape as that of the prior art and the realization of pulse operation and large current operation.

Also, with indirectly heated cathode for gas discharge tube C10, since mesh member 3 is folded and laminated, the amount of metal oxide 10 held can be increased and the holding performance can be improved.

EIGHTH EMBODIMENT

Figure 42:
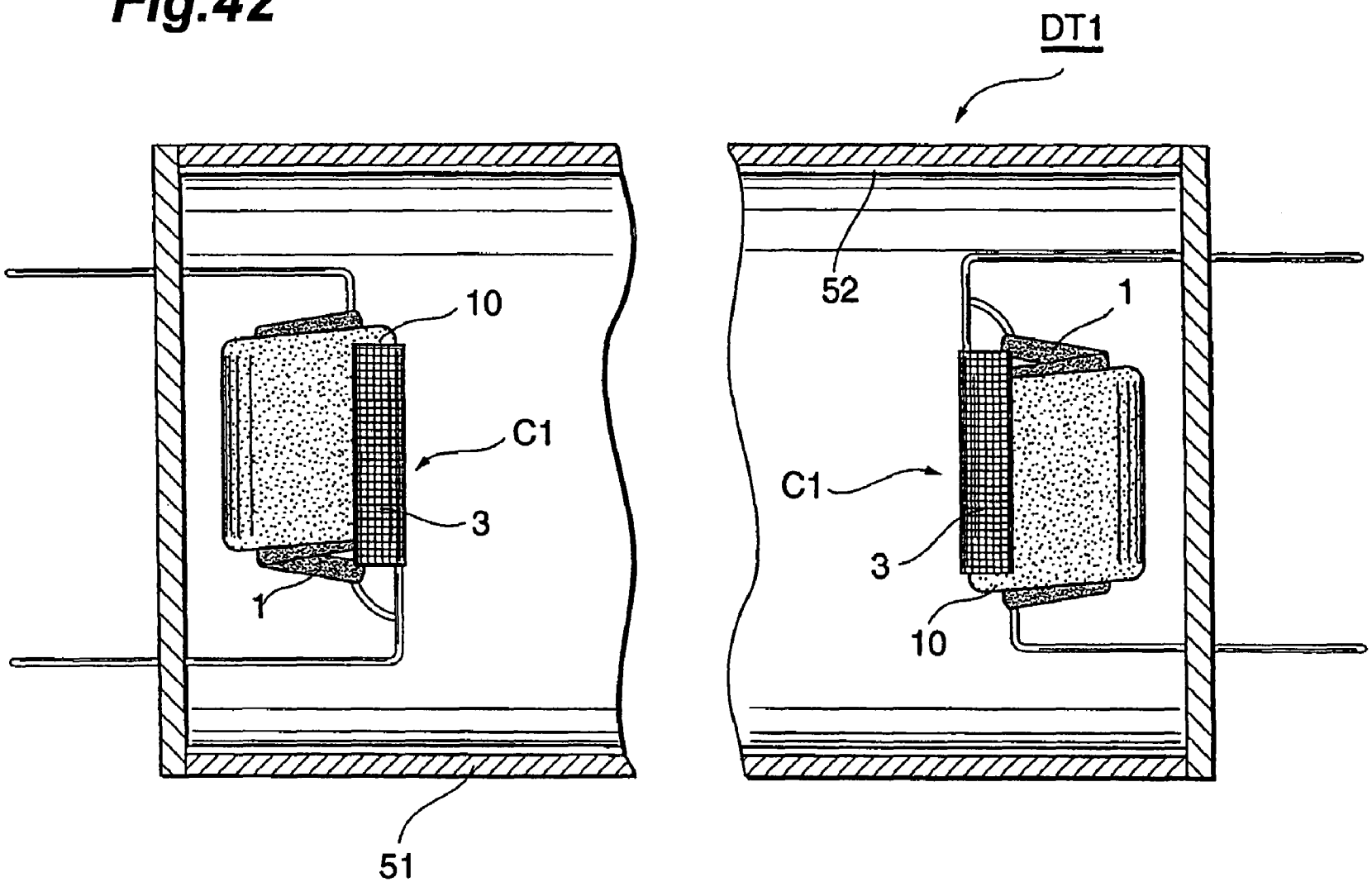
FIG. 42 is a schematic sectional view, showing an eighth embodiment's gas discharge tube using an indirectly heated cathode for gas discharge tube.

Next, a gas discharge tube of an eighth embodiment, which uses any of the indirectly heated cathodes for gas discharge tube C1 to C11 of the above-described arrangements, shall be described based on FIG. 42. FIG. 42 is a schematic sectional view of a gas discharge tube of the eighth embodiment. Though an example, wherein indirectly heated cathode for gas discharge tube C1 of the first embodiment is used as the indirectly heated cathode for gas discharge tube, shall be described with this eighth embodiment, any of the indirectly heated cathodes for gas discharge tube C2 to C11 may be used in place of indirectly heated cathode for gas discharge tube C1.

A gas discharge tube DT1 has a tubular bulb 51 as a sealed container, and a fluorescent film 52 is formed on the inner surface of this tubular bulb 51. Indirectly heated cathodes for gas discharge tube C1 are sealed in an airtight manner at both ends of the interior of tubular bulb 51 in a state where the equipotential surfaces, that is, electrical conductors 3 face each other. By making the equipotential surfaces face each other, the operation of gas discharge tube DT1 is made more stable. Argon or other rare gas, or argon or other rare gas and mercury is or are sealed in the interior of tubular bulb 51.

Figure 43:
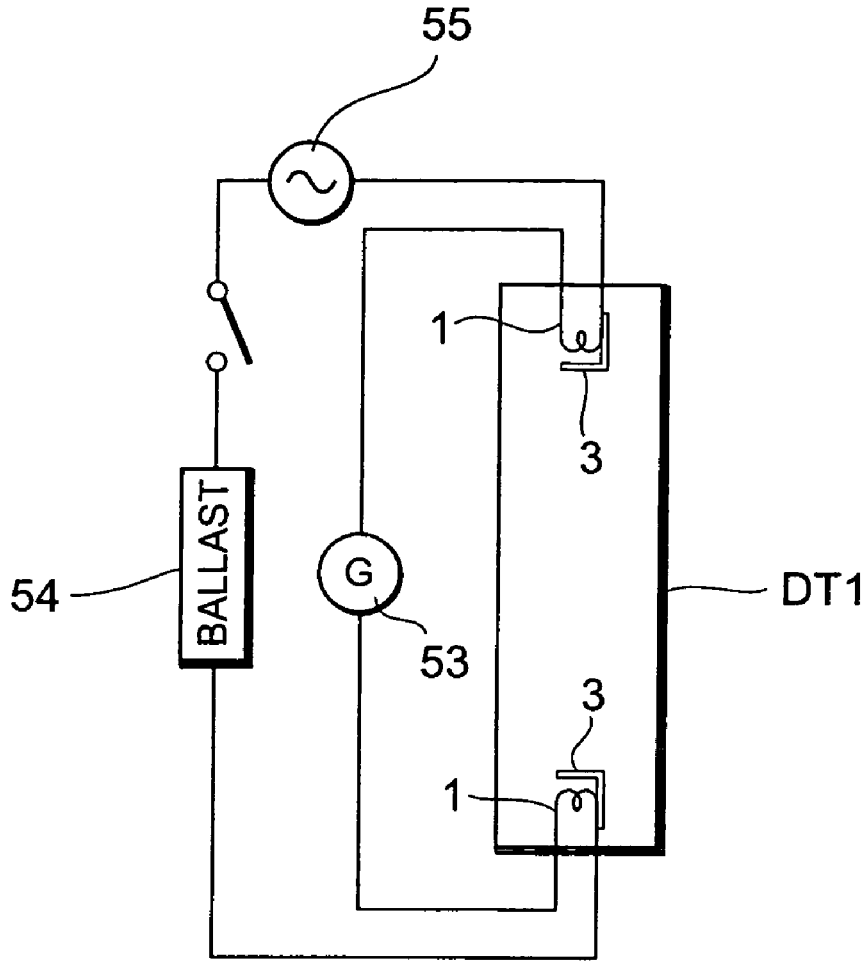
FIG. 43 is a circuit diagram, showing a lighting circuit of the eighth embodiment's gas discharge tube using an indirectly heated cathode for gas discharge tube.

As a lighting circuit for gas discharge tube DT1, a known, starter (preheating starting) type lighting circuit, having a glow tube 53, a ballast 54, and AC power supply 55 as shown in FIG. 43, may be used. In place of a starter type, a rapid start type lighting circuit may also be used as the lighting circuit. As the driving method, a type specialized to high-frequency lighting (Hf) may also be used. In gas discharge tube DT1, when one of the indirectly heated cathodes for gas discharge tube C1 is operating as a cathode, the other indirectly heated cathode for gas discharge tube C1 operates as an anode.

Thus with gas discharge tube DT1 of the eighth embodiment, by use of any of indirectly heated cathodes for gas discharge tube C1 to C11, a gas discharge tube (rare gas fluorescent lamp or mercury fluorescent lamp) of long service life and stable operation can be realized.

Though when an AC power supply is used as the power supply, the indirectly heated cathode for gas discharge tube C1 to C11 will undergo a cathode cycle and an anode cycle repeatedly, in the cathode cycle, sputtering of metal oxide 10 due to excessive ion current flow can be prevented by the increase of the discharge area. Also in the anode cycle, mesh member 3 serves the role of an electron focusing part and since the electron receiving area is large, excessive temperature rise can be prevented and vaporization of metal oxide 10 can be restrained.

Figure 44:
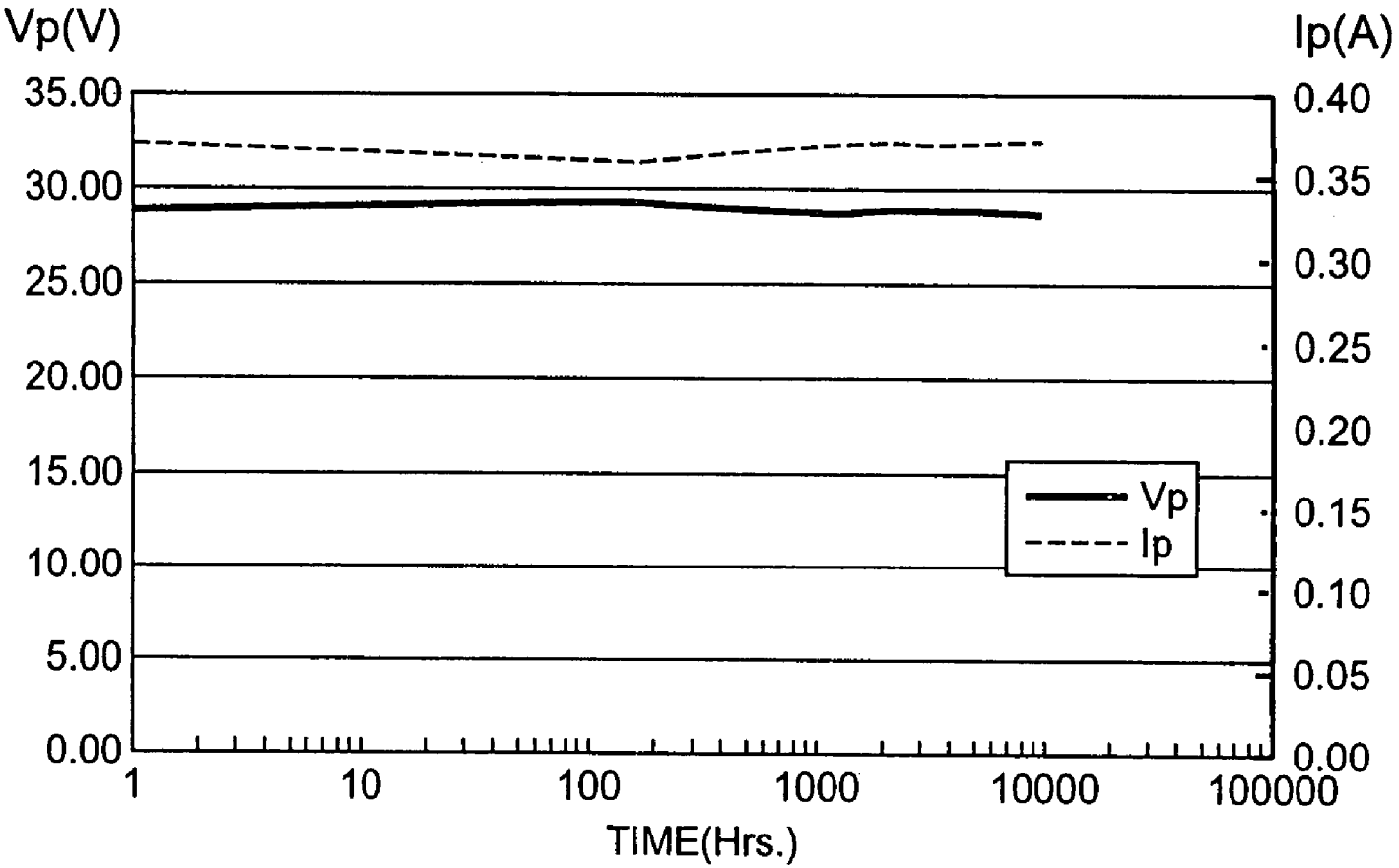
FIG. 44 is a graph concerning the variations with time of the lamp tube voltage and the lamp tube current of a gas discharge tube by the present invention.

With the present invention's gas discharge tube, a test was conducted to confirm the long service life and stable operation effects that are provided by the use of any of the indirectly heated cathodes for gas discharge tube C1 to C11 of the above-described arrangements. The results are shown in FIG. 44. FIG. 44 shows the variations with time of the lamp tube voltage (Vp) and the lamp tube current (Ip) For this test, a gas discharge tube DT1, with which indirectly heated cathodes for gas discharge tube C2, shown in FIG. 25, are made to face each other and sealed in an airtight manner at both ends of the interior of a tubular valve, was manufactured, and the variations with time of the lamp tube voltage (Vp) and the lamp tube current (Ip) were measured while lighting continuously with a lighting circuit of the arrangement shown in FIG. 43. The inner diameter of the tubular bulb is 28 mm, the gap between indirectly heated cathodes for gas discharge tube C2 is 175 mm, and argon is sealed at 470 Pa in the tubular bulb. A commercially available 15 W ballast was used as the ballast of the lighting circuit.

With each indirectly heated cathode for gas discharge tube C2, a filament coil, formed by doubly winding a tungsten element wire of 0.55 diameter, was used for the heater. The double coil was made by winding a tungsten element wire of 0.091 mm diameter around a molybdenum mandrel (0.25 mm diameter) at a pitch of 0.15 mm to prepare a primary coil and winding this primary coil six times at a diameter of 1.7 mm and a pitch of 0.51 mm. A tungsten element wire of 0.10 mm diameter was used as the wire member and this was formed to a hairpin shape with a gap of approximately 1 mm.

As can be understood from FIG. 44, stable values are exhibited over a long period of time (approximately 10000 hours) for the lamp tube voltage (Vp) and lamp tube current (Ip), demonstrating that the gas discharge tube by the present invention is long in service life and stable in operation.

Figure 45:
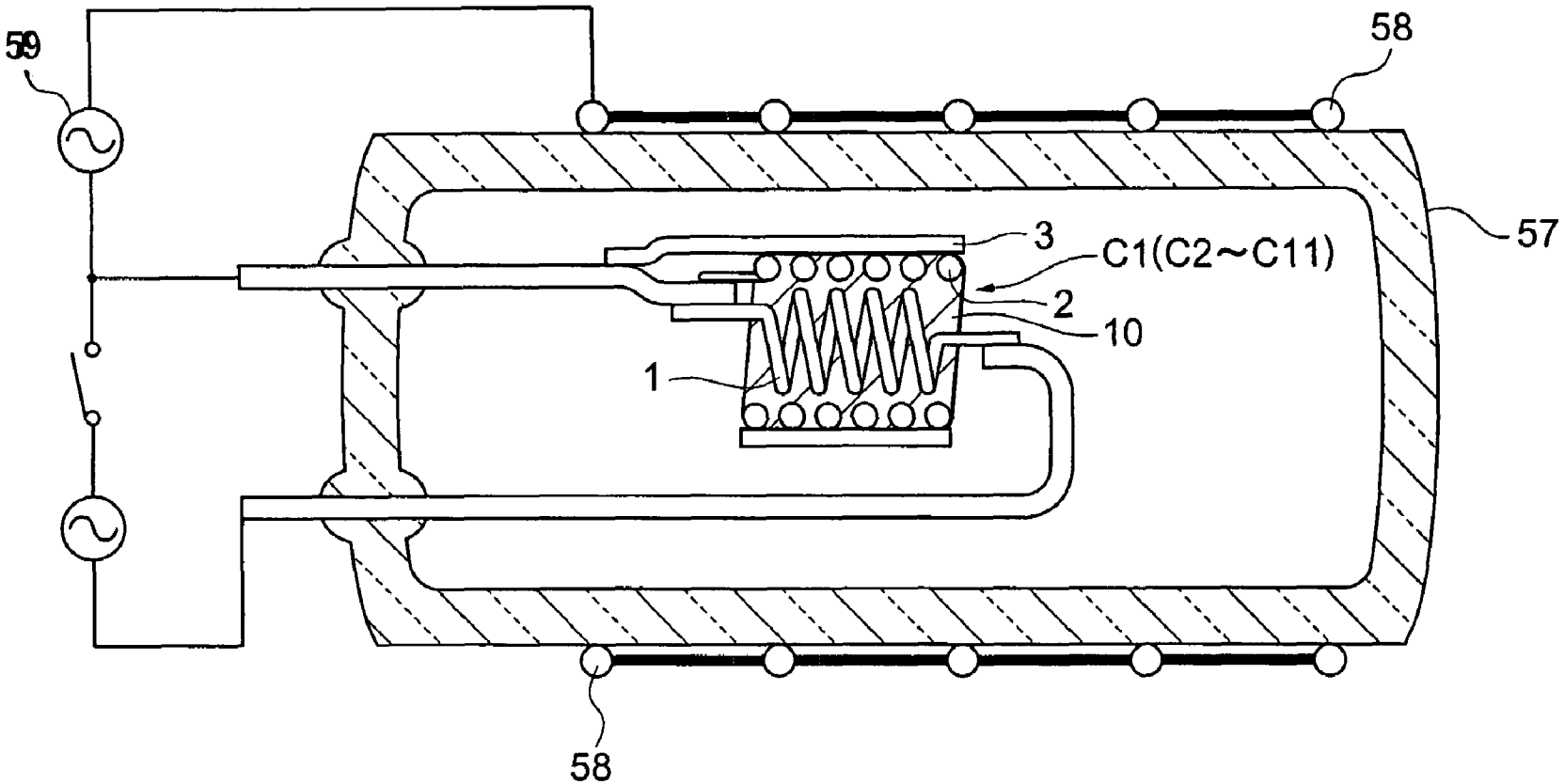
FIG. 45 is an arrangement diagram, showing a modification example (lamp with one outer electrode) of the eighth embodiment's gas discharge tube using an indirectly heated cathode for gas discharge tube.

Also, to make use of the characteristic of the dispersion of discharge, the present invention's indirectly heated cathode for gas discharge tube may be employed in a lamp with one outer electrode, which has an electrode 58 at the exterior of a container 57, has any of indirectly heated cathodes for gas discharge tube C1 to C11 disposed inside container 57, has a rare gas sealed inside container 57, and is driven using a high-frequency power supply 59 as shown in FIG. 45.

This type of lamp is an excimer lamp, which is an excimer light emitting lamp. For emission of excimer light using xenon gas as the sealed gas, the gas pressure is set in the range of 2000 Pa (10 Torr) to 100000 Pa (1 atm) and preferably in the range of 10000 Pa (75 Torr) to 50000 Pa (375 Torr).

In a case where a double coil having a mandrel is used as the coil member and an AC power supply is used as the power supply, the discharge is maintained by the balance of the heat amount on the surface of the mandrel. Due to the discharge on the surface of the mandrel, the amount of heat generated on the surface of the electrode is proportional to the discharge current (Id, unit: ampere) Also, as the cross-sectional area (Sm, unit: mm square) of the mandrel increases, the surface area increases and thus the amount of heat loss increases. From the above, the electrode surface temperature (Tc) is in the following relationship:

$$Tc \propto Id/Sm \tag{12}$$

If the electrode surface temperature is lower than the allowable range, it will be inadequate in terms of the cathode operating temperature. Thus in order to sustain the discharge, the temperature is raised locally to supply thermions, thus causing concentration of discharge. The resulting localized overheating enhances the sputter phenomenon of the material likely to emit electrons and accelerates the degradation of the electrode. On the other hand, if the electrode surface temperature is higher than the allowable range, the entire electrode surface is put in an overheated state, thereby enhancing vaporization of the material likely to emit electrons and accelerating the degradation of the electrode.

Upon conducting experiments with indirectly heated electrodes for gas discharge tube of the arrangement shown in FIG. 25, the present inventors found that the following range is preferable for maintaining the electrode surface temperature within an appropriate range:

$$3 < Id/Sm < 16 \tag{13}$$

Also, the present inventors found the following range to be even more preferable:

$$4 < Id/Sm < 10 \tag{14}$$

In the experiments, tungsten element wires of 0.05 mm to 0.20 mm were used as wire members 21 and these tungsten element wires were formed into hairpin forms with gaps of 0.5 mm to 2 mm.

NINTH EMBODIMENT

Figure 46:
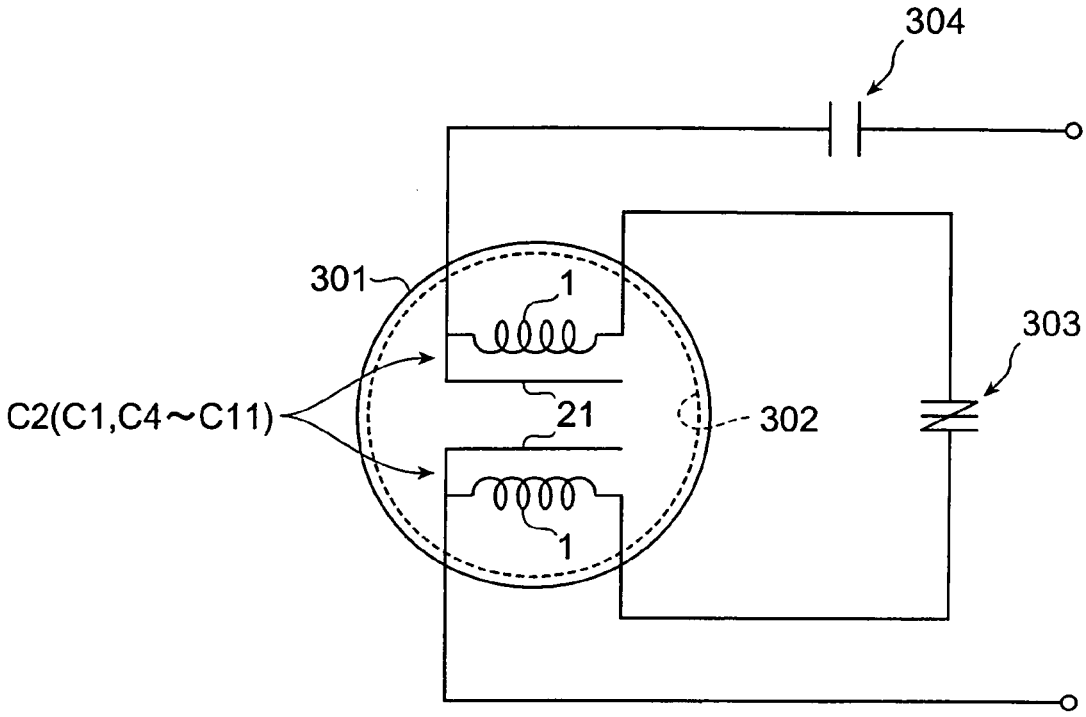
FIG. 46 is a schematic arrangement diagram of a gas discharge tube of a ninth embodiment.

Next, a gas discharge tube of an in the embodiment, which uses any of the indirectly heated cathodes for gas discharge tube C1 to C11 of the above-described arrangements, shall be described based on FIG. 46. FIG. 46 is a schematic arrangement diagram of a gas discharge tube of the ninth embodiment. Though an example, wherein indirectly heated cathode for gas discharge tube C2 of the second embodiment is used as the indirectly heated cathode for gas discharge tube, shall be described with this ninth embodiment, any of the indirectly heated cathodes for gas discharge tube C1 and C4 to C11 may be used in place of indirectly heated cathode for gas discharge tube C2.

The gas discharge tube shown in FIG. 46 has a spherical bulb 301 as a sealed container, and a fluorescent film 302 is formed on the inner surface of this spherical bulb 301. A pair of indirectly heated cathodes for gas discharge tube C2 are sealed in an airtight manner in the interior of spherical bulb 301 in a state where the discharge surfaces face each other. A single rare gas, such as xenon, argon, krypton, neon, etc. or a mixed gas is sealed in the interior of spherical bulb 301. Also, mercury may be sealed inside along with argon or other rare gas.

With each indirectly heated cathode for gas discharge tube C2, a filament coil, formed by doubly winding a tungsten element wire, was used for heater 1. The double coil was made by winding a tungsten element wire of 0.091 mm diameter around a molybdenum mandrel (0.25 mm diameter) at a pitch of 0.218 mm to prepare a primary coil of 0.433 mm of outer circumferential diameter and winding this primary coil six times at a diameter of 1.7 mm and a pitch of 0.51 mm. A tungsten element wire of 0.10 mm diameter was used as wire member 21.

For the sealed gas, mercury was added to argon at a pressure of 470 Pa. The gap between indirectly heated cathodes for gas discharge tube C2 is preferably set to 10 mm or less so that the discharge voltage will be 20V or less. A plurality of pairs of indirectly heated cathodes for gas discharge tube C2 may be disposed inside spherical bulb 301. In consideration of the light emission efficiency in a case where there is a fluorescent material, the inner diameter of spherical bulb 301 is preferably in the range of 20 mm to 60 mm.

Figure 47:
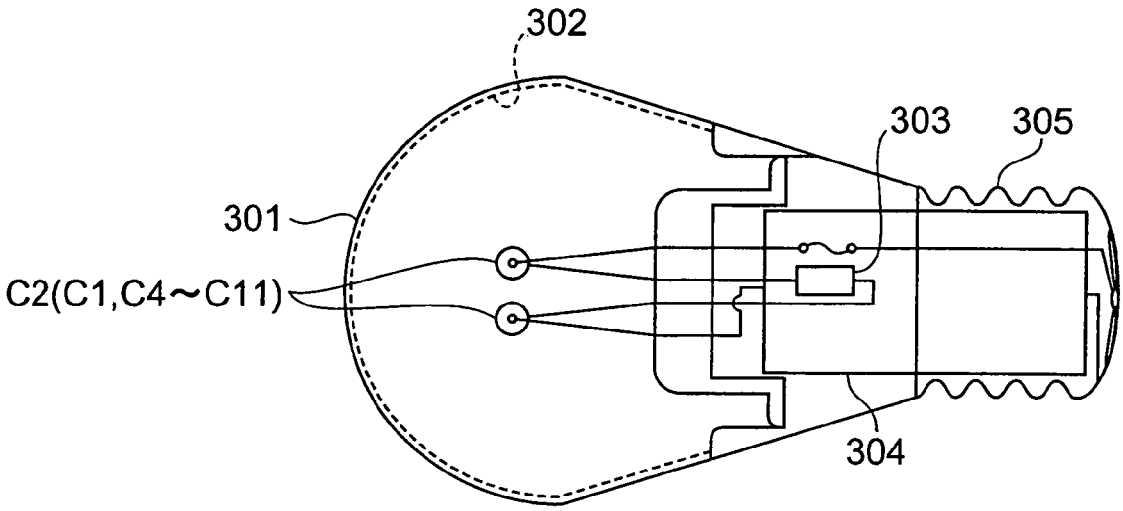
FIG. 47 is a schematic arrangement diagram of the gas discharge tube of the ninth embodiment.

As a lighting circuit, as shown in FIG. 46, a circuit, with which a two-terminal, bidirectional thyristor 303 is connected serially between the heaters 1 of indirectly heated cathodes for gas discharge tube C2 and a capacitor 304 is serially connected between an end part of one heater 1 and a power inlet end, is used. The lighting circuit may also be provided with a protective function circuit, which cuts off the supply of power when the lighting operation is not to be performed. In a case where the gas discharge tube has a single-base structure as shown in FIG. 47, the lighting circuit (two-terminal, bidirectional thyristor 303 and capacitor 304) can be disposed inside base 305, providing a structure similar to an incandescent bulb and the gas discharge tube may be used in place of an incandescent bulb. With the gas discharge tube shown in FIG. 46, when one of the indirectly heated cathodes for gas discharge tube C2 is operating as a cathode, the other indirectly heated cathode for gas discharge tube C2 operates as an anode.

Thus with the gas discharge tube of the ninth embodiment, by use of any of indirectly heated cathodes for gas discharge tube C1 to C11, a gas discharge tube (rare gas fluorescent lamp or mercury fluorescent lamp) of long service life and stable operation can be realized. In particular, an arrangement suitable for a gas discharge tube, with which a negative glow discharge due to AC discharge across a pair of electrodes is to be mainly performed, can be provided.

With each of the gas discharge tubes of the eighth and ninth embodiments, in the case of AC operation, each of the pair of electrodes (indirectly heated cathodes for gas discharge tube C1 to C11) alternatingly serves, as the main functions, the role of a cathode that emits electrons and an anode into which electrons flow. When functioning as an anode, a large amount of heat is generated at an electrode due to the voltage drop that occurs when the electrons flow in. By using the heat amount, which is generated when an electrode functions as the anode, as the heat amount necessary for thermionic emission when the electrode functions as the cathode, stable, sustained discharge can be realized without the supply of heat from heater 1 or with a lower supply of heat in comparison to DC operation during sustained discharge of the gas discharge tube.

TENTH EMBODIMENT

Figure 48:
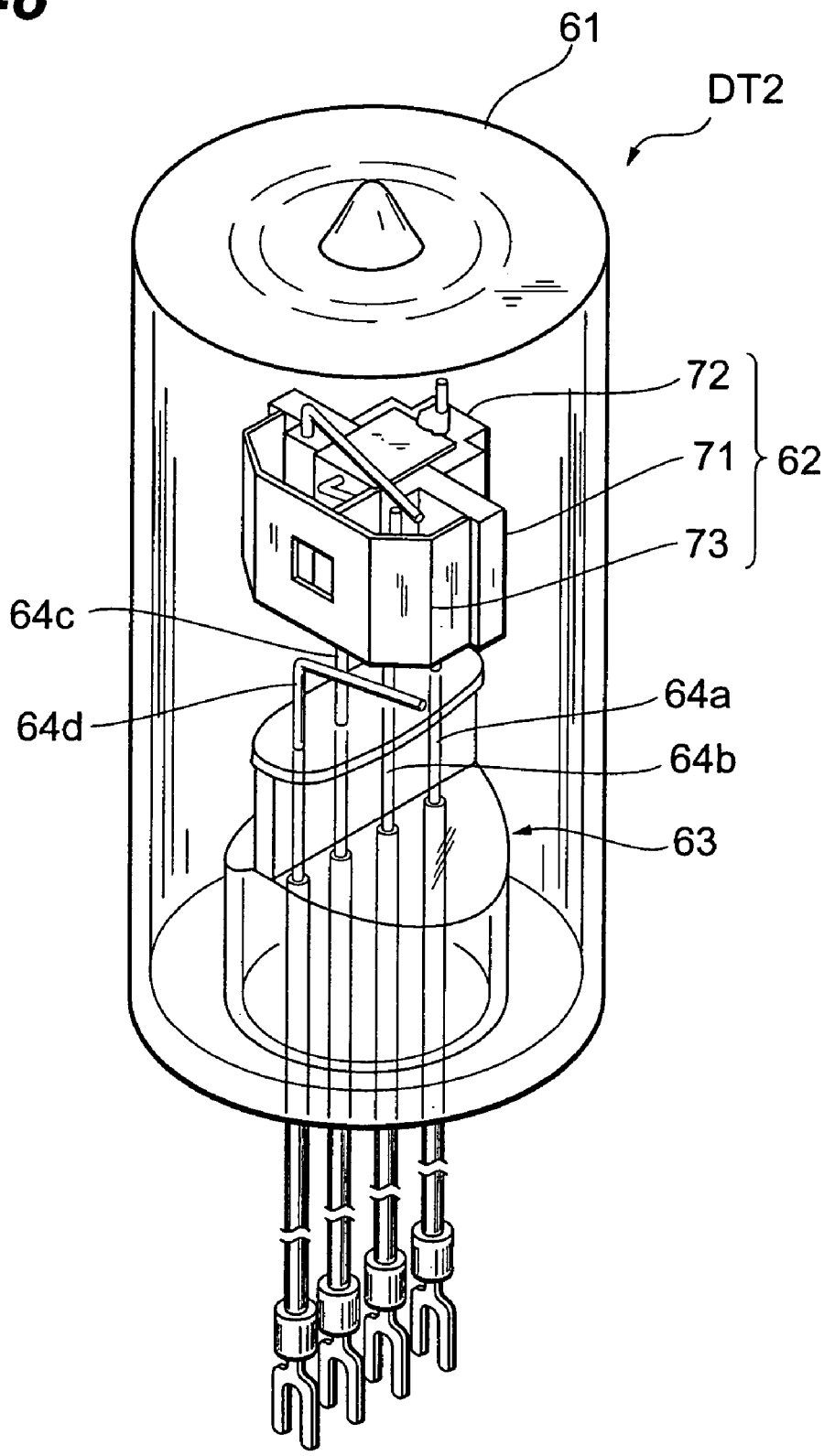
FIG. 48 is an overall perspective view, showing a tenth embodiment's gas discharge tube using an indirectly heated cathode for gas discharge tube.
Figure 49:
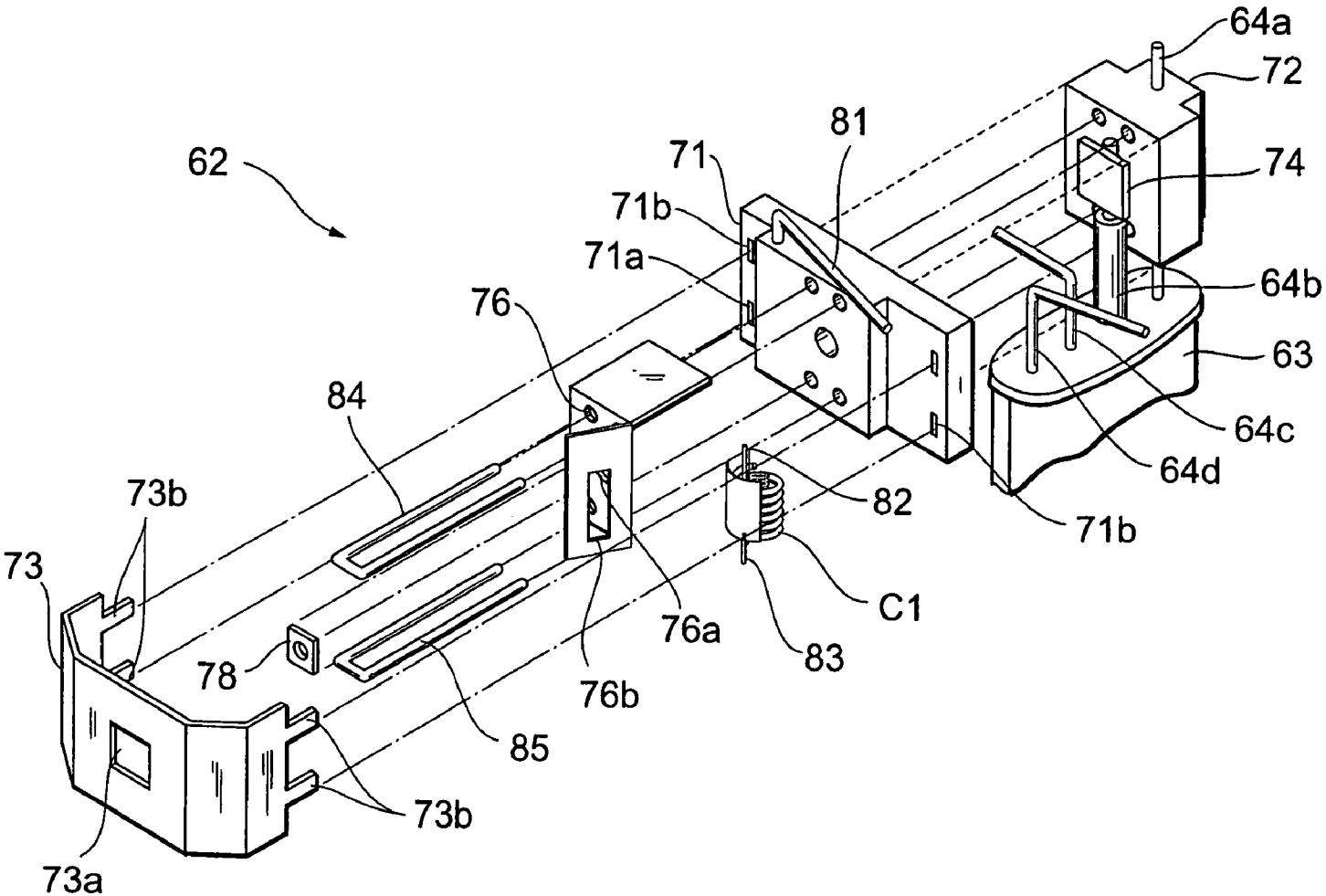
FIG. 49 is an exploded perspective view of the light emitting part of the tenth embodiment's gas discharge tube using an indirectly heated cathode for gas discharge tube.
Figure 50:
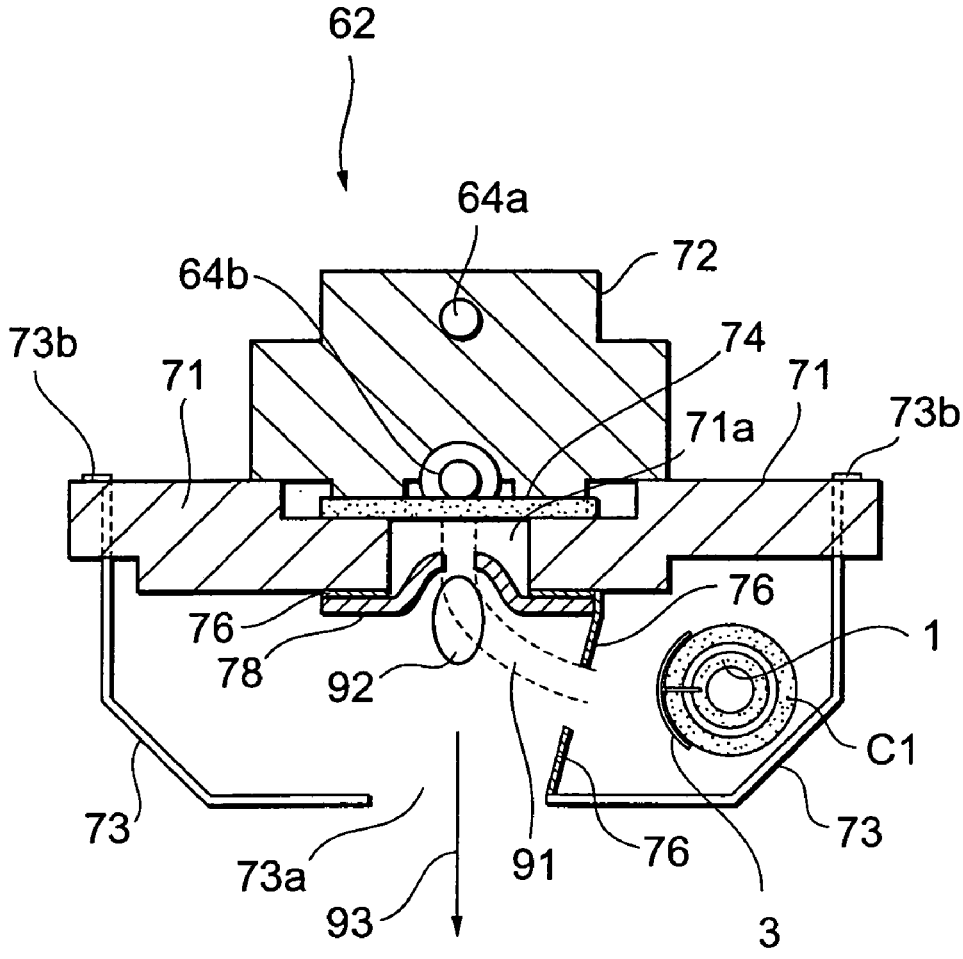
FIG. 50 is a transverse sectional view of the light emitting part of the tenth embodiment's gas discharge tube using an indirectly heated cathode for gas discharge tube.

Next, a gas discharge tube of a tenth embodiment, which uses any of the indirectly heated cathodes for gas discharge tube C1 to C11 of the above-described arrangements, shall be described based on FIGS. 48 to 50. FIG. 48 is an overall perspective view of a gas discharge tube of the tenth embodiment, FIG. 49 is an exploded perspective view of the light emitting part of the gas discharge tube, and FIG. 50 is a transverse sectional view of the light emitting part. With the tenth embodiment, the present invention is applied to a side-on type deuterium gas discharge tube. Though an example, wherein indirectly heated cathode for gas discharge tube C1 of the first embodiment is used as the indirectly heated cathode for gas discharge tube, shall be described with this tenth embodiment, any of the indirectly heated cathodes for gas discharge tube C2 to C11 may be used in place of indirectly heated cathode for gas discharge tube C1.

A deuterium gas discharge tube DT2 has a glass outer container 61. As shown in FIG. 48, a light emitting part assembly 62 is housed inside outer container 61 and the bottom part of outer container 61 is sealed in an airtight manner by a glass stem 63. Four lead pins 64*a* to 64*d* extend from the lower part of light emitting part assembly 62 and are exposed to the exterior upon passing through stem 63. Light emitting part assembly 62 has a shielding box structure, formed by adhering together a discharge shielding plate (discharge shielding part) 71 and a supporting plate 72, both made of alumina, and a metal front cover 73, which is mounted to the front face of discharge shielding plate 71.

As shown in FIG. 49, a through hole is formed in the vertical direction at the rear part of supporting plate 72, having a protruding cross-sectional shape, and lead pin 64*a* is inserted through this through hole and held by stem 63. An indented groove, which extends vertically downwards, is formed on the front face of supporting plate 72, and lead pin 64*b*, which extends from stem 63, is set inside this groove, and by these parts, supporting plate 72 is fixed to stem 63. A flat, rectangular anode 74 is fixed facing forward on lead pin 64*b* and is held by being in contact with two protrusions formed on the front face of supporting plate 72.

Also as shown in FIG. 49, discharge shielding plate 71 is arranged as a structure with a protruding cross-sectional shape that is thinner and wider in comparison to supporting plate 72, and a through hole 71*a* is formed at a central position corresponding to anode 74. A through hole is formed in the vertical direction to a side of the protruding part of discharge shielding plate 71, and an electrode rod 81, which has been bent to an L-shape, is inserted through this through hole. In the condition where discharge shielding plate 71 and supporting plate 72 are adhered together, the lower end of electrode rod 81 and the tip of lead pin 64*c*, which has been bent into an L-shape, are welded together. An upper electrode rod 82 of an indirectly heated cathode for gas discharge tube C1 is welded to the tip part of electrode rod 81 that extends to the side, and in the condition where discharge shielding plate 71 and supporting plate 72 are adhered together, a lower electrode rod 83 is welded to the tip of lead pin 64*d*, which has been bent into an L-shape.

As shown in FIG. 49, a metal focusing electrode 76 is arranged by preparing an L-shaped metal plate, having a focusing aperture 76*a* formed coaxial to through hole 71*a* of discharge shielding plate 71 at a middle part, and bending this metal plate towards the rear at the upper part and towards the front at a side part in the direction of indirectly heated cathode for gas discharge tube C1, and at a side part, an aperture 76*b*, which has a rectangular shape that is long in the vertical direction and faces indirectly heated cathode for gas discharge tube C1, is formed. Each of discharge shielding plate 71, supporting plate 72, and focusing electrode 76 has four through holes formed at corresponding positions. Thus by inserting two metal pins 84 and 85 in the condition where discharge shielding plate 71, supporting plate 72, and focusing electrode 76 are adhered together, these components can be fixed to stem 63.

As shown in FIGS. 48 and 49, metal front cover 73 has a U-shaped cross section that is formed by bending in four stages and has an aperture window 73*a* for light projection formed at a central part. Two protrusions 73*b* are formed at each end part and these correspond to four through apertures 71*b* that are formed at the end parts of the front face of discharge shielding plate 71. Here, by inserting these protrusions 73*b* into through apertures 71*b*, front cover 73 is fixed to discharge shielding plate 71, and in this condition, the front end part of focusing electrode 76 contacts the inner face of front cover 73, and the space in which indirectly heated cathode for gas discharge tube C1 is disposed is separated from the light emitting space.

As shown in FIGS. 49 and 50, focusing electrode 76 has, at its central part, a focusing aperture 76*a* that is coaxial to through hole 71*a* of discharge shielding plate 71, and here, an aperture restricting plate 78 for restricting the aperture diameter is fixed by welding. Aperture restricting plate 78 is bent in the direction of anode 74 at the periphery of focusing aperture 76*a* and thus the distance between anode 74 and the aperture of aperture restricting plate 78 is less than the thickness of discharge shielding plate 78.

The respective electrodes inside light emitting part 62, which is assembled in the above-described manner, are positioned as shown in FIG. 50. Anode 74 is fixed by being sandwiched by discharge shielding plate 71 and supporting plate 72, and aperture restricting plate 78, which is welded to focusing electrode 76 is fixed to discharge shielding plate 71 at a position at which it faces anode 74 via through hole 71*a* of discharge shielding plate 71. Indirectly heated cathode for gas discharge tube C1 is positioned within a space surrounded by discharge shielding plate 71, front cover 73, and the surface of focusing electrode 76 provided with rectangular aperture 76*b* and at a position at which it faces aperture restricting plate 78 via rectangular aperture 76*b*.

The operation of deuterium gas discharge tube DT2 shall now be described with reference to FIG. 50. After indirectly heated cathode for gas discharge tube C1 has been heated adequately, a trigger voltage is applied across anode 74 and indirectly heated cathode for gas discharge tube C1 and discharge is thereby started. The flow path of thermions at this time is restricted to just the single path 91 (illustrated as the part sandwiched by broken lines) by the focusing by aperture restricting plate 78 of focusing electrode 76 and the shielding effect by discharge shielding plate 71 and supporting plate 72. That is, the thermions (not shown) emitted from indirectly heated cathode for gas discharge tube C1 pass through aperture restricting plate 78 from rectangular aperture 76*b* of focusing electrode 76, pass through the through hole 71*a* of discharge shielding plate 71 and reaches anode 74. An arc ball 92 due to arc discharge is generated at a space in front of aperture restricting plate 78 and at the side opposite anode 74. The light taken out from arc ball 92 is emitted substantially in the direction of arrow 93 through aperture window 73*a* of front cover 73.

Thus with deuterium gas discharge tube DT2 of the tenth embodiment, a deuterium gas discharge tube of long service life and stable operation can be realized by the use of any of indirectly heated cathodes for gas discharge tube C1 to C11.

ELEVENTH EMBODIMENT

Figure 51:
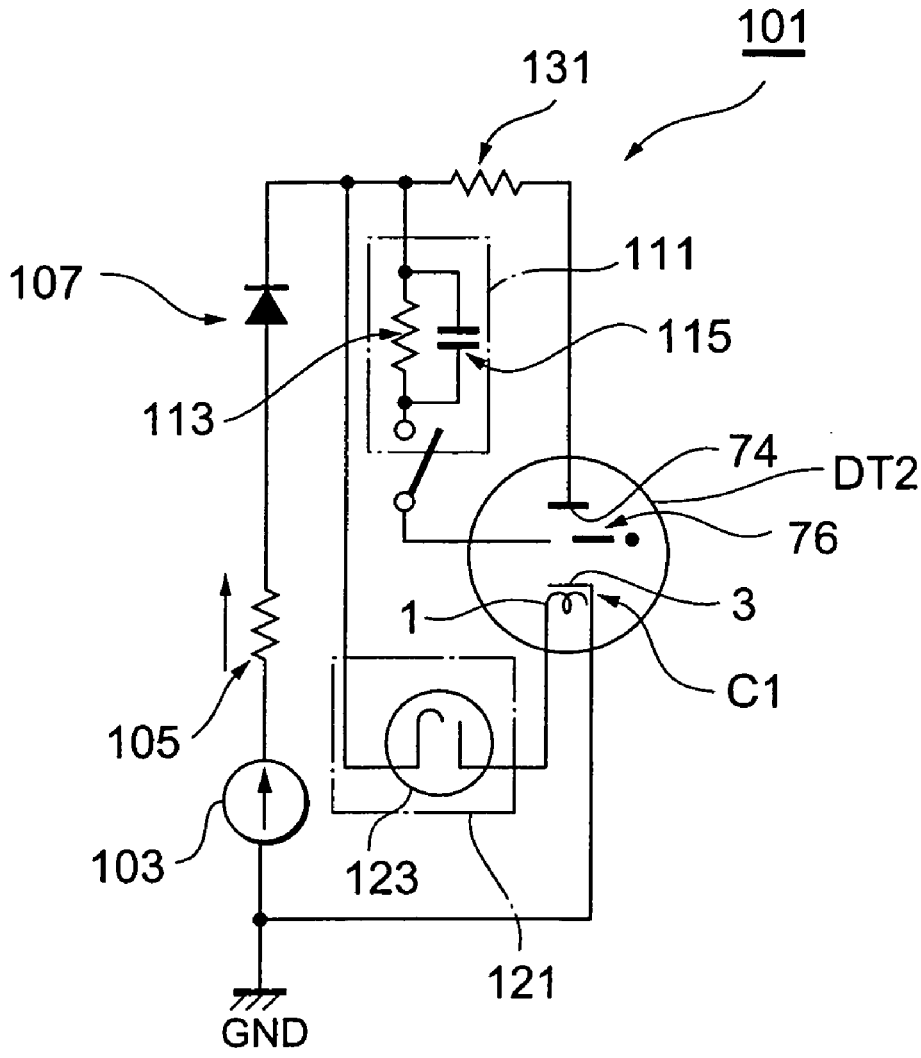
FIG. 51 is a circuit diagram, showing an eleventh embodiment's lighting device for gas discharge tube using an indirectly heated cathode for gas discharge tube.
Figures 52A, 52B, 52C, 52D, 52E, 52F:
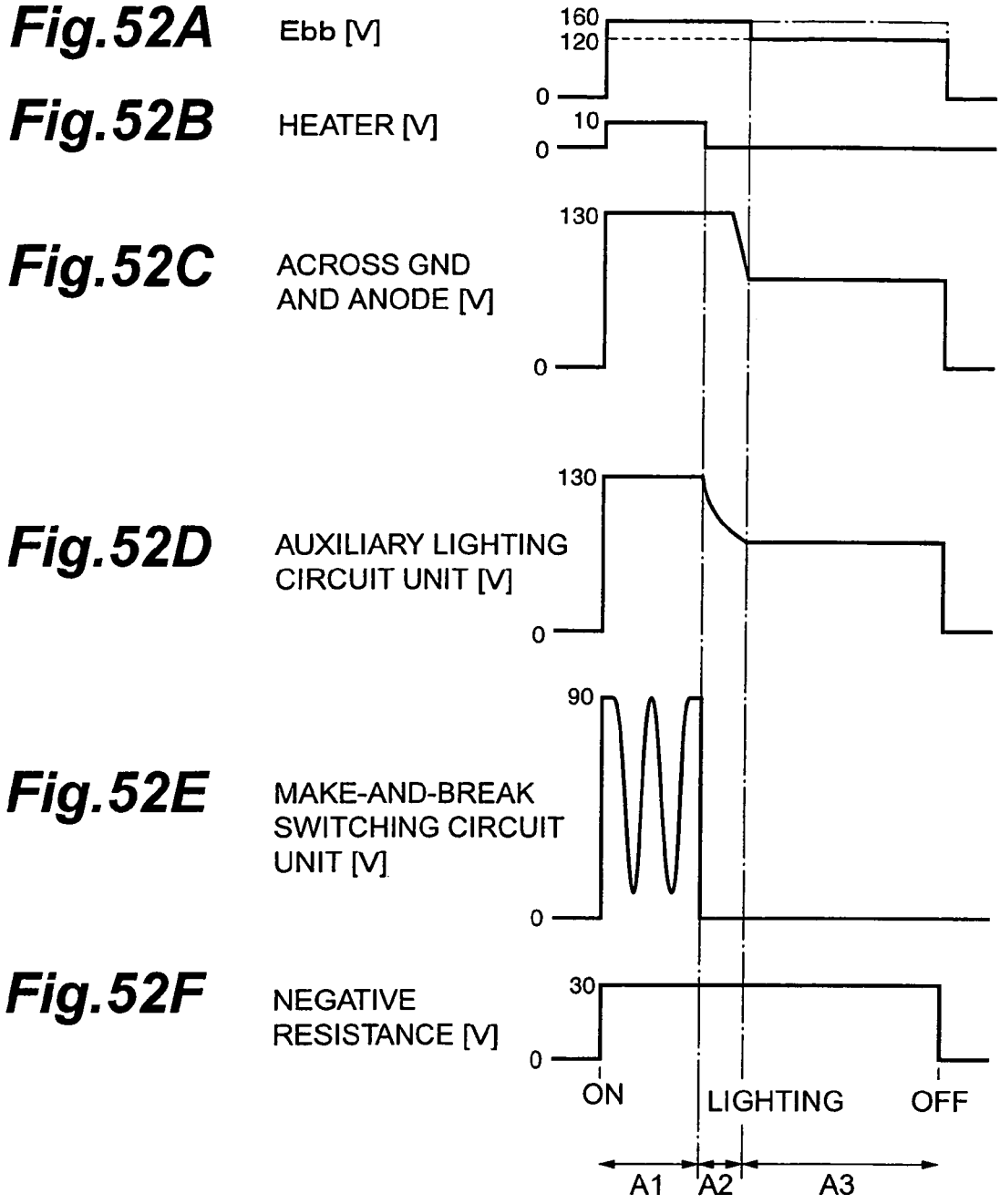
FIG. 52A is a timing chart, showing the operation voltage characteristics of the eleventh embodiment's lighting device for gas discharge tube using an indirectly heated cathode for gas discharge tube.
FIG. 52B is a timing chart, showing the operation voltage characteristics of the eleventh embodiment's lighting device for gas discharge tube using an indirectly heated cathode for gas discharge tube.
FIG. 52C is a timing chart, showing the operation voltage characteristics of the eleventh embodiment's lighting device for gas discharge tube using an indirectly heated cathode for gas discharge tube.
FIG. 52D is a timing chart, showing the operation voltage characteristics of the eleventh embodiment's lighting device for gas discharge tube using an indirectly heated cathode for gas discharge tube.
FIG. 52E is a timing chart, showing the operation voltage characteristics of the eleventh embodiment's lighting device for gas discharge tube using an indirectly heated cathode for gas discharge tube.
FIG. 52F is a timing chart, showing the operation voltage characteristics of the eleventh embodiment's lighting device for gas discharge tube using an indirectly heated cathode for gas discharge tube.
Figures 53A, 53B, 53C, 53D, 53E:
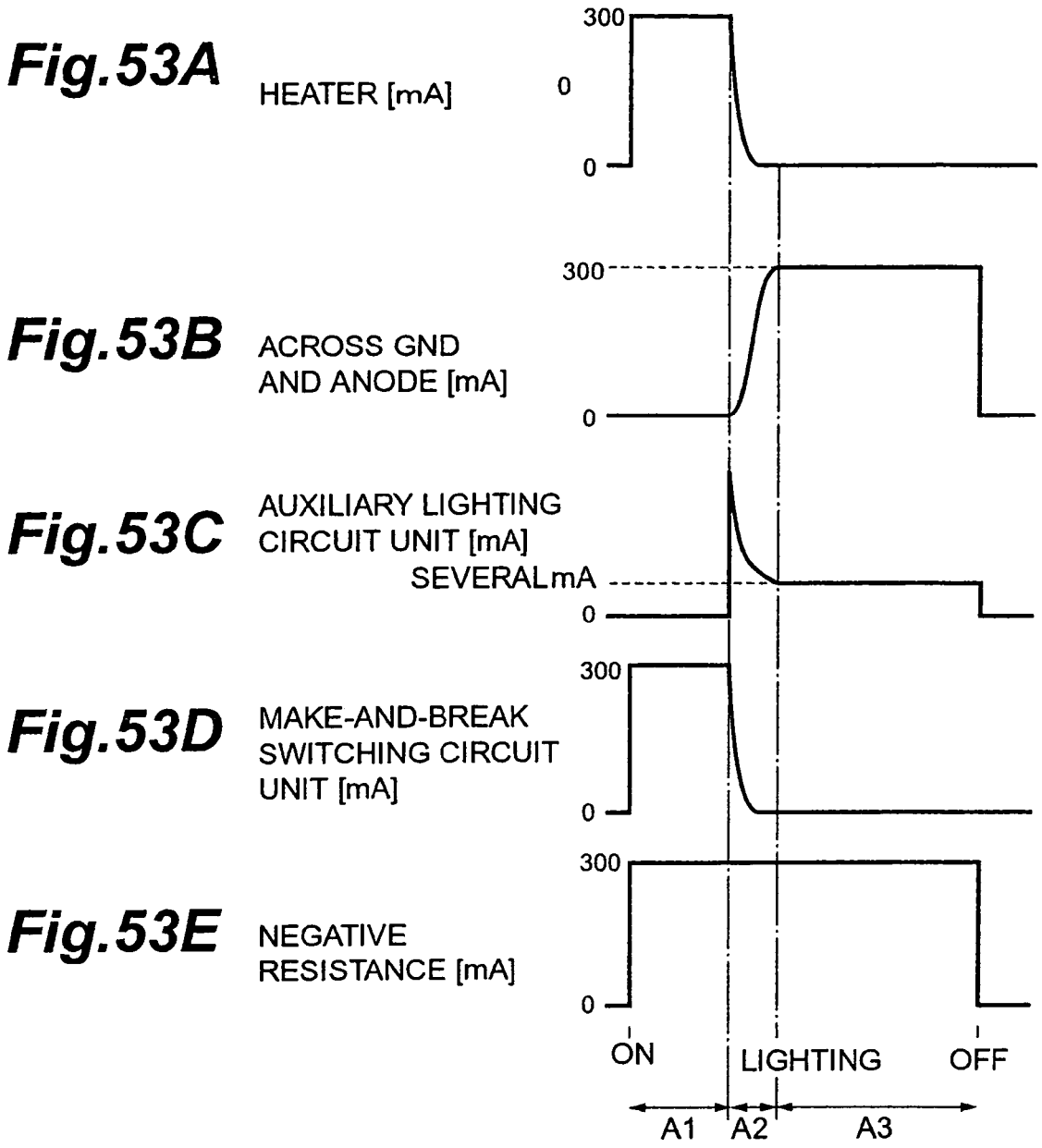
FIG. 53A is a timing chart, showing the operation current characteristics of the eleventh embodiment's lighting device for gas discharge tube using an indirectly heated cathode for gas discharge tube.
FIG. 53B is a timing chart, showing the operation current characteristics of the eleventh embodiment's lighting device for gas discharge tube using an indirectly heated cathode for gas discharge tube.
FIG. 53C is a timing chart, showing the operation current characteristics of the eleventh embodiment's lighting device for gas discharge tube using an indirectly heated cathode for gas discharge tube.
FIG. 53D is a timing chart, showing the operation current characteristics of the eleventh embodiment's lighting device for gas discharge tube using an indirectly heated cathode for gas discharge tube.
FIG. 53E is a timing chart, showing the operation current characteristics of the eleventh embodiment's lighting device for gas discharge tube using an indirectly heated cathode for gas discharge tube.

An eleventh embodiment's lighting device for gas discharge tube shall now be described based on FIG. 51. FIG. 51 is a circuit diagram, showing the eleventh embodiment's lighting device for gas discharge tube. In terms of gas discharge tube, the lighting device of the eleventh embodiment is suitable for deuterium gas discharge tube DT2, which was described as the tenth embodiment, and is especially suitable for a gas discharge tube that uses any of indirectly heated cathodes for gas discharge tube C1 to C3.

A lighting device 101 comprises a constant current power supply 103, connected as a power supply between indirectly heated cathode for gas discharge tube C1 and anode 74 of deuterium gas discharge tube DT2, an auxiliary lighting circuit unit 111, connected between anode 74 and focusing electrode 76 in order to generate a trigger discharge across indirectly heated cathode for gas discharge tube C1 and focusing electrode 76, a make-and-break switching circuit unit 121, connected between indirectly heated cathode for gas discharge tube C1 and anode 74 and supplying electricity to a heater 1 for a predetermined period and then cutting off the supply of electricity to heater 1 after the elapse of the predetermined period, and a fixed resistor 131 for current detection, serially connected and installed between anode 74 and constant current power supply 103.

Constant current power supply 103 supplies a DC open voltage of approximately 160V and a steady-state current of approximately 300 mA. A negative resistance 105 and a diode 107 for discharge stabilization are connected serially to this constant current power supply 103. Negative resistance 105 is set to approximately 50 to 150Ω.

Auxiliary lighting circuit unit 111 includes a fixed resistor 113, which is serially connected and installed between anode 74 and focusing electrode 76, and a capacitor 115, which is connected in parallel to this fixed resistor 113. Make-and-break switching circuit unit 121 includes a glow tube 123. A switch, which is opened after operation (lighting) of deuterium gas discharge tube DT2 may be provided between auxiliary lighting circuit unit 111 and focusing electrode 76. Also, in place of a glow starter system using glow tube 123, an electronic starting system using a semiconductor element with a timer function or a mechanical (contact) switch, which may or may not have a timer function, may be used.

The operation of lighting device 101 shall now be described based on FIGS. 52A to 52F and 53A to 53E.

Though not illustrated in FIG. 51, when a main power switch of lighting device 101 for deuterium gas discharge tube DT2 is switched ON (start), power is supplied from constant current power supply 103 to glow tube 123, glow discharge occurs at glow tube 123, and by mutual contact of the electrodes of glow tube 123, power is supplied to heater 1 of indirectly heated cathode for gas discharge tube C1, and indirectly heated cathode for gas discharge tube C1 is thereby preheated (period A1 in FIGS. 52A to 52F and 53A to 53E). At this point, a voltage of approximately 130V is applied across indirectly heated cathode for gas discharge tube C1 and anode 74 from constant current power supply 103 and an electric field directed from anode 74 to indirectly heated cathode for gas discharge tube C1 is generated.

When these preparations for trigger discharge have been made, the glow discharge at glow tube 123 stops and by the separation of the electrodes of glow tube 123, a potential of approximately 130V is generated at focusing electrode 76 from constant current power supply 103 and via the parallel-connected capacitor 115 and fixed resistor 113, and a trigger discharge is generated across indirectly heated cathode for gas discharge tube C1 and focusing electrode 76 (period A2 in FIGS. 52A to 52F and 53A to 53E).

By thus causing a trigger discharge to occur, an arc discharge is made to occur across indirectly heated cathode for gas discharge tube C1 and anode 74, and based on the current of approximately 300 mA that is supplied across indirectly heated cathode for gas discharge tube C1 and anode 74 from constant current power supply 103, arc discharge is sustained in a stable manner until the main power switch is turned OFF (period A3 in FIGS. 52A to 52F and 53A to 53E) During operation (lighting) of deuterium gas discharge tube DT2, the voltage applied to deuterium gas discharge tube DT2 from constant current power supply 103 is lowered, by fixed resistor 131, from the approximately 160V in the starting process to approximately 120V.

Since deuterium gas discharge tube DT2 using any of indirectly heated cathodes for gas discharge tube C1 to C3 can be driven in accordance to the relationship expressed by equations (7) and (8) given above, with lighting device 101 of the eleventh embodiment, a lighting device for lighting deuterium gas discharge tube DT2 using any of indirectly heated cathodes for gas discharge tube C1 to C3 can be realized. Also, since a single constant current power supply 103 can be used for the preheating of any of indirectly heated cathodes for gas discharge tube C1 to C3, for the starting of the trigger discharge (discharge by initial gas ionization), and for the main discharge, a power supply for preheating (heater) of any of indirectly heated cathodes for gas discharge tube C1 to C3 is made unnecessary in particular, thus enabling significant reduction of the number of parts and simplification of arrangement.

Also, with lighting device 101, since make-and-break switching circuit unit 121 includes a glow tube 123, make-and-break switching circuit unit 121 can be realized simply and at low cost. Furthermore, since auxiliary lighting circuit unit 111 includes a capacitor 115, auxiliary lighting circuit unit 111 can be realized simply and at low cost. Also, since auxiliary lighting circuit unit 111 includes a fixed resistor 113, the lighting property of deuterium gas discharge tube DT2 can be improved.

Also, with lighting device 101, since a fixed resistor 131 for current detection is provided, the voltage during operation of deuterium gas discharge tube DT2 can be lowered and the consumption power of deuterium gas discharge tube DT2 can thus be lowered.

TWELFTH EMBODIMENT

Figure 54:
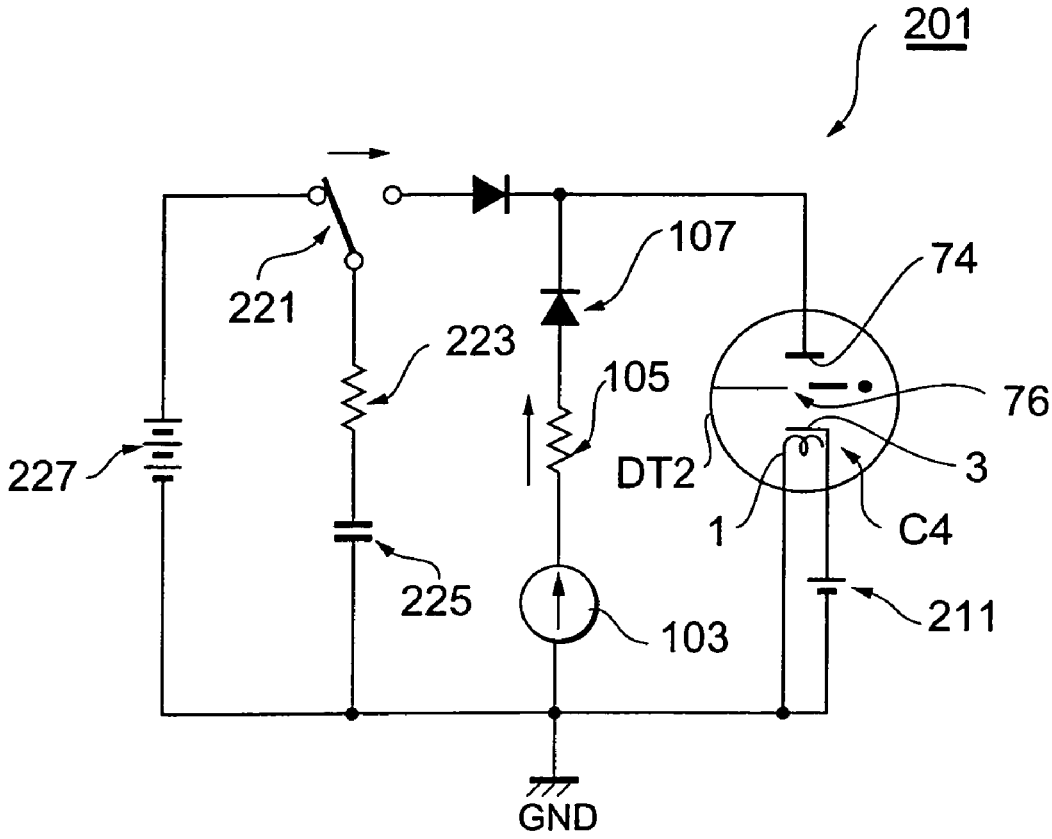
FIG. 54 is a circuit diagram, showing a lighting device of a twelfth embodiment's gas discharge tube using an indirectly heated cathode for gas discharge tube.

A twelfth embodiment's lighting device for gas discharge tube shall now be described based on FIG. 54. FIG. 54 is a circuit diagram, showing the twelfth embodiment's lighting device for gas discharge tube. In terms of gas discharge tube, the lighting device of the twelfth embodiment is suitable for deuterium gas discharge tube DT2, which was described as the tenth embodiment, and is especially suitable for a gas discharge tube that uses either of indirectly heated cathodes for gas discharge tube C4 and C5. The twelfth embodiment differs from the eleventh embodiment in having a cathode heating voltage source and a discharge starting voltage source.

A lighting device 201 is a general lighting device for a deuterium gas discharge tube and, though details shall be omitted, has a cathode heating voltage source 211, connected to indirectly heated cathode for gas discharge tube C4, and has, as a discharge starting circuit between anode 74 and indirectly heated cathode for gas discharge tube C4, a trigger switch 221, a fixed resistor 223, and a capacitor 225, which are connected successively and serially, and a discharge starting voltage source 227, which is connected in parallel to these parts.

With lighting device 201 of the twelfth embodiment, during the lighting of the deuterium gas discharge tube, the operation voltage of either of indirectly heated cathodes for gas discharge tube C4 and C5 can be lowered to lower the amount of heat generated by either of indirectly heated cathodes for gas discharge tube C4 and C5.

In a case where lighting device 201 is to be used as a lighting device for a deuterium gas discharge tube using any of indirectly heated cathodes for gas discharge tube C1 to C3, it is preferable to serially connect a make-and-break switch to cathode heating voltage source 211 and to open this make-and-break switch during operation of the deuterium gas discharge tube in accordance to the relationships of equations (7) and (8) given above.

Though in the first to seventh embodiments, a mesh member 3 or a wire member 21 is used as the electrical conductor, the electrical conductor is not limited thereto, and a rigid body, which is conductive and has a melting point that is higher than the operating temperature of the cathode, for example, a high-melting-point metal formed to a plate shape (including a ribbon-like or foil-like shape) may be used instead, and a porous metal of low thickness, carbon fibers, etc. may also be used in place of a high-melting-point metal. Also for improvement of the sputter resistance and improvement of the discharge performance of metal oxide 10, a nitride or carbide of tantalum, titanium, niobium, etc. may be attached to the surface of metal oxide 10, mesh member 3, wire member 21, or base metal 31.

Figure 55:
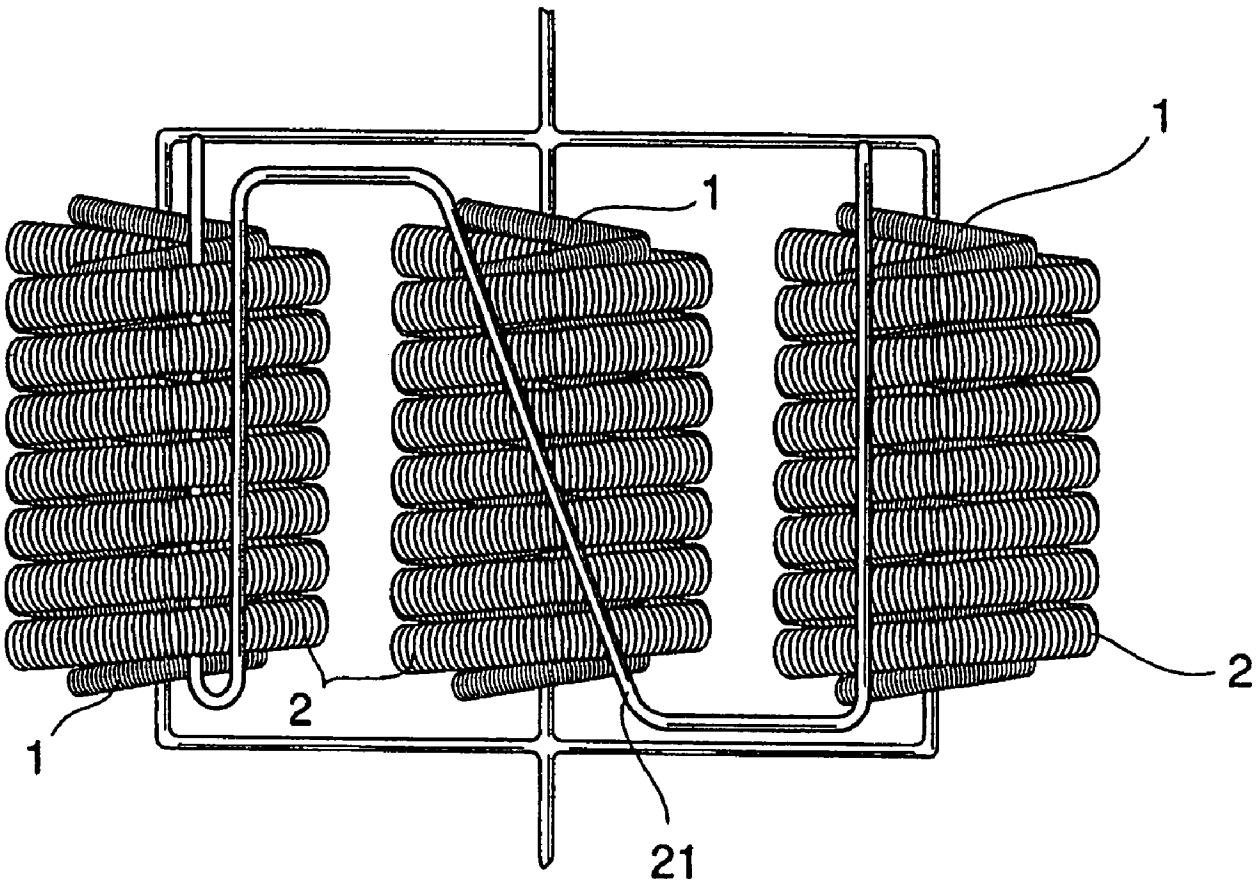
FIG. 55 is a schematic front view, showing a modification example of the indirectly heated cathode for gas discharge tube of any of the first to seventh embodiments.
Figure 56A:
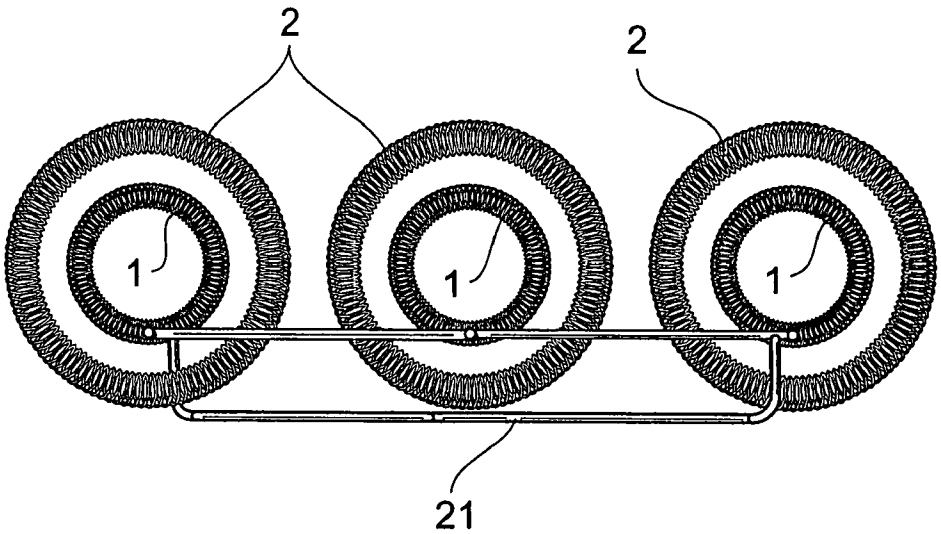
FIG. 56A is a schematic top view, showing a modification example of the indirectly heated cathode for gas discharge tube of any of the first to seventh embodiments.
Figure 56B:
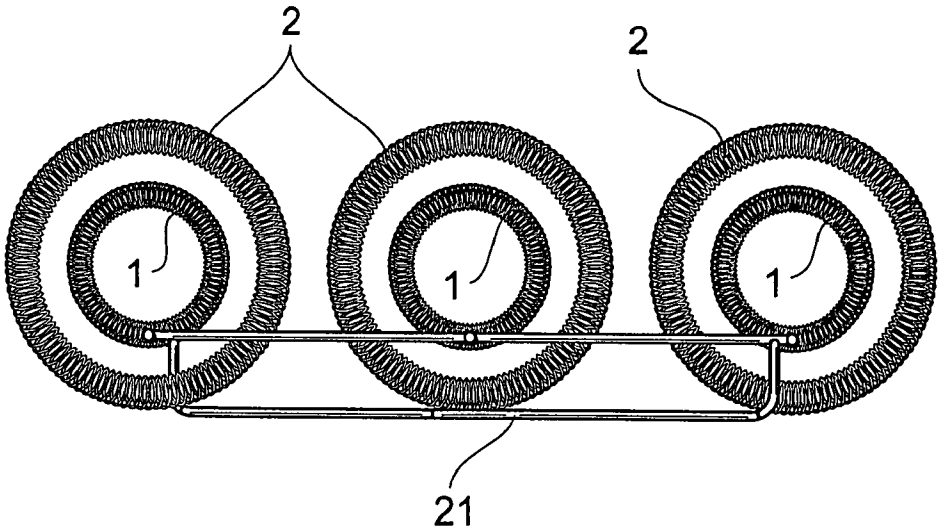
FIG. 56B is a schematic top view, showing a modification example of the indirectly heated cathode for gas discharge tube of any of the first to seventh embodiments.

As a further modification example of any of the first to seventh embodiments, a plurality of double coils 2 may be provided and a mesh member 3 or a wire member 21 may be disposed across these double coils 2 as shown in FIGS. 55, 56A, and 56B. In FIG. 56A, wire member 21 is disposed with gaps being set with respect to double coils 2. In FIGS. 56B, wire member 21 is disposed so as to be in electrical contact with a plurality of coil portions of double coils 2 along the length direction of double coils 2. In FIGS. 55, 56A and 56B, illustrations of an electrical insulating layer 4 and metal oxide 10 are omitted for the sake of description.

Also, though with the first to seventh embodiments, the surface of mesh member 3 or the surface of wire member 21 is exposed, there is no need for these surfaces to be exposed, and as long as mesh member 3 or wire member 21 is in contact with metal oxide 10, the surface of mesh member 3 or the surface of wire member 21 may be covered by metal oxide 10.

Also, though with the tenth embodiment, the present invention was applied to a side-on type deuterium gas discharge tube, the present invention is not limited thereto and may be applied to a head-on type deuterium gas discharge tube with which light is taken out from a top part of the tube.

THIRTEENTH EMBODIMENT

Figure 57:
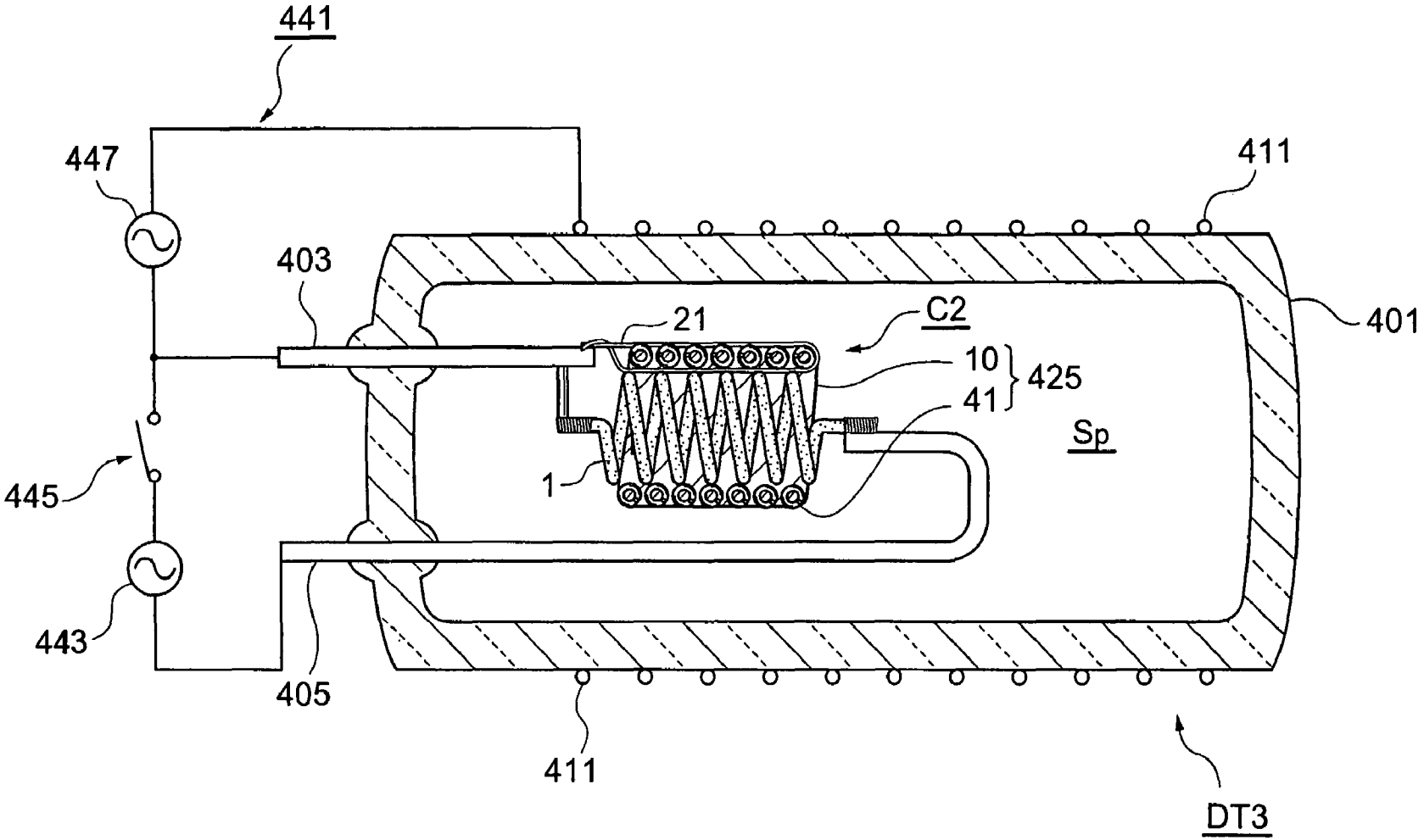
FIG. 57 is a schematic arrangement diagram, showing a gas discharge tube of a thirteenth embodiment.
Figure 58:
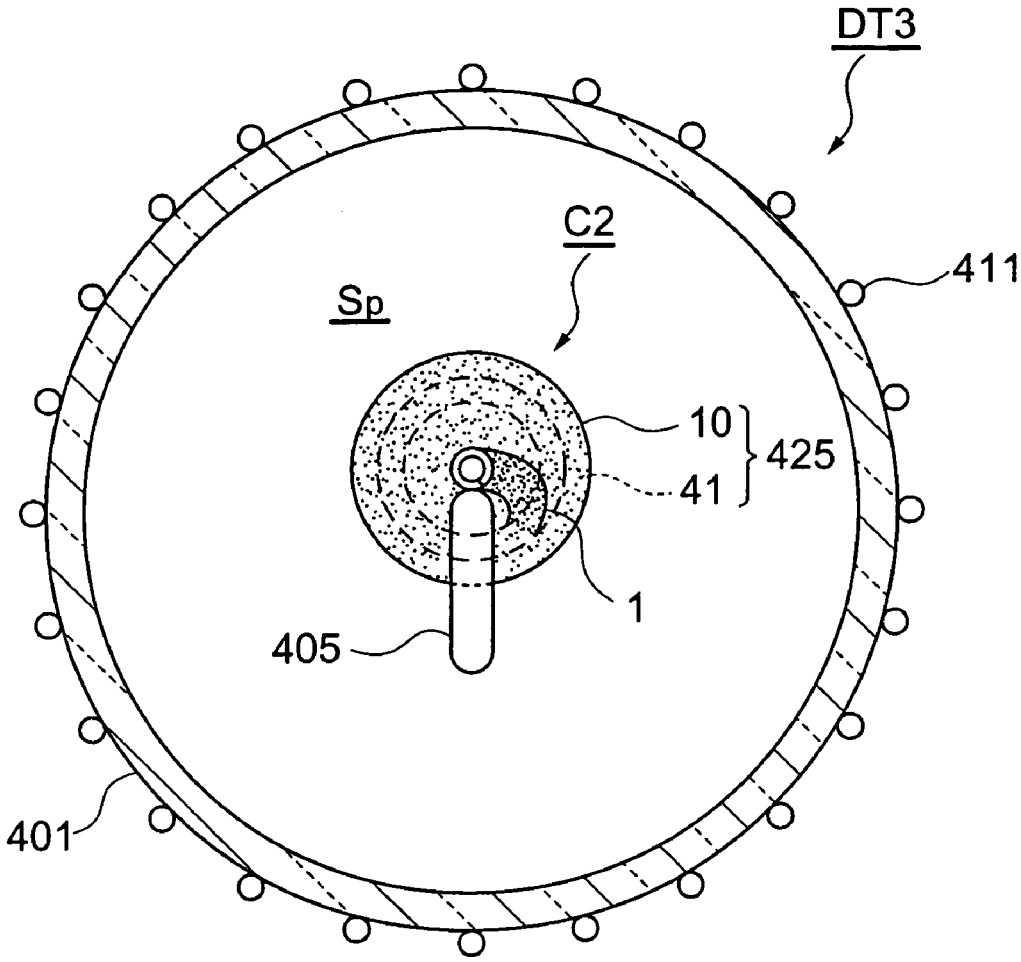
FIG. 58 is a schematic view for explaining the cross-sectional structure of a gas discharge tube of the thirteenth embodiment.

A gas discharge tube of a thirteenth embodiment shall now be described based on FIGS. 57 and 58. FIG. 57 is a schematic arrangement diagram of a gas discharge tube of the thirteenth embodiment and FIG. 58 is likewise a schematic view for explaining the cross-sectional structure of a gas discharge tube.

As shown in FIG. 57, a gas discharge tube DT3 is equipped with a glass bulb 401 as a tubular discharge container, an outer electrode 411, disposed at the outer side of glass bulb 401, and an indirectly heated electrode C2 as an inner electrode disposed at the inner side of glass bulb 401. Glass bulb 401 is comprised, for example, of a synthetic quartz glass tube and forms a dielectric body. A pair of lead-in wires 403 and 405 are sealed at one end part of glass bulb 401, and indirectly heated electrode C2 is mounted to the tip parts of lead-in wires 403 and 405. In the interior (discharge space Sp) of glass bulb 401, xenon (Xe) gas, for example, is sealed in an airtight manner as a gas from which excimer molecules are formed by dielectric barrier discharge.

Though the excimer light emission efficiency varies according to the discharge distance and the discharge sustaining voltage that arises in association with the discharge, the factor that affects the light emission efficiency the most is the sealed gas pressure. Xenon, having a light emission region at 172 nm, is most practical in terms of use, and xenon gas may be used upon being mixed with an other rare gas, such as krypton, neon, etc. Here, as the pressure of the xenon gas that is sealed for practical purposes, a pressure in the range of 2 kPa to 100 kPa may be used in accordance to the discharge distance and other discharge conditions. A xenon gas pressure range of 10 kPa to 50 kPa is favorable for use in that the excimer light emission efficiency peaks within this range.

Outer electrode 411 is formed as a conductive rigid body (metal conductor) of, for example, nickel, stainless steel, etc.

With the present embodiment, a nickel element wire of approximately 0.1 mm diameter is woven into mesh form to arrange outer electrode 411. The mesh size of outer electrode 411 is set to approximately 5 to 20 mesh. As shown in FIG. 58, outer electrode 411 is positioned by being wound around the outer circumference of glass bulb 401. Since outer electrode 411 is thus formed to a mesh, the light that is emitted from gas discharge tube DT3 will not be shielded by outer electrode 411. As outer electrode 411, an element wire of nickel, stainless steel, etc. may be positioned by being wound around the outer circumference of glass bulb 401.

Figure 59:
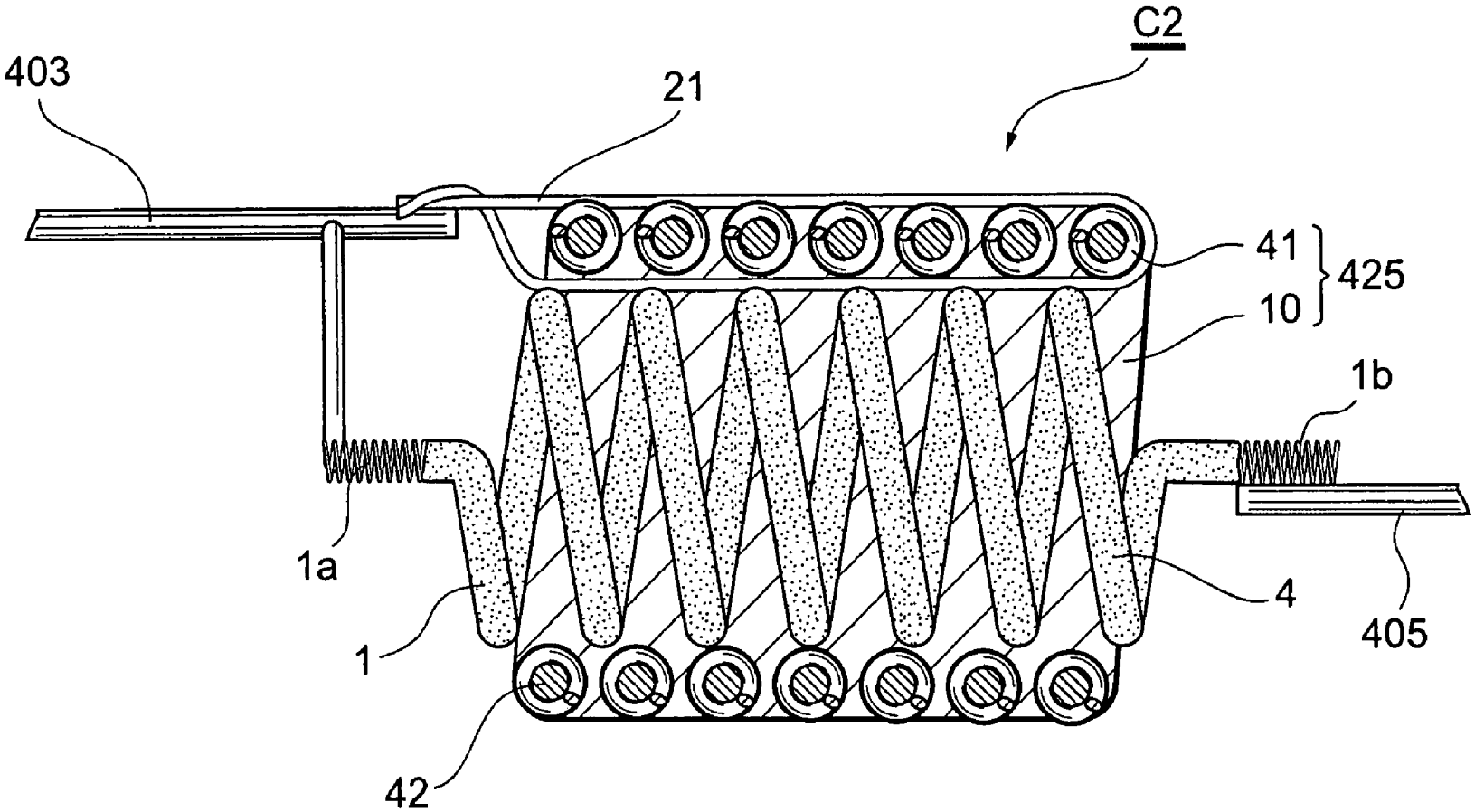
FIG. 59 is a schematic sectional view, showing the inner electrode (indirectly heated electrode) contained in the gas discharge tube of the thirteenth embodiment.

As shown in FIG. 59, indirectly heated electrode C2 has a heater 1, an electron emitting part 425, and a wire member 21.

Heater 1 comprises a filament coil, with which a tungsten element wire of 0.03 to 0.1 mm diameter, that is for example, a tungsten element wire of 0.07 mm diameter is wound in double, and an electrical insulating material (for example, alumina, zirconia, magnesia, silica, etc.) is coated by electrodeposition, etc. and formed as electrical insulating layer 4 on the surface of this tungsten filament coil. One end part 1*a* of heater 1 is electrically connected to one lead-in wire 403 among the pair of lead-in wires 403 and 405. The other end part 1*b* of heater 1 is electrically connected to the other lead-in wire 405 among the pair of lead-in wires 403 and 405.

Electron emitting part 425 emits electrons upon receiving the heat from heater 1 and has a double coil 41 and a metal oxide 10 as a material likely to emit electrons. Double coil 41 is a multiple coil arranged from a coil that is wound in coil form, and a tungsten element wire of 0.091 mm diameter is formed into a primary coil with a diameter of 0.25 mm and a pitch of 0.146 mm and this primary coil is formed into a double coil with a diameter of 1.7 mm and a pitch of 0.6 mm. Heater 1 is inserted into and disposed at the inner side of double coil 41.

Double coil 41 has a mandrel 42. Here, the mandrel is a core wire that serves the role of a mold that determines the winding diameter in the process of preparing the filament coil.

Each wire member 21 is a conductive rigid body (metal conductor) formed of a single, high-melting-point metal (with a melting point of at least 1000° C.) selected from among groups IIIa to VIIa, VIII, and Ib of the periodic table or, more specifically, from among tungsten, tantalum, molybdenum, rhenium, niobium, osmium, iridium, iron, nickel, cobalt, titanium, zirconium, manganese, chromium, vanadium, rhodium, rare earth metals, etc. or an alloy of these metals. With the present embodiment, wire members made of tungsten are used. The diameter of each wire member 21 is set to approximately 0.1 mm. Each wire member 21 is disposed across the length direction of double coil 41 at the outer side of double coil 41 so as to be substantially orthogonal to the discharge direction, and double coil 41 and wire member 21 are electrically connected. Though in the present embodiment, the number of wire members 21 is set to two, the number is not limited thereto and may be one or three or more. As with one end part 1*a* of heater 1, wire member 21 is electrically connected to lead-in wire 403.

Metal oxide 10 is held by double coil 41 and is put in contact with wire member 21. Metal oxide 10 and wire member 21 are exposed to the outer side of indirectly heated electrode C2 so that the surface of metal oxide 10 and the surface of wire member 21 make up a discharge surface and the surface part of metal oxide 10 is put in contact with wire member 21.

As metal oxide 10, a single oxide of a metal selected from among barium (Ba), strontium (Sr), and calcium (Ca), or a mixture of such oxides, or an oxide, with which the principle component is a single oxide of a metal selected from among barium (Ba), strontium (Sr), and calcium (Ca) or a mixture of such oxides and a sub-component is an oxide of a metal selected among rare earth metals including lanthanum (metals of group IIIa of the periodic table), is used. Each of barium, strontium, and calcium is low in work function, can emit thermions readily, and enable the thermion supply amount to be increased. Also, in a case where a rare earth metal (metal of group IIIa of the periodic table) is added as a sub-component, the thermion supply amount can be increased further and the sputter resistance can be improved as well.

As the electrode material, metal oxide 10 is coated in the form of a metal carbonate (for example, barium carbonate, strontium carbonate, calcium carbonate, etc.) and obtained by vacuum thermal decomposition of the coated metal carbonate. In the final stage, the metal oxide 10 that is thus obtained becomes the material likely to emit electrons. The metal carbonate that is to be the electrode material is coated from the wire member 21 side in the condition where heater 1 is positioned at the inner side of double coil 41 and wire member 21 is positioned at the outer side of double coil 41.

Referring again to FIG. 57, gas discharge tube DT3 is connected to a driving circuit 441. Driving circuit 441 includes a heater power supply 443, a preheating switch 445, and a high-frequency power supply 447. Heater power supply 443 and preheating switch 445 are connected in series between lead-in wires 403 and 405. By the closing of preheating switch 445, power is supplied from heater power supply 443 to heater 1 of indirectly heated electrode C2 and indirectly heated electrode C2 is thereby preheated. High-frequency power supply 447 is serially connected between lead-in wire 403 and outer electrode 411 and applies a high-frequency voltage across outer electrode 411 and indirectly heated electrode C2.

With gas discharge tube DT3 of the above-described arrangement, when indirectly heated electrode C2 is preheated and a high-frequency voltage is applied across outer electrode 411 and indirectly heated electrode C2, electron emitting part 425 (metal oxide 10) receives the heat from heater 1 and emits electrons, and a dielectric barrier discharge is thus generated. By the generation of this dielectric barrier discharge, excimer molecules of xenon gas are formed. Excimer light (vacuum ultraviolet light) is then emitted by the formed excimer molecules of xenon. If a fluorescent material is coated onto the inner surface of glass bulb 401, the coated fluorescent material is excited by the excimer light and emits visible light.

Thus with gas discharge tube DT3 of the thirteenth embodiment, since indirectly heated electrode C2 is used as the inner electrode, the potential (acceleration voltage) necessary for emission of discharge electrons from indirectly heated electrode C2 can be kept low and the emission efficiency of gas discharge tube DT3 can be made high.

Also since indirectly heated electrode C2 is used as the inner electrode, a high discharge current can be taken out from the inner electrode (indirectly heated electrode C2). The discharge current amount per unit area of outer electrode 411 is thus increased and the amount of xenon excimer molecules that are produced is increased. As a result, the optical output of gas discharge tube DT3 can be made high.

With indirectly heated electrode C2 of the thirteenth embodiment, since wire member 21 is disposed in contact with metal oxide 10, an equipotential surface is formed effectively by wire member 21, and thermionic emission thus occurs over a wide region of the equipotential surface that is formed, the discharge area is increased, the electron emission amount per unit area (electron emission density) is increased, and the load placed on the discharge position is lightened, thereby enabling the sputtering of metal oxide 10 and stabilization (mineralization) due to oxidation with the reduced metal, which are degradation factors, to be restrained, that is, the degradation of the thermionic emission ability to be restrained. As a result, the occurrence of localized discharge can be restrained and long service life of indirectly heated electrode C2 can be realized. Since the movement of the discharge position is also restrained, stable discharge over a long period of time can be realized.

Also, with indirectly heated electrode C2 of the thirteenth embodiment, due to the increase of the discharge area, even if the current density is slightly increased and the load is somewhat increased, that is, even if the discharge current is increased, the damage can be made less than that of the prior art. This enables the provision of an indirectly heated electrode of large discharge current with substantially the same shape as that of the prior art.

Also since wire member 21 is used as the electrical conductor in indirectly heated electrode C2 of the thirteenth embodiment, an electrical conductor of an arrangement, which can restrain the degradation of the thermionic emission ability and the movement of the discharge position, can be realized at low cost and in a simpler manner. Also, since wire member 21 (electrical conductor) is a rigid body, it is easy to process and can be put in close contact with metal oxide 10.

Also with indirectly heated electrode C2 of the thirteenth embodiment, since heater 1 is used as a core at the outer side of which double coil 41, which holds metal oxide 10, is positioned in a surrounding manner and wire member 21 is positioned so as to be in contact with the surface part of metal oxide 10 that is held by double coil 41, the vibration restraining effect of double coil 41 is put to work and the falling off of metal oxide 10 is thereby prevented. Also, since a large amount of metal oxide 10 will be held between the pitches of double coil 41, the effect of replenishing the metal oxide loss that accompanies the degradation with time during discharge is provided.

Also with indirectly heated electrode C2 of the thirteenth embodiment, since double coil 41 has mandrel 42, the deformation of double coil 41 during processing can be restrained. Furthermore, since double coil 41 has mandrel 42, double coil 41 is made high in heat capacity and improved in heat resistance.

FOURTEENTH EMBODIMENT

Figure 60:
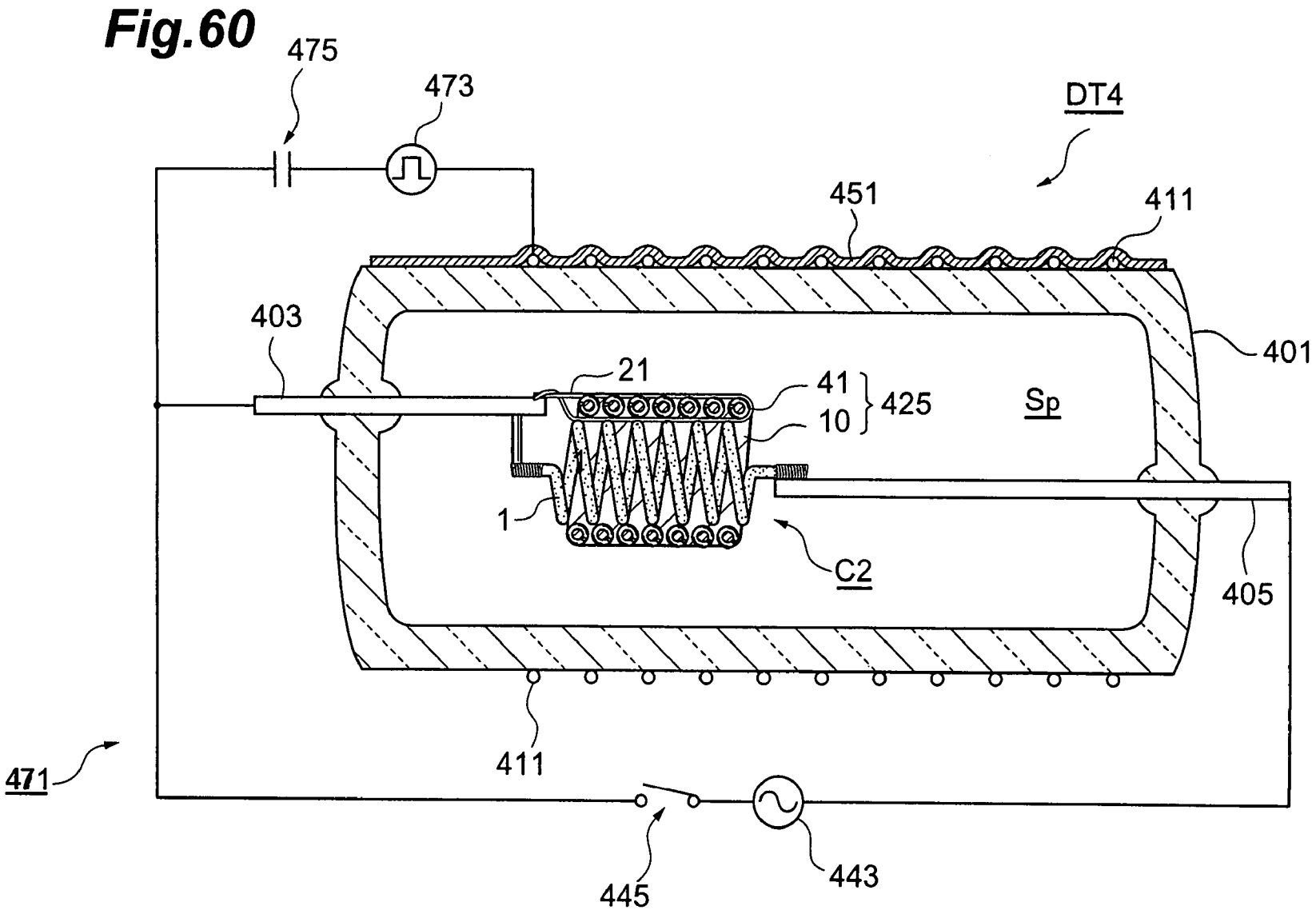
FIG. 60 is a schematic arrangement diagram, showing a gas discharge tube of a fourteenth embodiment.

A gas discharge tube DT4 of a fourteenth embodiment shall now be described based on FIGS. 60 and 61. FIG. 60 is a schematic arrangement diagram, showing a gas discharge tube of the fourteenth embodiment, and FIG. 61 is likewise a schematic view for explaining the cross-sectional structure of a gas discharge tube.

As with the thirteenth embodiment, a gas discharge tube DT4 is equipped with a glass bulb 401, lead-in wires 403 and 405, an outer electrode 411, and an indirectly heated electrode C2. However, as shown in FIG. 60, lead-in wire 403 is sealed at one end part of glass bulb 401 and lead-in wire 405 is sealed at the other end part of glass bulb 401.

Figure 61:
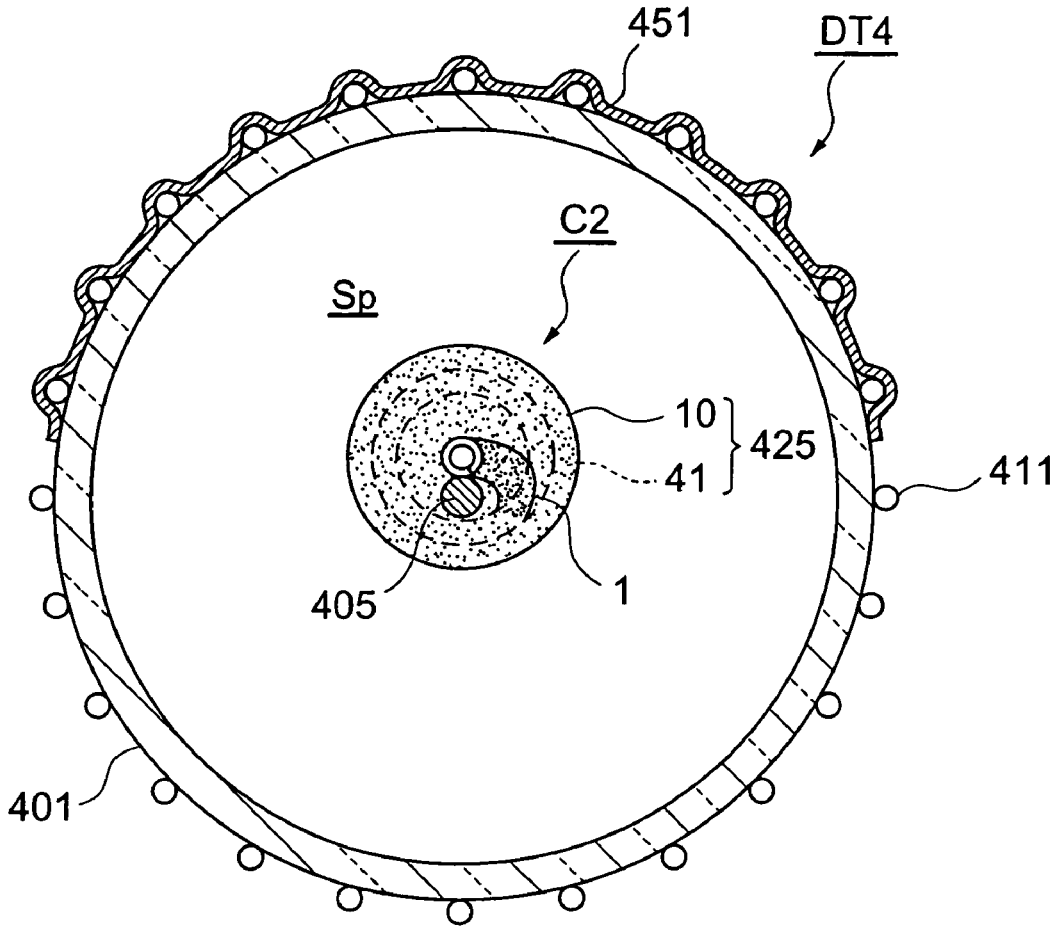
FIG. 61 is a schematic view for explaining the cross-sectional structure of the gas discharge tube of the fourteenth embodiment.

As shown in FIGS. 60 and 61, with gas discharge tube DT4, a light reflecting member 451 for reflecting excimer light is provided at the outer side of outer electrode 411. The part of glass bulb 401 at which light reflecting member 451 is not provided becomes the part from which light is taken out. Light reflecting member 451 may be formed by vapor depositing aluminum or other metal in the form of a film. Though light reflecting member 451 and outer electrode 411 are arranged as separate components, in a case where light reflecting member 451 is arranged as a vapor-deposited film of aluminum or other conductive metal, light reflecting member 451 itself may be used as the outer electrode.

As shown in FIG. 60, a driving circuit 471 is connected to gas discharge tube DT4. Driving circuit 471 includes a heater power supply 443, a preheating switch 445, and a rectangular wave power supply 473. Rectangular wave power supply 473 is serially connected, along with a ballast capacitor 75, between lead-in wire 403 and outer electrode 411 and applies a rectangular wave voltage (pulse voltage) across outer electrode 411 and indirectly heated electrode C2.

With gas discharge tube DT4 of the above-described arrangement, when indirectly heated electrode C2 is preheated and a rectangular wave voltage is applied across outer electrode 411 and indirectly heated electrode C2, electron emitting part 425 (metal oxide 10) receives the heat from heater 1 and emits electrons, and a dielectric barrier discharge is thus generated. Excimer molecules of xenon gas are formed by this dielectric barrier discharge and excimer light is thereby emitted.

As with gas discharge tube DT3 of thirteenth embodiment, since indirectly heated electrode C2 is used as the inner electrode in gas discharge tube DT4 of the fourteenth embodiment, the potential (acceleration voltage) necessary for emission of discharge electrons from indirectly heated electrode C2 can be kept low and the emission efficiency of gas discharge tube DT4 can be made high.

Also since indirectly heated electrode C2 is used as the inner electrode, a high discharge current can be taken out from the inner electrode (indirectly heated electrode C2). The discharge current amount per unit area of outer electrode 41 is thus increased and the amount of xenon excimer molecules that are produced is increased. As a result, the optical output of gas discharge tube DT4 can be made high.

Also, with gas discharge tube DT4 of the fourteenth embodiment, since excimer light is reflected by light reflecting member 451 and is emitted from a part at which light reflecting member 451 is not provided, a large optical output can be obtained at a compact size in comparison to a gas discharge tube of an arrangement with which light is emitted substantially uniformly from the entire circumference of the outer surface of a glass bulb 401 (for example, gas discharge tube DT3 of the thirteenth embodiment).

FIFTEENTH EMBODIMENT

Figure 62:
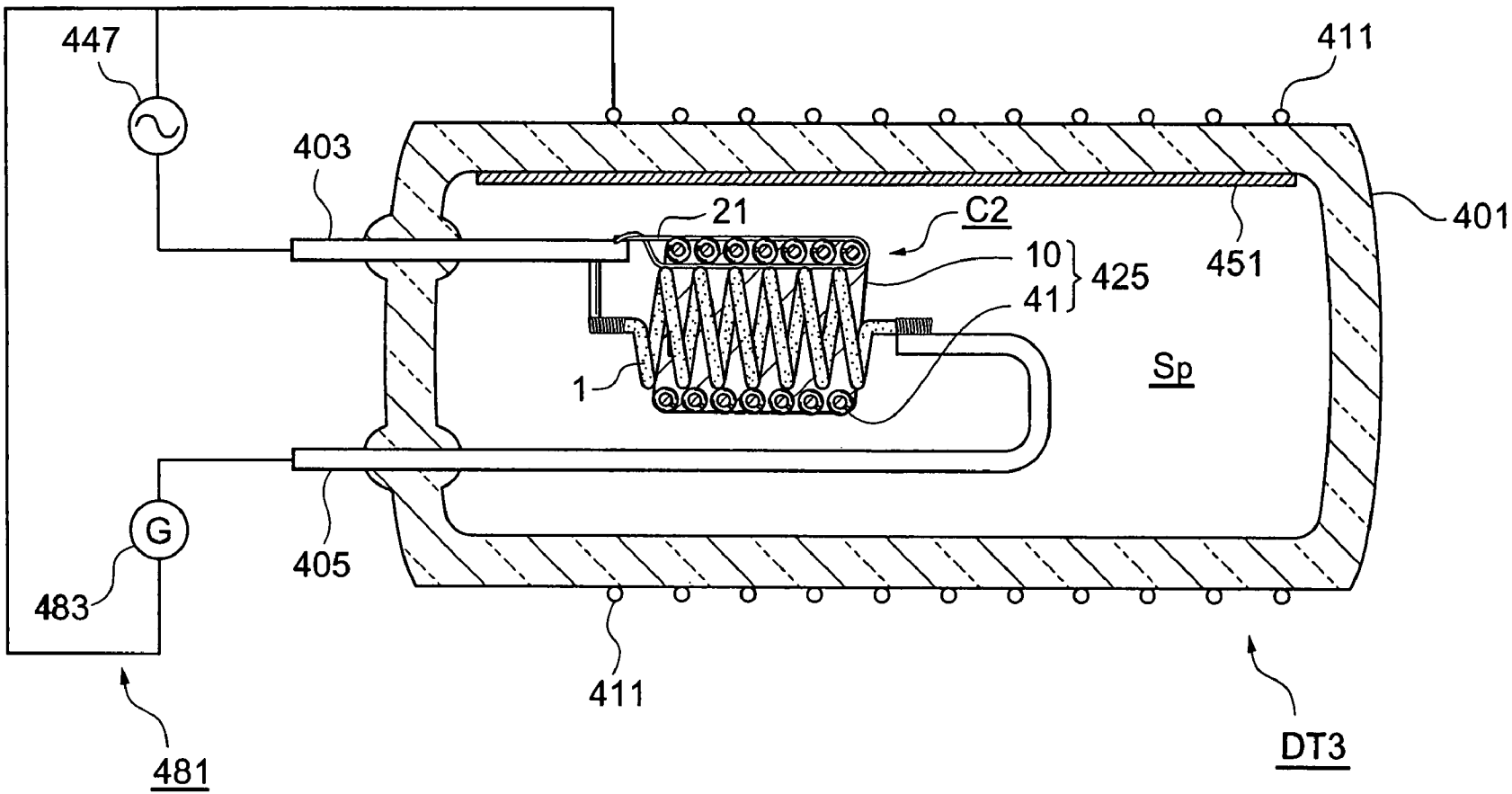
FIG. 62 is a schematic arrangement diagram, showing a gas discharge tube of a fifteenth embodiment.
Figure 63:
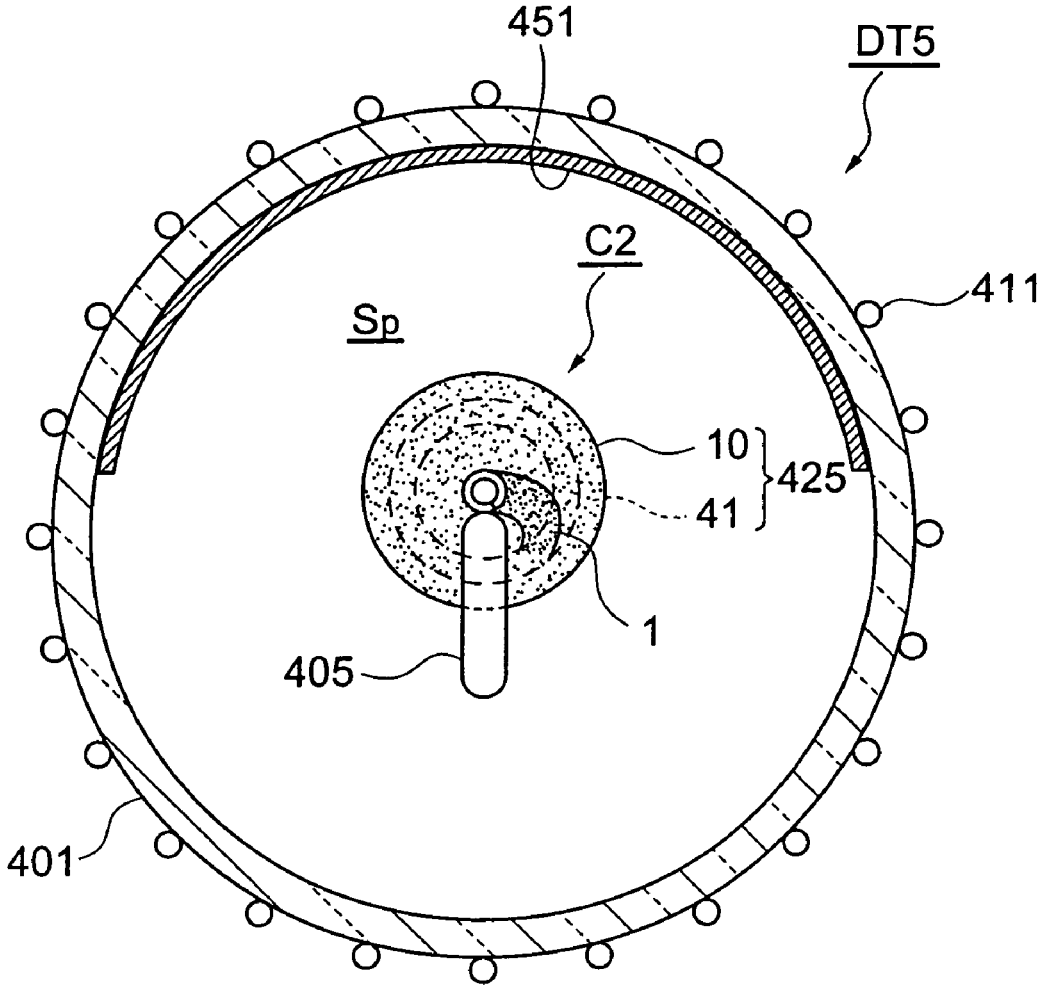
FIG. 63 is a schematic view for explaining the cross-sectional structure of the gas discharge tube of the fifteenth embodiment.
Figure 64:
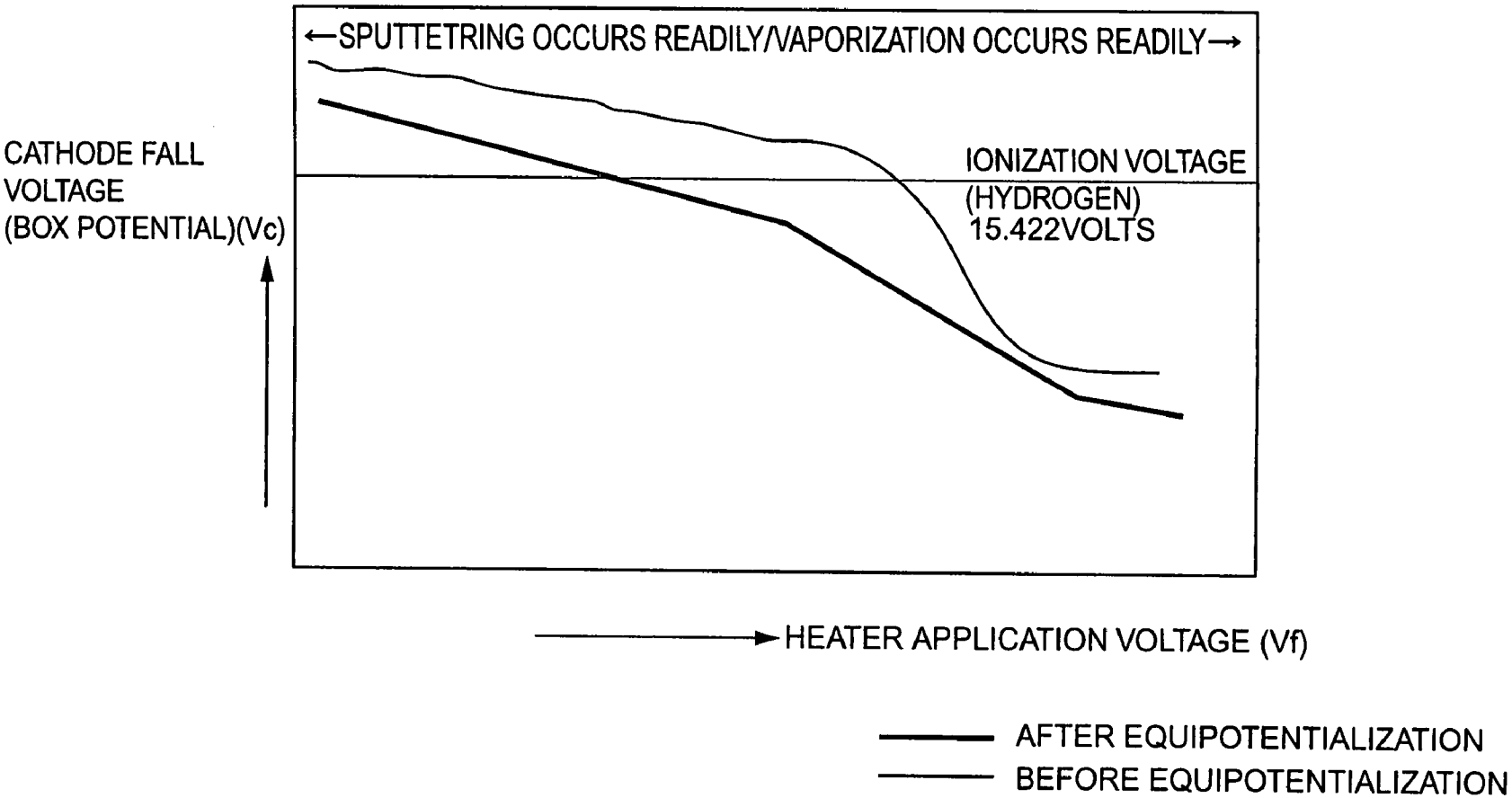
FIG. 64 is a graph, showing the relationship between the heater application voltage and cathode fall voltage (box potential) of a gas discharge tube.
Figure 65:
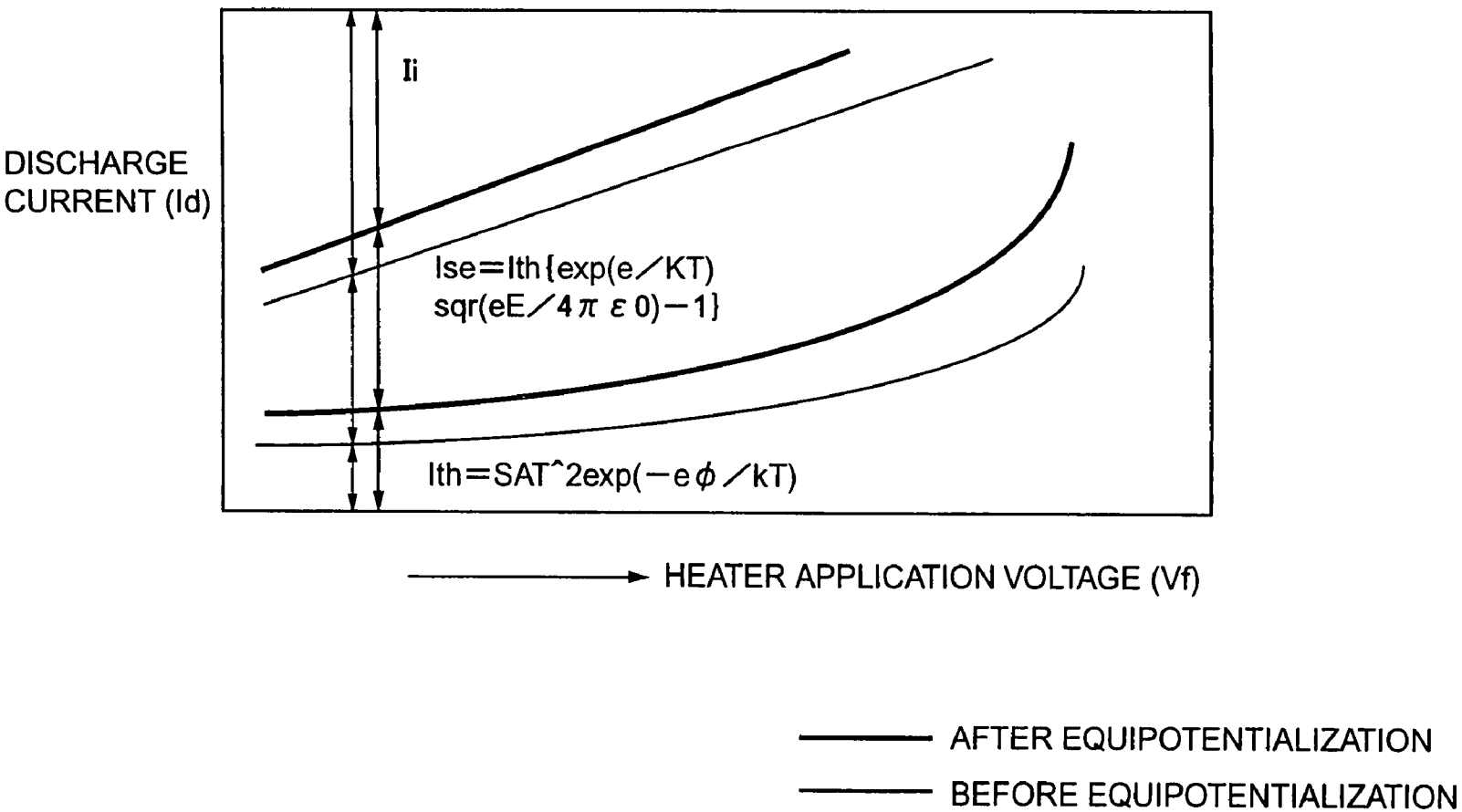
FIG. 65 is a graph, showing the relationship between the heater application voltage and discharge current of a gas discharge tube.

A gas discharge tube DT5 of a fifteenth embodiment shall now be described based on FIGS. 62 and 63. FIG. 62 is a schematic arrangement diagram, showing a gas discharge tube of the fifteenth embodiment, and FIG. 63 is likewise a schematic view for explaining the cross-sectional structure of a gas discharge tube.

As with the thirteenth and fourteenth embodiments, a gas discharge tube DT5 is equipped with a glass bulb 410, lead-in wires 403 and 405, outer electrode 411, and indirectly heated electrode C2. As shown in FIGS. 62 and 63, with gas discharge tube DT5, a light reflecting member 451 for reflecting excimer light is provided at the inner surface of glass bulb 401. Thus like gas discharge tube DT4 of the fourteenth embodiment, the part of glass bulb 401 at which light reflecting member 451 is not provided becomes the part from which light is taken out.

As shown in FIG. 62, a driving circuit 481 is connected to gas discharge tube DT5. Driving circuit 481 includes a glow tube 483 and a high-frequency power supply 447. Also, in place of a glow starter system using glow tube 483, an electronic starting system using a semiconductor element with a timer function or a mechanical (contact) switch, which may or may not have a timer function, may be used.

As with gas discharge tube DT3 of thirteenth embodiment and gas discharge tube DT4 of the fourteenth embodiment, since indirectly heated electrode C2 is used as the inner electrode in gas discharge tube DT5 of the fifteenth embodiment, the potential (acceleration voltage) necessary for emission of discharge electrons from indirectly heated electrode C2 can be kept low and the emission efficiency of gas discharge tube DT5 can be made high.

Also since indirectly heated electrode C2 is used as the inner electrode, a high discharge current can be taken out from the inner electrode (indirectly heated electrode C2). The discharge current amount per unit area of outer electrode 41 is thus increased and the amount of xenon excimer molecules that are produced is increased. As a result, the optical output of gas discharge tube DT5 can be made high.

Also, as with gas discharge tube DT4 of the fourteenth embodiment, since excimer light is reflected by light reflecting member 451 and is emitted from a part at which light reflecting member 451 is not provided with gas discharge tube DT5 of the fifteenth embodiment, a large optical output can be obtained at compact size in comparison to a gas discharge tube of an arrangement with which light is emitted substantially uniformly from the entire circumference of the outer surface of a glass bulb 401 (for example, gas discharge tube DT3 of the thirteenth embodiment).

Though with the thirteenth to fifteenth embodiments described above, examples of use of indirectly heated cathode for gas discharge tube C2 of the second embodiment as the indirectly heated cathode for gas discharge tube were described, any of indirectly heated cathodes for gas discharge tube C1 and C4 to C11 may be used in place of indirectly heated cathode for gas discharge tube C2. Also, besides xenon gas, a single gas of krypton (Kr), argon (Ar), or neon (Ne) or a mixed gas, etc. may be used as the gas with which excimer molecules are formed by dielectric barrier discharge.

INDUSTRIAL APPLICABILITY

This invention's indirectly heated cathode for gas discharge tube, gas discharge tube using this cathode, and lighting device for the gas discharge tube may be used in rare gas lamps, rare gas fluorescent lamps, mercury lamps, mercury fluorescent lamps, deuterium lamps, etc.

The invention claimed is:

1. A gas discharge tube comprising:

a container; and a pair of indirectly heated electrodes are sealed in an airtight manner in the container, wherein each of the indirectly heated electrodes comprises:

a heater, having an electrical insulating layer formed on a surface thereof;

an electron emitting part, emitting electrons upon receiving heat from the heater; and an electrical conductor, disposed at the surfacemost part of the electron emitting part and having a predetermined length, wherein the electron emitting part comprises: a metal oxide likely to emit electrons; and a coil member, holding the metal oxide, and wherein the electrical conductor is a high-melting-point metal that has been formed to a mesh and is in contact with the metal oxide.

2. The gas discharge tube as set forth in claim 1, wherein a pair of the indirectly heated electrodes are sealed such that the electrical conductors oppose each other.

3. The gas discharge tube as set forth in claim 1, wherein the the electrical conductor is disposed in contact with the metal oxide and in contact with a plurality of coil portions of the coil member along the length direction of the coil member.

4. The gas discharge tube as set forth in claim 3, wherein the coil member is a multiple coil arranged by winding a coil in coil form.

5. The gas discharge tube as set forth in claim 3, wherein the coil member is a multiple coil arranged by winding a coil having a mandrel in coil form.

6. The gas discharge tube as set forth in claim 3, wherein the metal oxide is an oxide of a single metal among barium, strontium, and calcium or a mixture of oxides of these metals or contains an oxide of a rare earth metal.

7. The gas discharge tube as set forth in claim 1, wherein the gas discharge tube is driven by alternating current.

8. A gas discharge tube comprising:

a container; and a pair of indirectly heated electrodes are sealed in an airtight manner in the container, wherein each of the indirectly heated electrodes comprises:

a coil member, having a mandrel and wound in coil form;

a heater, disposed at the inner side of the coil member and having an electrical insulating layer formed on a surface thereof;

a high-melting-point metal, formed to a mesh and disposed along the length direction of the coil member at the outer side of the coil member; and a metal oxide, serving as a material likely to emit electrons and disposed so as to be in contact with the coil member; and wherein a pair of the indirectly heated electrodes are sealed such that the high-melting-point metals oppose each other.

9. The gas discharge tube as set forth in claim 8, wherein the coil member is a single coil.

10. The gas discharge tube as set forth in claim 8, wherein the coil member is a multiple coil arranged by winding a coil in coil form.

11. A gas discharge tube comprising:

a container; and a pair of indirectly heated electrodes are sealed in an airtight manner in the container, wherein each of the indirectly heated electrodes comprises:

a coil member, wound in coil form;

a heater, disposed at the inner side of the coil member and having an electrical insulating layer formed on a surface thereof;

a high-melting-point metal, formed to a mesh and disposed along the length direction of the coil member at the outer side of the coil member; and a metal oxide, serving as a material likely to emit electrons and held by the coil member so as to be in contact with the high-melting-point metal; and wherein the high-melting-point metal is in electrical contact with the coil member at a plurality of locations; and wherein a pair of the indirectly heated electrodes are sealed such that the high-melting-point metals oppose each other.

12. The gas discharge tube as set forth in claim 11, wherein the coil member is a single coil.

13. The gas discharge tube as set forth in claim 11, wherein the coil member is a multiple coil arranged by winding a coil in coil form.

14. A gas discharge tube comprising:

a container; and a pair of indirectly heated electrodes are sealed in an airtight manner in the container, wherein each of the indirectly heated electrodes comprises:

a coil member, wound in coil form;

a heater, disposed at the inner side of the coil member and having an electrical insulating layer formed on a surface thereof;

a high-melting-point metal, formed to a mesh and disposed along the length direction of the coil member at the outer side of the coil member; and a metal oxide, serving as a material likely to emit electrons and held by the coil member so as to be in contact with the coil member and the high-melting-point metal; and wherein a pair of the indirectly heated electrodes are sealed such that the high-melting-point metals oppose each other.

15. The gas discharge tube as set forth in claim 14, wherein the coil member is a multiple coil arranged by winding a coil in coil form.

16. A gas discharge tube comprising:

a container; and a pair of indirectly heated electrodes are sealed in an airtight manner in the container, wherein each of the indirectly heated electrodes comprises:

a base metal, formed to a tubular form;

a heater, disposed at the inner side of the base metal and having an electrical insulating layer formed on a surface thereof;

a coil member, wound in coil form around the outer side of the base metal;

a high-melting-point metal, formed to a mesh and disposed along the length direction of the coil member at the outer side of the coil member; and a metal oxide, serving as a material likely to emit electrons and held by the coil member so as to be in contact with the high-melting-point metal; and wherein a pair of the indirectly heated electrodes are sealed such that the high-melting-point metals oppose each other.

17. A gas discharge tube comprising:

a container; and a pair of indirectly heated electrodes are sealed in an airtight manner in the container, wherein each of the indirectly heated electrodes comprises:

a heater, having an electrical insulating layer formed on a surface thereof;

a high-melting-point metal, formed to a mesh and disposed along the length direction of the heater at the outer side of the heater; and a metal oxide, serving as a material likely to emit electrons and disposed so as to be in contact with the high-melting-point metal; and wherein a pair of the indirectly heated electrodes are sealed such that the high-melting-point metals oppose each other.

18. A gas discharge tube comprising:

a container; and a pair of indirectly heated electrodes are sealed in an airtight manner in the container, wherein each of the indirectly heated electrodes comprises:

a heater, having an electrical insulating layer fonned on a surface thereof;

a high-melting-point metal, formed to a mesh, extended in the length direction in a waving manner, and disposed along the length direction of the heater at the outer side of the heater;

a conductive wire, having a shape that spans a depressed part at one side of the high-melting-point metal in one direction along the width direction of the high-melting-point metal and spans a depressed part at the other side of the high-melting-point metal in the reverse direction along the width direction of the high-melting-point metal; and a metal oxide, serving as a material likely to emit electrons and disposed so as to be in contact with the high-melting-point metal; and wherein a pair of the indirectly heated electrodes are sealed such that the high-melting- point metals oppose each other.

19. The gas discharge tube as set forth in claim 18, wherein the conductive wire comprises a mandrel and a filament wound around the outer circumference of the mandrel.

20. A gas discharge tube comprising:

a container; and a pair of indirectly heated electrodes are sealed in an airtight manner in the container, wherein each of the indirectly heated electrodes comprises:

a base metal, formed to a tubular form; a heater, disposed at the inner side of the base metal and having an electrical insulating layer fonned on a surface thereof;

a high-melting-point metal, formed to a mesh and disposed on the surface of the base metal along the length direction of the heater; and a metal oxide, serving as a material likely to emit electrons and disposed so as to be in contact with the high-melting-point metal, and wherein a pair of the indirectly heated electrodes are sealed such that the high-melting- point metals oppose each other.

21. The gas discharge tube as set forth in any form in any of claims 1-5, 6, 8, 11, 14, 9, 10, 16 and 17-20, 12, 13, 15, wherein a rare gas, or a rare gas and mercury is or are sealed in the container.

22. The gas discharge tube as set forth in claim 21, wherein the container has a fluorescent film formed on the inner surface thereof.

23. A gas discharge tube comprising:

a container; and a pair of indirectly heated electrodes are sealed in an airtight manner in the container, wherein each of the indirectly heated electrodes comprises:

a heater, having an electrical insulating layer formed on a surface thereof;

an electron emitting part, emitting electrons upon receiving heat from the heater; and an electrical conductor, disposed at the surfacemost part of the electron emitting part and having a predetermined length, wherein the emitting part comprises: a metal oxide as a material likely to emit electrons; and a coil member, holding the metal oxide; and wherein the coil member is a multiple coil arranged by winding a coil having a mandrel in coil form.

24. The gas discharge tube as set forth in claim 23, wherein a pair of the indirectly heated electrodes are sealed such that the electrical conductors oppose each other.

25. The gas discharge tube as set forth in claim 23, wherein the electrical conductor is disposed in contact with the metal oxide and in contact with a plurality of coil portions of the coil member along the length direction of the coil member.

26. The gas discharge tube as set forth in claim 23, wherein the electrical conductor is a high-melting-point metal that has been formed to a mesh.

27. The gas discharge tube as set forth in claim 23, wherein the electrical conductor is a high-melting-point metal that has been formed to a wire or a plate.

28. The gas discharge tube as set forth in claim 23, wherein the metal oxide is an oxide of a single metal among barium, strontium, and calcium or a mixture of oxides of these metals or contains an oxide of a rare earth metal.

29. The gas discharge tube as set forth in claim 23, wherein each of the indirectly heated electrodes further comprises a tubular base metal; and wherein the heater is disposed at the inner side of the base metal and the electron emitting part is disposed at the outer side of the base metal.

30. The gas discharge tube as set forth in claim 29, wherein the tubular base metal is disposed in contact with the coil member.

31. The gas discharge tube as set forth in claim 23, wherein a rare gas, or a rare gas and mercury is or are sealed in the container.

32. The gas discharge tube as set forth in claim 31, wherein the container has a fluorescent film formed on the inner surface thereof.

33. The gas discharge tube as set forth in claim 23, wherein the gas discharge tube is driven by alternating current.

34. A gas discharge tube comprising:

a container; and a pair of indirectly heated electrodes are sealed in an airtight manner in the container, wherein each of the indirectly heated electrodes comprises:

a multiple coil member, arranged by winding a coil having a mandrel in coil form;

a heater, disposed at the inner side of the multiple coil member and having an electrical insulating layer formed on a surface thereof;

a high-melting-point metal, formed to a mesh and disposed along the length direction of the multiple coil member at the outer side of the multiple coil member; and a metal oxide, serving as a material likely to emit electrons and disposed so as to be in contact with the multiple coil member and the high-melting-point metal; and wherein a pair of the indirectly heated electrodes are sealed such that the high-melting- point metals oppose each other.

35. The gas discharge tube as set forth in claim 34, wherein the high- melting-point metal is in electrical contact with the multiple coil member at a plurality of locations.

36. The gas discharge tube as set forth in claim 34, wherein a rare gas, or a rare gas and mercury is or are sealed in the container.

37. The gas discharge tube as set forth in claim 36, wherein the container has a fluorescent film formed on the inner surface thereof.

38. The gas discharge tube as set forth in claim 34, wherein the gas discharge tube is driven by alternating current.

39. A gas discharge tube comprising:

a container; and a pair of indirectly heated electrodes are sealed in an airtight manner in the container, wherein each of the indirectly heated electrodes comprises:

a multiple coil member, arranged by winding a coil having a mandrel in coil form;

a heater, disposed at the inner side of the multiple coil member and having an electrical insulating layer formed on a surface thereof;

a high-melting-point metal, formed to a wire or a plate and disposed along the length direction of the multiple coil member at the outer side of the multiple coil member; and a metal oxide, serving as a material likely to emit electrons and disposed so as to be in contact with the multiple coil member and the high-melting-point metal; and wherein a pair of the indirectly heated electrodes are sealed such that the high-melting- point metals oppose each other.

40. The gas discharge tube as set forth in claim 39, wherein the high- melting-point metal is in electrical contact with the multiple coil member at a plurality of locations.

41. The gas discharge tube as set forth in claim 39, wherein a rare gas, or a rare gas and mercury is or are sealed in the container.

42. The gas discharge tube as set forth in claim 41, wherein the container has a fluorescent film formed on the inner surface thereof.

43. The gas discharge tube as set forth in claim 39, wherein the gas discharge tube is driven by alternating current.

* * * * *